US005371578A

United States Patent [19]

Asano et al.

[11] Patent Number: 5,371,578

[45] Date of Patent: Dec. 6, 1994

[54] IMAGE FORMING APPARATUS INCLUDING MEANS FOR REMOVING COUNTER CHARGED TONER FROM THE CHARGING MEANS

[75] Inventors: Masaki Asano, Amagasaki; Shuji Iino, Hirakata; Akihito Ikegawa, Sakai; Izumi Osawa, Ikeda, all of Japan

[73] Assignee: Minolta Camera Kabushiki Kaisha, Osaka, Japan

[21] Appl. No.: 137,223

[22] Filed: Oct. 18, 1993

Related U.S. Application Data

[63] Continuation of Ser. No. 901,766, Jun. 19, 1992, abandoned.

[30] Foreign Application Priority Data

| | | | |
|---|---|---|---|
| Jun. 21, 1991 | [JP] | Japan | 3-150141 |
| Aug. 30, 1991 | [JP] | Japan | 3-247020 |
| Aug. 30, 1991 | [JP] | Japan | 3-247021 |
| Aug. 30, 1991 | [JP] | Japan | 3-247022 |
| Dec. 16, 1991 | [JP] | Japan | 3-331714 |

[51] Int. Cl.[5] ..... G03G 15/02; G03G 21/00

[52] U.S. Cl. ..... 355/219; 355/221; 355/296

[58] Field of Search ..... 355/219, 221, 227, 296

[56] References Cited

U.S. PATENT DOCUMENTS

| | | | |
|---|---|---|---|
| 3,850,662 | 11/1974 | Jahn | 355/245 X |
| 4,469,435 | 9/1984 | Nosaki et al. | 355/303 |
| 4,481,275 | 11/1984 | Iseki et al. | 355/299 X |
| 4,939,542 | 7/1990 | Kurando et al. | 355/219 X |
| 4,959,688 | 9/1990 | Koitabashi | 355/219 |
| 5,006,902 | 4/1991 | Araya | 355/219 X |
| 5,012,282 | 4/1991 | Wanou et al. | 355/219 |
| 5,132,738 | 7/1992 | Nakamura et al. | 355/219 X |

FOREIGN PATENT DOCUMENTS

| | | |
|---|---|---|
| 63-43750 | 9/1988 | Japan . |
| 64-65574 | 3/1989 | Japan . |

*Primary Examiner*—Fred L. Braun

*Attorney, Agent, or Firm*—Burns, Doane, Swecker & Mathis

[57] ABSTRACT

An image forming apparatus includes electrostatic latent image carrier having a moving surface to be charged and contact charging device for selectively applying a first charging voltage and a second charging voltage to the surface to be charged, the second charging voltage having the same polarity as the first charging voltage and having an absolute value smaller than that of the first charging voltage, the first charging voltage being applied to an electrostatic latent image forming region of the surface to be charged, the first charging voltage being changed to the second charging voltage when a region confronting the contact charging device moves from the electrostatic latent image forming region to a non-image portion in accordance with movement of the surface to be charged.

10 Claims, 41 Drawing Sheets

BP : BFFORE PRINTING
IP : IMAGE PORTION
IIP : INTER-IMAGE PORTION
AP : AFTER PRINTING

IMAGE FORMING APPARATUS INCLUDING MEANS FOR REMOVING COUNTER CHARGED TONER FROM THE CHARGING MEANS

This application is a continuation of application Ser. No. 07/901,766, filed Jun. 19, 1992 now abandoned.

BACKGROUND OF THE INVENTION

1. Field of the Invention

The present invention relates to an electrophotographic image forming apparatus such as a copying machine and a printer, and more particularly to an image forming apparatus using a contact charging device.

2. Description of the Related Art

Electrophotographic image forming apparatuses employ charging devices for uniformly charging surfaces of electrostatic latent image carriers such as photosensitive drums. The charging devices can be basically classified into corona charging devices and contact charging devices. As the known contact charging devices, there are charging devices of fixed brush charging devices, rotatable brush charging devices, roller charging devices, blade charging devices, magnetic brush charging devices and others.

However, in the electrophotographic image forming apparatus, toner fragments other than the toner may be produced in the developing devices and others. The toner fragments are charged at the polarity opposite to the regular or proper charge polarity of the toner. The toner fragments may adhere to a surface of an electrostatic latent image carrier, and may not be removed sufficiently by a cleaning device. Also, shaved powder or the like of the electrostatic latent image carrier having the polarity opposite to the regular charge polarity of the toner may be produced. The shaved powder or the like may not be removed by the cleaning device.

For example, if a contact charging device is used as a device for charging the surface of the electrostatic latent image carrier prior to formation of the electrostatic latent image, these toner fragments, shaved powder and others having the opposite polarity (also referred to as counter charged toner) may adhere to the charging device, which results in defective charging and thus image noises called as striped noises.

As measures for solving the foregoing problem, the Japanese Examined Patent Publication No. 63-43750 (43750/1988) has taught a technique in which a voltage, which includes a D.C. component of the same polarity as the charge polarity of the electrostatic latent image carrier, is applied to the charging device in the charging operation, and a voltage, which includes a D.C. component having the polarity opposite to the charge polarity of the electrostatic latent image carrier, is applied to the electrostatic latent image carrier when the charging operation is not carried out, so that stain by the fine powder adhered to the charging device may be removed.

However, in the foregoing prior art, the stain by the fine powder adhered to the contact charging device is removed by charging the surface of the electrostatic latent image carrier at the polarity opposite to the regular charge polarity, so that the charge of the opposite polarity is accumulated on and in the surface of the electrostatic latent image carrier. As a result, this charge may cancel the regular charge of the regular polarity which is used for the regular charging of the surface of the electrostatic latent image carrier in a subsequent image forming step, resulting in reduction of the amount of the charge and/or irregular charging.

SUMMARY OF THE INVENTION

Accordingly, it is an object of the invention to provide an image forming apparatus using contact charging means, in which the stain by the fine powder adhered to the charging means may be facilely eliminated without disadvantages such as reduction of the amount of charge on the surface of the electrostatic latent image carrier and irregular charging.

Another object of the invention is to provide an image forming apparatus using contact charging means, which can suppress the adhesion of the toner, which is charged at the polarity opposite to the regular charge polarity, onto a non-image portion, e.g., a portion between images of a surface of the electrostatic latent image carrier, whereby consumption of toner is suppressed, and the stain of contact transfer means, if used, can be suppressed.

The inventors have researched to achieve the above-noted objects and developed the present invention based on discovery that, if a voltage, which has the same polarity as a regular charge polarity of a surface of an electrostatic latent image carrier and has an absolute value lower than that of a regular voltage applied by a contact charging device, is applied to a non-image portion, e.g., a portion between images, fine powder of the polarity opposite to the regular charge polarity of the toner moves toward the electrostatic latent image carrier.

DETAILED DESCRIPTION OF THE INVENTION

According to the invention, an image forming apparatus using a contact charging means includes means, which applies a voltage to the charging means during a non-image period, e.g., a period for which a portion of a surface of an electrostatic latent image carrier bearing no image to be developed passes over the charging means. The voltage applied during the non-image period has the same polarity as a charge polarity of the electrostatic latent image carrier and has an absolute value lower than that of a regular voltage applied to the contact charging means during the regular image forming period, i.e., period other than the non-image period.

In the specification and accompanied claims, 0 V, i.e., the ground voltage is contained in "the voltage having the same polarity as the charge polarity of the electrostatic latent image carrier and having the absolute value lower than that of the regular voltage applied to the charging means".

In the specification and accompanied claims, "the non-image period" contains an inter-image period, i.e., a period during which an inter-image portion (i.e., a portion of a surface of an electrostatic latent image carrier located between portions of the surface bearing images to be developed) passes over the charging means, and also contains periods before first printing and/or copying operations and after final printing and/or copying operations. The voltage of which absolute value is lower than that of the regular voltage is applied to the charging means so as to apply the voltage to a part of or a whole area of the non-image portion which passes over the charging means during the non-image period.

Timings for applying the voltage may be so determined that the voltage is applied several times in one printing or copying operation, in which case, voltages of different values may be applied at respective times.

Another aspect of the invention provides an image forming apparatus using a contact charging means, in which a voltage in a pulse-like form is applied to charging means at a period not more than {(charging width)/(moving speed of a surface of an electrostatic latent image carrier)}, this voltage having the same polarity as the charge polarity of the electrostatic latent image carrier and having an absolute value lower than that of a regular voltage applied to the charging means.

According to the image forming apparatus, in the charging operation for applying the regular charging voltage to form the image, an absolute potential of the charging means is significantly higher than an absolute potential of the surface of the electrostatic latent image carrier, so that toner fragments, shaved powder of the electrostatic latent image carrier and others, which are charged at the polarity opposite to a regular charge polarity of the toner, adhere to the charging means. However, the voltage, which has the same polarity as the charge polarity of the electrostatic latent image carrier and the absolute value lower than that of the regular voltage applied to the charging means and is lower than the surface potential of the electrostatic latent image carrier, is applied to the charging means during the non-image period, so that the toner fragments and others, which are adhered to the charging means and have been charged at the polarity opposite to the regular charge polarity, move toward the charged electrostatic latent image carrier bearing the charge, and thus the stain by the fine powder on the charging means is removed.

Also during the non-image period, the toner fragments and others are partially removed owing to the application of the voltage, which has the same polarity as the charge polarity of the electrostatic latent image carrier and the absolute value lower than that of the regular voltage applied to the charging means and is higher than the surface potential of the electrostatic latent image carrier. The reason for this can be considered as that, the change of the voltage applied to the charging means causes the change of an electrostatic attractive force between the charging means and the surface of the electrostatic latent image carrier. The reason for this can also be considered as that the change of the electrostatic attractive force causes the vibration and thus drop of the toner fragments and other.

Still another aspect of the invention provides an image forming apparatus using a contact charging means, in which the contact charging means itself charges a surface of an electrostatic latent image carrier to form a charged region, and then the charged region is contacted again with the contact charging means during which a voltage is applied to the charging means, this voltage having the same polarity as the surface potential of the charged region and having an absolute value lower than that of the surface potential.

In this case, the charging of the electrostatic latent image carrier by the contact charging means is carried out in such a manner that the voltage applied to the contact charging means is changed to the voltage (including 0 V) having the absolute value lower than that of the potential, which has already been charged in the electrostatic latent image carrier, for example, after one rotation of the electrostatic latent image carrier, if it is of a rotary type, and after one reciprocation of the electrostatic latent image carrier, if it is of a reciprocative type.

According to the image forming apparatus, when the regular charging voltage for forming the image is applied to the contact charging means from which the stain is to be removed, the absolute potential of the charging means is higher than the absolute potential of the surface of the electrostatic latent image carrier, so that toner fragments, shaved powder of the electrostatic latent image carrier and others, which are charged at the polarity opposite to the regular charge polarity of the toner, adhere to the charging means. However, the charged region, which has been formed by charging the surface of the electrostatic latent image carrier by the contact charging device, is contacted again with the stained contact charging device, which receives the voltage having the same polarity as the surface potential of the charged region and having the absolute value lower than that of the surface potential. Thereby, the toner fragments and others, which are adhered to the contact charging means and have been charged at the opposite polarity, move toward the electrostatic latent image carrier bearing the charge, and thus the stain by the fine powder on the contact charging means is removed.

Further another aspect of the invention provides an image forming apparatus using a contact charging means, in which charging means other than the contact charging means charges a non-image portion of the electrostatic latent image carrier to have the same polarity as the regular charge polarity of an image formation portion, and a voltage is applied to the charged region of the non-image portion by the contact charging means, this voltage having the same polarity as the surface potential of the charged region of the non-image portion and having an absolute value lower than that of the surface potential.

Here, "the voltage applied by the contact charging means and having the same polarity as the surface potential of the charged region of the non-image portion and the absolute value lower than that of the surface potential" contains 0 V, i.e., the ground potential.

The charging means other than the contact charging means may be formed of transfer means, of which primary purpose is to transfer a toner image formed on the electrostatic latent image carrier in the developing step to a recording material, and may be also formed of additionally provided charging means.

The charging means other than the contact charging means may be of various types such as a brush type, a roller type and a corona charging type. A cleaning blade of a cleaner contacting the electrostatic latent image carrier may be used also as the charging means.

According to the image forming apparatus, when the regular charging voltage for forming the image is applied to the contact charging means from which the stain is to be removed, the absolute potential of the contact charging means is higher than the absolute potential of the surface of the electrostatic latent image carrier, so that toner fragments, shaved powder of the electrostatic latent image carrier and others, which are charged at the polarity opposite to the regular charge polarity of the toner, adhere to the contact charging means. However, the charging means other than the contact charging means charges the surface of the electrostatic latent image carrier at the same polarity as the regular charge potential of the image forming portion, and the contact charging means applies to the charged region the voltage having the same polarity as the surface potential of the charged region and having the absolute value lower than that of the surface potential. Thereby, the toner fragments and others, which are adhered to the contact charging means and have been charged at the opposite polarity , move toward the electrostatic latent image carrier bearing the charge, and thus the stain by the fine powder on the contact charging means is removed.

The inventors have also paid the attention to the fact that the non-image portion on the electrostatic latent image carrier, which is charged by the charging means or has the surface potential not reduced to a large extent after the charging, is subjected, for example, to full turn-on exposure by an electrostatic latent image forming means to change its surface potential to a post-exposure potential, and the developing bias potential applied to the developing means is changed to 0 V, whereby the potential difference can be reduced, and thus the adhesion of the toner, which is charged at the polarity opposite to the regular charge polarity, to the non-image portion can be remarkably suppressed.

Further examination relating to the development has been carried out in such a manner that a toner carrying sleeve of a developing device which uses negatively chargeable one-component developer is contacted with the negatively chargeable photosensitive drum, and a difference (Vo−Vi) between a surface potential Vo of the photosensitive drum and a developing bias potential Vb is variously changed for the development. The result is shown in FIG. 40.

Based on them, the present invention provides an image forming apparatus, in which a moving surface of an electrostatic latent image carrier is charged by charging means to form a charged region, which is subjected to an image exposure by electrostatic latent image forming means to obtain an electrostatic latent image, the electrostatic latent image is developed into a toner image by developing means, and the toner image is transferred onto a transfer member by transfer means. In this image forming apparatus, developer is one-component developer containing toner as a major component, one or more non-image portions on the electrostatic latent image carrier is set to have a surface potential of Vi, a developing bias potential of the developing means is Vb for the non-image portion(s) having the potential of Vi, these potentials Vi and Vb preferably satisfy a relationship of $50\ V \leqq |X=Vi-Vb| \leqq 250\ V$, and a polarity of the "X" is the same as the regular charging polarity of the toner.

The present invention further provides an image forming apparatus, in which a moving surface of an electrostatic latent image carrier is charged by charging means to form a charged region, which is subjected to an image exposure by electrostatic latent image forming means to obtain an electrostatic latent image, the electrostatic latent image is developed into a toner image by developing means, and the toner image is transferred onto a transfer member by transfer means. In this image forming apparatus, developer is two-component developer containing toner and carrier as major components, one or more non-image portions on the electrostatic latent image carrier is set to have a surface potential of Vi, a developing bias potential of the developing means is Vb for the non-image portion(s) having the potential of Vi, these potentials Vi and Vb preferably satisfy a relationship of $0\ V \leqq |X=Vi-Vb| \leqq 100\ V$, and a polarity of the "X" is the same as the regular charging polarity of the toner.

In the development with the one-component developer, if $|X=Vi-Vb|$ is 0 V or a value near 0 V, there may be caused fog adhesion of the regularly charged toner. Therefore, 50 V, $\leqq |X|$ is preferable. Also $|X| \leqq 250$ is preferable in order to prevent the fog adhesion of the oppositely charged toner. In the development of the two-component developer, the toner is not separated from the carrier even if $|X|=0$, and thus hardly moves to the non-image portion. Therefore, $|X|=0$ does not cause a problem. In practice, it is desirable to prevent adhesion of the carrier, and it is difficult to set Vi at 0 V . Meanwhile, Vb can be facilely set at 0 V by the grounding. Therefore, $|X|$ may be 50 V or more (e.g., about 100 V ).

The surface potential of the non-image portion may be reduced to Vi, for example, by full turn-on exposure of the electrostatic latent image forming means, exposure by an additionally provided exposure means, and application of the opposite charge by the contact charging means.

In image forming operation by the image forming apparatus described above, one or more non-image portions have the surface potential of Vi, the developing bias potential is Vb, these potentials Vi and Vb preferably satisfy the relationship of $50\ V \leqq |X=Vi-Vb| \leqq 250\ V$, if the one-component developer is used, and the relationship of $0\ V = |X=Vi-Vb| \leqq 100\ V$, if the two-component developer is used, and the polarity of the "X" is the same as the regular charge polarity of the toner whichever the toner may be used. Thereby, the adhesion of the oppositely charged toner to the non-image portion is suppressed.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

An embodiment of the invention described below relates to a printer shown in FIG. 1.

Figure 1:
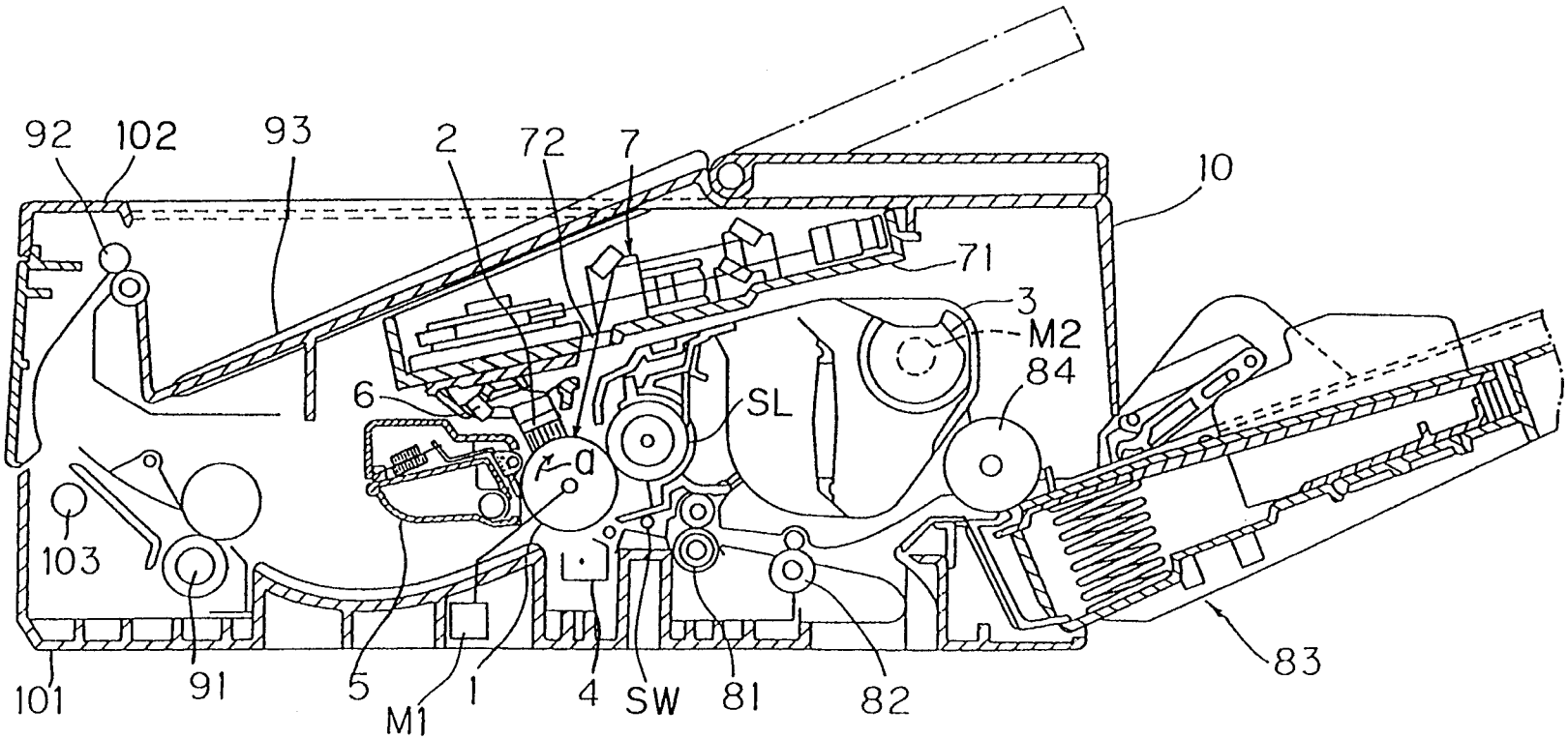
FIG. 1 is a cross section showing a schematic construction of a printer of an embodiment of the invention.

The printer shown in FIG. 1 is provided at its central portion with a photosensitive drum 1, i.e., electrostatic latent image carrier driven to rotate in a direction indicated by an arrow a in the figure by a motor M1. Around the drum 1, there are sequentially disposed a fixed brush charging device 2, a developing device 3 having an electrically conductive sleeve SL to which a developing bias voltage Vb is applied, a transfer charger 4, a cleaning device 5 and an eraser 6 for erasing a residual charge. The developing sleeve is rotated by a motor M2.

Above the photosensitive drum 1, there is provided an optical system 7 including a housing 71 which accommodates a semiconductor laser generator, a polygon mirror, a toroidal lens, a half mirror, a spherical mirror, a return mirror, a reflection mirror and others. The housing 71 is provided at its floor with an exposure slit 72. The image exposure can be applied onto the photosensitive drum 1 through the exposure slit 72 and a space between the charging device 2 and the developing device 3.

At the right side to the photosensitive drum 1 in the figure, there are sequentially disposed a timing roller pair 81, an intermediate roller pair 82 and a sheet feed cassette 83 to which a feed roller 84 is opposed. At the left side to the photosensitive drum 1 in the figure, there are sequentially disposed a fixing roller pair 91 and a discharge roller 92, to which a sheet discharge tray 93 is opposed.

The part and portions described above are mounted on a main body 10 of the printer. The main body 10 is formed of lower and upper units 101 and 102. The upper unit 102 carries the charging device 2, developing device 3, cleaning device 5, optical system 7, upper roller of the timing roller pair 81, upper roller of the intermediate roller pair 82, feed roller 84, upper roller of the fixing roller pair 91, discharge roller pair 92 and sheet discharge tray 93. The upper unit is pivotable around a shaft 103 disposed at the left end portion of the printer so that the end at the sheet feeding side of this unit may be upwardly opened for the restoration from the jamming state and various kinds of maintenance.

Figure 2A:
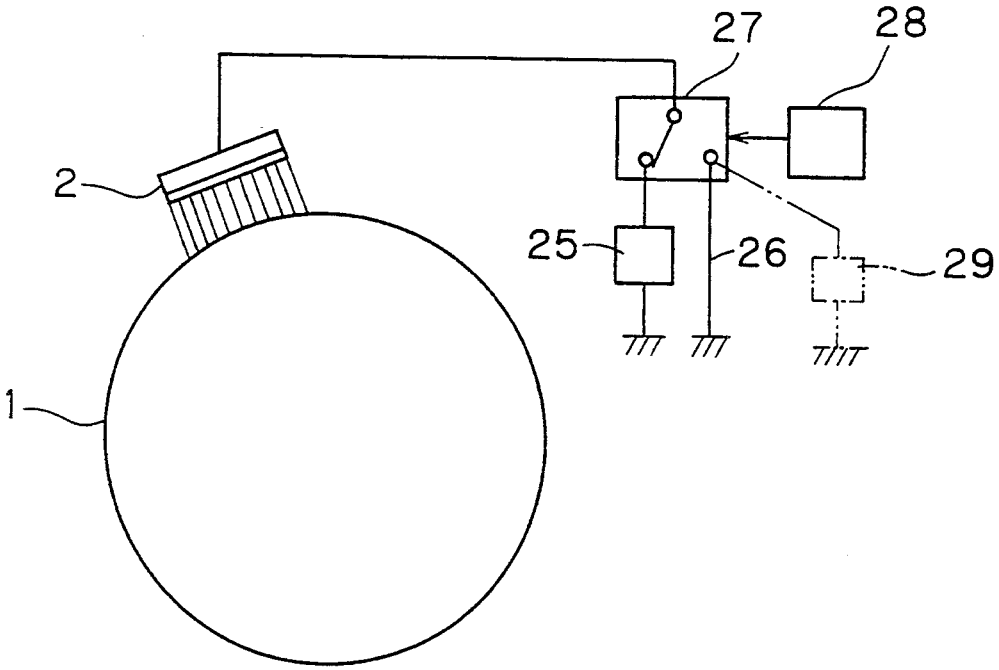
FIG. 2(A) shows means for applying a voltage to a charging device in a printer in FIG. 1.

As shown in FIG. 2(A), a power supply 25 for applying a regular charging voltage (−1.1 KV in this embodiment) and a line 26 for grounding the device 2 are selectively connected the charging device 2 through a switch 27, which is controlled by a switch controller 28. The controller 28 controls the switch 27 in such a manner that the line 26 is connected to the device 2 during a non-image period between actual image forming operations in a printing operation for continuously obtaining a plurality of printed sheets, and that the power supply 25 is connected to the device 2 during the actual image forming operation. As indicated by imaginary line in FIG. 2(A), the ground line 26 may be replaced with a power supply line 29 supplying a voltage of an absolute value lower than that of the voltage supplied by the power supply 25.

A system speed of the printer, i.e., a peripheral speed of the photosensitive drum 1 is 3.5 cm/sec. The developing device 3 is a contact developing device, which uses one-component developer and carries out reversal development with the developing bias voltage (−250 V in the embodiment), using the toner of the same charge polarity as that of the drum 1.

The photosensitive drum 1 is a negatively chargeable photosensitive member of a function-separated type which has the sensitivity to the long wave light, and is manufactured as follows.

Photosensitive liquid is formed of $\tau$-type non-metal phthalocyanine at 1 weight part, polyvinyl butyral resin at 2 weight parts and tetrahydrofuran at 100 weight parts. This liquid is kept in a ball mill pot for 24 hours to be dispersed. The photosensitive liquid thus manufactured is applied to a base member, i.e., a cylindrical aluminium member by a dipping method, and then is dried to form a charge generating layer of 0.4 $\mu$m in thickness.

Then, liquid, which contains hydrazone compound having a following structural formula, is used.

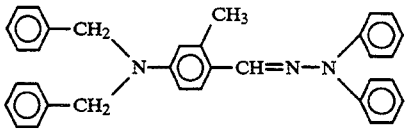

This liquid includes the above hydrazone compound at 8 weight parts, as well as orange pigment (Sumiplast Orange 12 manufactured by Sumitomo Kagaku Kabushiki Kaisha) at 0.1 weight part, and polycarbonate resin at 10 weight parts which are dissolved into solvent of tetrahydrofuran at 180 weight parts. This liquid is applied to the charge generating layer by the dipping method, and then is dried to form a charge transmitting layer of 18 $\mu$m in thickness. In this manner, the photosensitive drum 1 is manufactured.

The electrostatic latent image carrier other than the above may be used in the present invention.

In an imaging system using a long wave light source such as a laser optical system and LED array, there is used the photosensitive member having the sensitivity to the long wave as described above. In an imaging system which employs a liquid crystal shutter array, PLZT shutter array or the like and utilizes visible light as the light source, there is used the photosensitive member having the sensitivity to the relative visible range. Also in the visible light imaging system provided with lens and mirror optical system which are used in an ordinary analog PPC, there is used the photosensitive member having the sensitivity to the relative visible range.

There is no restriction with respect to the material of the image carrier, and the image carrier may be the organic photosensitive member of the function-separated type described before or a photosensitive member of a single layer structure. Various known material other than those described before may be used for the charge generating material, charge transmitting material, binder resin and others. Also, inorganic material such as zinc oxide, cadmium sulfide, selenium alloy and amolphous silicone may be used.

A surface protective layer may be formed on the outermost surface of the photosensitive member. This protective layer may be formed of resin such as ultraviolet setting resin, cold setting resin and thermosetting resin. It also may be formed of resin in which resistance adjusting agent is dispersed in the above resin. Further, it may be formed of a thin film which is prepared by vacuum deposition, ion plating or the like of metal oxide or metal sulfide. Moreover, it may be formed of amolphous carbon film which is formed by plasma-polymerization of gas containing hydrocarbon.

The base member also may be formed of various material having the electrical conductivity, and may be of a flat shape or a belt-like shape, depending on the imaging system.

If used light source emits coherent light, the base member may be roughened or blackened to prevent so-called interference pattern.

The toner used in the developing device 3 described before is of a negative chargeable type, and is manufactured from the following composition. The composition is formed of bisphenol A polyester resin at 100 weight parts, carbon black MA#8 (manufactured by Mitsubishi Kasei Kogyo Kabushiki Kaisha) at 5 weight parts, Bontron S-34 (manufactured by Orient Kagaku Kogyo Kabushiki Kaisha) at 3 weight parts, and Viscorl TS-200 (manufactured by Sanyo Kasei Kogyo Kabushiki Kaisha) at 2.5 weight parts. This composition is kneaded, ground and classified to manufacture toner particles having a mean diameter of 10 $\mu$m and a distribution, in which 80 weight percents are included in a range of the particle diameters from 7 $\mu$m to 13 $\mu$m. Hydrophobic silica (Tanolux 500 manufactured by Talco Co.) at 0.75 weight percents is added as fluidization agent to the toner particles, and mixed and agitated by a homogenizer.

Figure 3A:
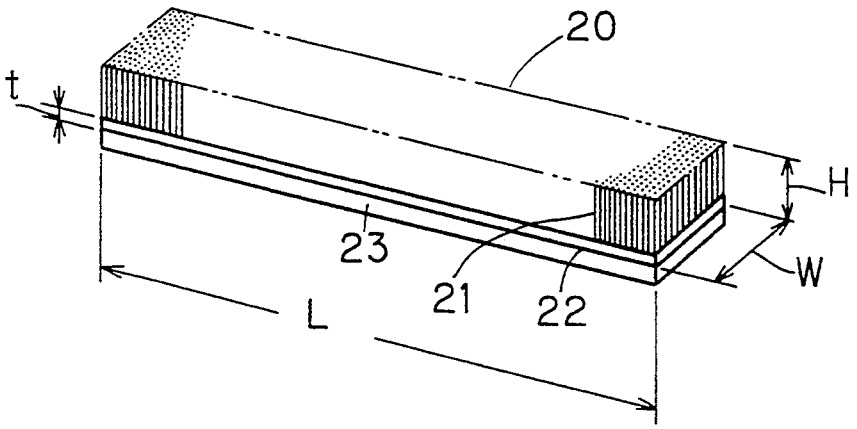
FIG. 3(A) is a perspective view of a charging device.
Figure 3B:
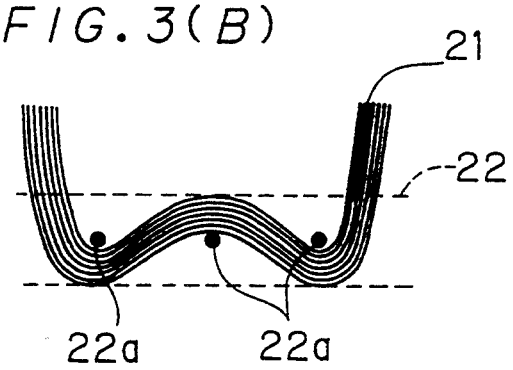
FIG. 3(B) shows an example of a manner for weaving brush fibers in a charging brush.
Figure 3C:
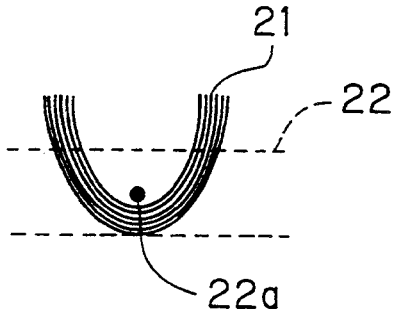
FIG. 3(C) shows another example of a manner for weaving brush fibers in a charging brush.

The fixed brush charging device 2 has the structures shown in FIG. 3(A), and includes electrically conductive rayon fibers 21 of 6 deniers. The rayon fiber 21 has an electrical resistivity of about $1\times10^5$ $\Omega$·cm and contains conductive carbon powder at 18 wt.% with respect to the whole weight. As shown in FIG. 3(B), bundles, each including 100 fibers, are woven in a W-form into warps 22*a* of a base cloth 22 having a thickness t of about 1 mm to obtain a fiber density of 15000 fibers/cm$^2$. The rear surface of the base cloth 22 is coated with electrically conductive adhesive, by which the base cloth 22 is fixed to a back plate 23 of aluminium. A brush 20 thus formed has a length L of 240 mm, width of 10 mm and a height H of 5 mm. The fibers 21 may be woven in a V-form, as shown in FIG. 3(C).

The brush may be formed of various kinds of fibers having an appropriate electrical conductivity.

The conductive material may be metal wires of tungsten, stainless steel, gold, platinum, iron, copper, aluminium and others.

The electrically conductive resin may be formed of resin such as rayon, nylon, acetate, cuprammonium, vinylidene, vinylon, ethylene fluoride, promix, benzoate, polyurethane, polyester, polyethylene, polyvinyl chloride, polychlal, polynosic, polypropylene and resistance adjusting agent dispersed therein. The resistance adjusting agent may be carbon black, carbon fiber, metal powder, metal whiskers, metal oxide, semiconductor and others. An appropriate resistance may be obtained by adjusting the amount of the resistance adjusting agent dispersed in the fiber. Instead of dispersion, the surface of the fiber may be covered with the resistance adjusting agent.

In this printer, the surface of the photosensitive drum 1 is uniformly charged to a predetermined potential by the charging device 2 connected to the power supply 25, and a charged area is subjected to the image exposure by the optical system 7 to form an electrostatic latent image. The electrostatic latent image thus formed is developed by the developing device 3 into a toner image, which is moved to a transfer region opposed to the transfer charger 4.

Meanwhile, a transfer sheet of paper is drawn by the feed roller 84 from the sheet feed cassette 83 through the intermediate roller pair 82 to the timing roller pair 81, from which the sheet is fed to the transfer region in synchronization with the toner image on the drum 1. In the transfer region, the transfer charger 4 transfers the toner image formed on the drum 1 to the transfer sheet. The transfer sheet moves to the fixing roller pair 91, at which the toner image is fixed, and then the sheet is discharged by the discharge roller pair 92 to the discharge tray 93.

After the transfer of the toner image, the toner remaining on the photosensitive drum 1 is mechanically cleaned off by the cleaning device 5, and then the residual charge on the surface is removed by the whole surface exposure applied by the eraser 6 to have the reduced surface potential of about 0 V.

In the printing operation described above, the toner is to be charged at the regular polarity, i.e., negative polarity. However, there may be generated defective toner charged at the opposite polarity, i.e., positive polarity due to the defective charging and/or breakage of the toner. Also, there may be generated fine shaved powder of the photosensitive drum 1 and other fine powder which are charged at the positive polarity, due to the contact of the charging device 2 with the surface of the photosensitive drum 1. A part of these defective toner and fine powder adhered to the drum 1 may reach the charging device 2 without being cleaned off by the cleaning device 5. If the charging device 2 were in a state of receiving the regular charging voltage ($Vc=-1.1$ KV) from the power supply 25 when the defective toner and fine powder reached the charging device 2, they would adhere to the brush hairs 21. This is because the potential of the brush hairs of the charging device set by the power supply 25 is the negative polarity, and has the absolute value higher than that of the negative potential of the surface of the photosensitive drum 1. Therefore, in the printer of this embodiment, the controller 28 operates the switch 26 to switch the charging device 2 to the ground potential in a period between the continuous printing operations. Thereby, the voltage applied to the charging device 2 becomes zero, while the surface of the photosensitive drum, of which potential does not instantaneously reduces to 0 V, maintains the negative charging charge. Accordingly, the fine powder of the positive polarity adhered to the brush hairs moves to a non-image portion, i.e., inter-image portion of the surface of the photosensitive drum, and thus the fine powder staining the charging device 2 is removed. However, in the cleaning operation of the fine powder, the voltage of the positive polarity, which is opposite to the charge polarity (i.e., negative polarity) of the photosensitive drum 1, is not applied to the charging device 2. Therefore, unpreferable positive memory is not generated on the photosensitive drum, and thus the surface of the photosensitive drum is uniformly charged with a predetermined charge amount when the regular charging voltage is applied to the photosensitive drum for the printing.

As already described, the time(s) of application of the voltage, of which absolute value is lower than that of the regular voltage, to the contact charging device may be one for every print image, or may be more than one. Also, the times may be one for more than one print images. Further, the times of application may be set small in an initial stage in which the contact charging device is not stained to a large extent, and the times of application may be increased at a later stage in which the degree of stain has increase in accordance with the number of the printed sheets.

If the voltage is applied more than one time, the voltage for each application may be uniform or may be different from the others, if the applied voltage has the same polarity as the regular voltage or is 0 V.

The applied voltage may have a square wave form as well as other wave form such as a sinusoidal wave form and a triangular wave form.

FIGS. 4–8 are timing charts showing a print instruction generated by a personal computer (not shown) connected to the printer, a print start signal which is generated by the printer itself upon confirmation of the state allowing the printing, a voltage Vc applied to the charging device 2, a bias voltage Vb applied to the developing device 3, and an operation state of a switch SW shown in FIG. 1 which is disposed slightly upstream to the transfer region and operates to detect a rear or trailing edge of the transfer sheet (i.e., is turned off when the rear edge of the transfer sheet passes through it). If the charge potential were grounded during the non-image period described before and the non-image portion moved to the developing device 3, the whole surface would be developed, resulting in so-called solid black development. This causes wasteful consumption of the toner. Therefore, it is preferable to change the bias voltage Vb for the non-image portion in accordance with the change of the charging voltage Vc for preventing the solid black development. Specifically, if the voltage Vc is changed to 0 V, it is preferable to changed the voltage Vb to have the polarity opposite to that of the regularly and normally applied voltage.

Figure 2B:
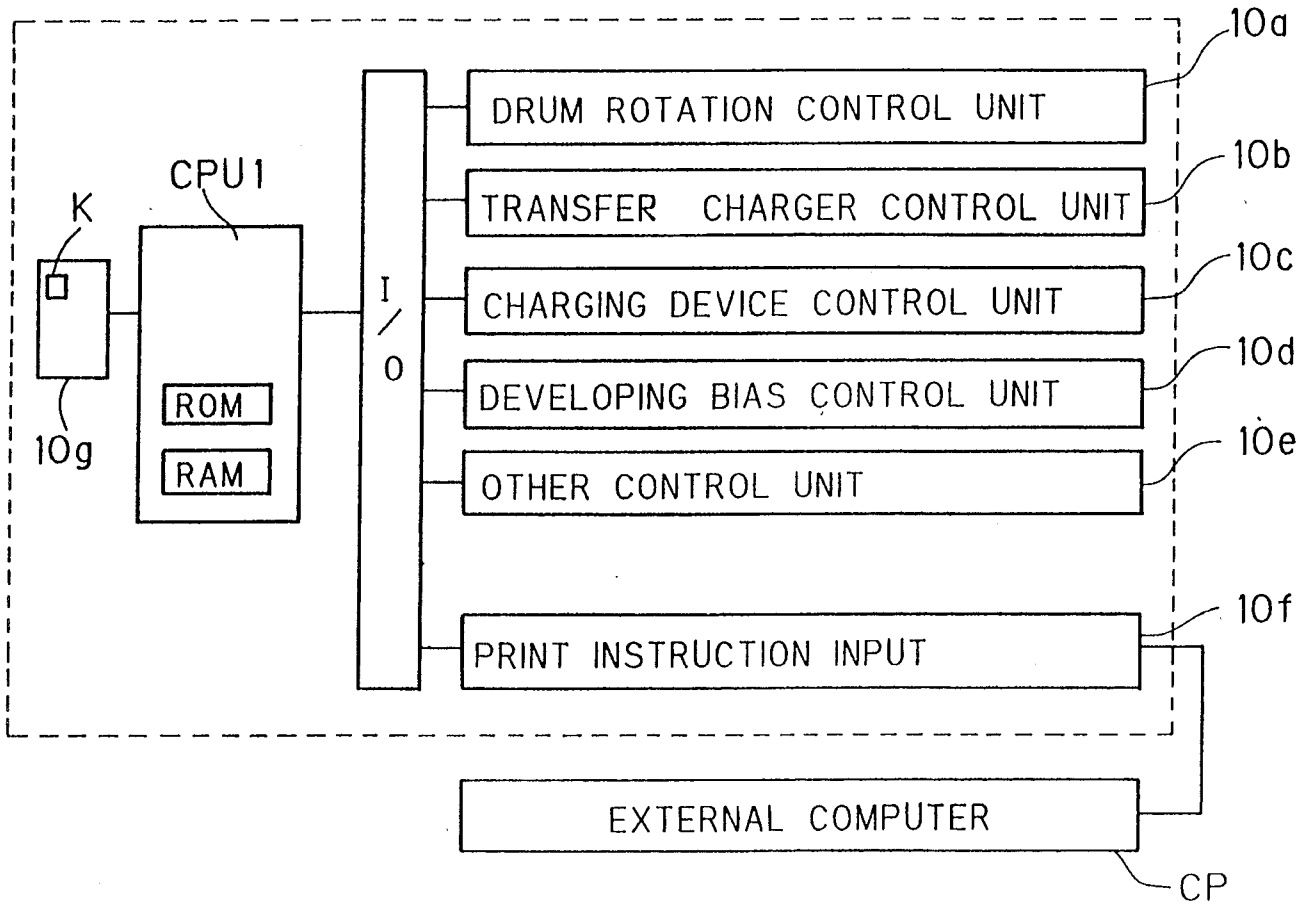
FIG. 2(B) is a block diagram showing a major part of a control circuit of a printer in FIG. 1.

FIG. 2(B) is a block diagram showing a major part of a control circuit of the printer. This control circuit includes, as a major component, a microprocessor CPU1 including a read only memory (also called as "ROM" hereinafter) and a random access memory (also called as "RAM" hereinafter). The whole operation of the printer is controlled by this microprocessor CPU1.

The microprocessor CPU1 is connected through an interface circuit I/O to a rotation control unit **10*a* for the photosensitive drum 1, a control unit 10*b* for the transfer device 4, a control unit 10***c* for the charging device 2, a developing bias control unit 10*d*, and other control unit 10*e*, and is also connected to a print instruction input 10*f*.

The processing program of the microprocessor CPU1 is stored in the ROM. The print instruction input 10*f* receives a printer control signal from an external computer such as a personal computer CP and sends the same to the microprocessor CPU1.

The ROM has also stored time periods from the receipt of the print instruction to various actions such as start and stop of the rotation of the photosensitive drum 1, application of the voltage $V_T$ to the transfer charger 4, changing of the voltage $V_T$, interruption of the voltage $V_T$, application of the voltage Vc to the charging device 2, changing of the voltage Vc, interruption of the voltage Vc, application of the developing bias Vb, changing of the voltage Vb and interruption of the voltage Vb. Based on these stored contents, ON-signals, OFF-signals and switch selection signals are supplied through the interface I/O to the photosensitive drum rotation control unit 10*a*, transfer charger control unit 10*b*, charging device control unit 10*c*, and developing bias control unit 10*d*. The change of the voltage Vc applied to the charging device 2 is instructed by the control unit 10*c*. The change of the developing bias voltage Vb applied to the developing device 3 is instructed by the control unit 10*d*. The change of the voltage $V_T$ applied to the transfer charger 4 is instructed by the control unit 10*b*.

The microprocessor CPU1 is also connected to a operator panel 10*g*, which is provided with a print key K for allowing the start of print.

Figure 9:
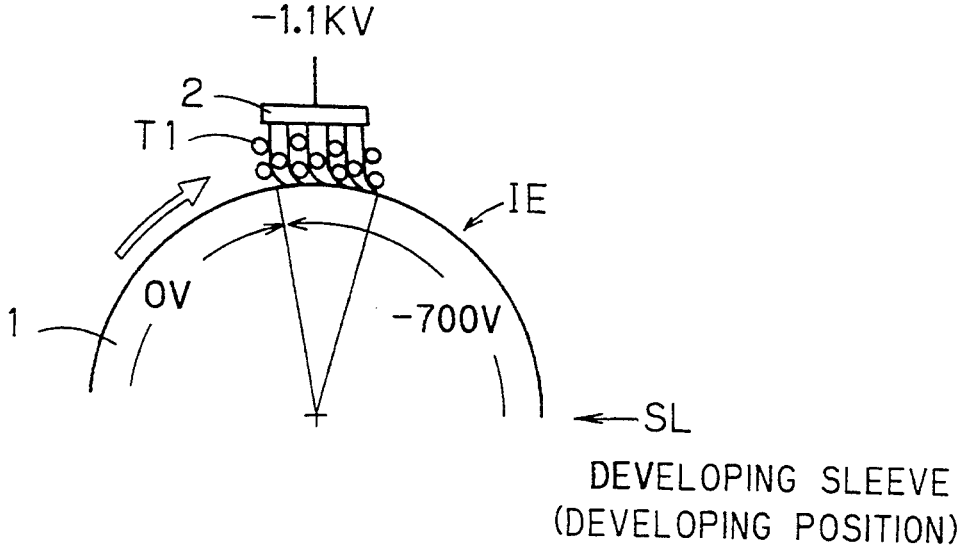
FIG. 9 is a diagram for explaining a charging operation for a photosensitive drum in an image forming operation.
Figure 10:
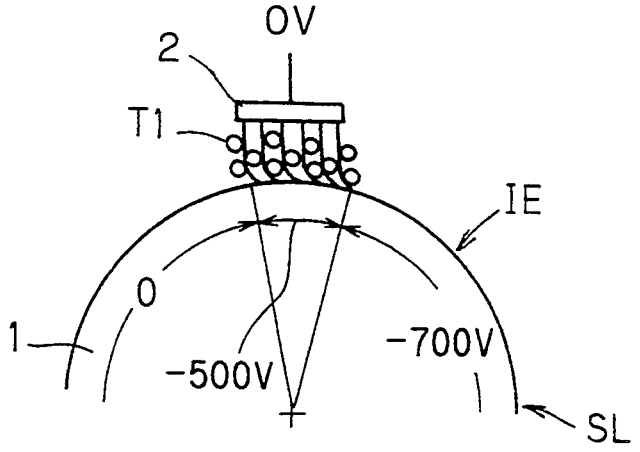
FIG. 10 is a diagram showing a state in which a voltage applied to a charging device is set at 0 V during a non-image period.
Figure 11:
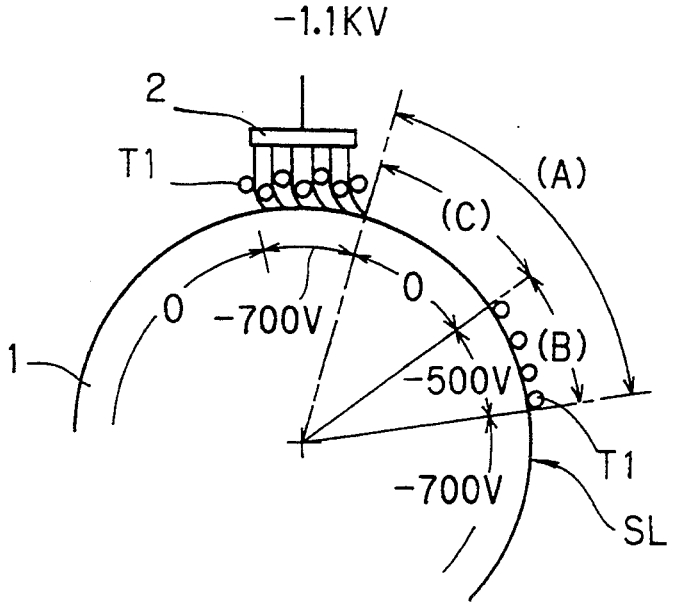
FIG. 11 is a diagram showing a solid black development.

The foregoing is illustrated more specifically in FIGS. 9–11. FIG. 9 shows a state of the image forming stage (electrostatic latent image forming stage) in which the voltage of −1.1 KV is applied to the charging device 2 to charge the surface of the photosensitive drum 1 at −700 V. The electrostatic latent image is formed on the surface of the photosensitive drum 1 by image exposure IE applied by the optical system 7, and is developed in the developing position with the toner (not shown) charged at the negative polarity by the developing device 3. During this operation, toner fragments T1 and others charged at the opposite polarity adhere to the charging device, as described before.

Therefore, as shown in FIG. 10, the voltage applied to the charging device 2 for the non-image portion, i.e., region at which the electrostatic latent image is not formed, is set to be a voltage (e.g., of 0 V in this case) of the absolute value lower than that of the regular voltage (−1.1 KV). Thereby, the potential of the surface of the photosensitive drum 1 instantaneously lowers to about −500 V, so that the toner fragments T1 and others, which have been positively charged and have adhered to the charging device 2, are attracted to the surface of the photosensitive drum by the electrostatic attractive force.

As shown in FIG. 11, a front half portion B of the inter-image portion A, i.e., the portion which was located immediately below the charging device 2, has the surface potential of −500 V. However, the surface potential of a rear half portion C has been reduced to 0 V due to the whole surface exposure by the eraser 6. The positively charged defective toner moves onto the front half portion (having the surface potential of −500 V) of the inter-image portion of the photosensitive drum 1, and may be collected by the developing device 3 and the cleaning device 5, but does not move onto the rear half portion (having the surface potential of 0 V) of the inter-image portion of the photosensitive drum 1. Further, the negatively charged toner from the developing device 3 may be fully moved on the rear half portion C and may form the solid black, because the developing bias voltage Vb of the developing device 3 is +250 V. Therefore, it is necessary to change the developing bias voltage Vb for the inter-image portion A so as to prevent the consumption of the toner. For example, the developing bias voltage Vb is changed to the positive polarity, e.g., of −250 V. Thereby, the inter-image portion is not developed with the negative toner. The negative toner both on the front and rear portions B and C of the inter-image portion A is electrostatically attracted from the photosensitive drum 1 toward the developing sleeve SL, and thus unnecessary development can be prevented.

In a modification, the voltage, of which absolute value is lower than that of the regular voltage applied to the contact charging device 2, is applied to the inter-image portion, and the application of the regular voltage is started again until the trailing edge, in the moving direction of the surface of the photosensitive drum, of the portion having the reduced surface potential of −500 V completely passes through the contact charging device 2. Thereby, the portion of the surface potential of 0 V is not formed even in the inter-image portion, and the change or switch of the developing bias Vb is not required. This can be represented by the following expression:

$$T_L(\text{sec.}) \leqq T_N(\text{sec.}) \quad (1)$$

where $T_L$ is a time period (second) for application of the voltage of which absolute value is lower than that of the regular voltage applied to the contact charging device. $T_N$ is a value obtained by division of a nip width (mm) between the contact charging device and the electrostatic latent image carrier (photosensitive drum) by a peripheral speed (mm/sec) of the electrostatic latent image carrier (photosensitive drum).

Figure 12:
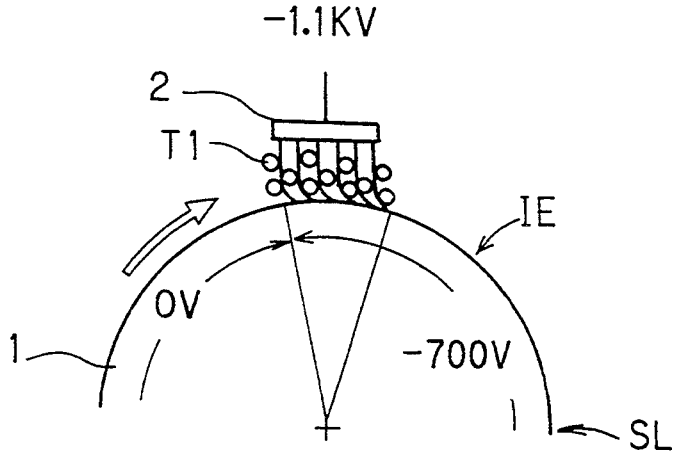
FIG. 12 is a diagram similar to FIG. 9.
Figure 13:
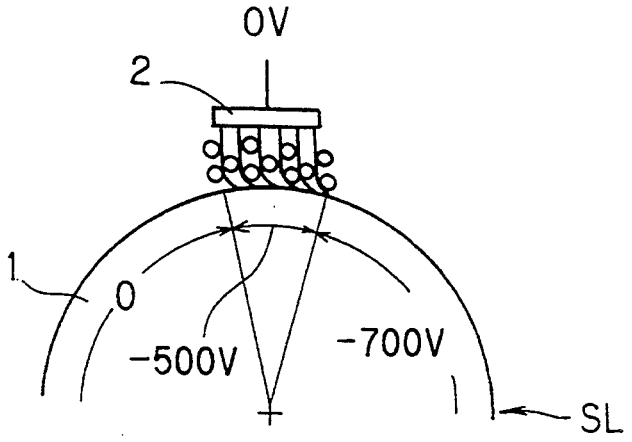
FIG. 13 is a diagram similar to FIG. 10.
Figure 14:
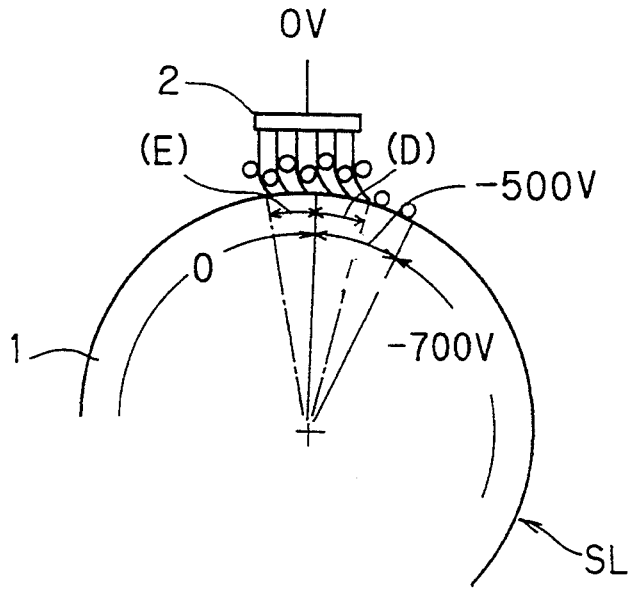
FIG. 14 shows a solid black development region.
Figure 15:
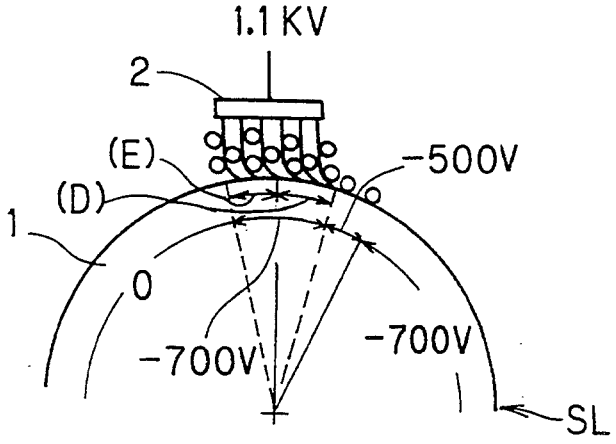
FIG. 15 shows timings for applying a regular voltage so as to prevent a solid black development.

FIGS. 12–15 show the foregoing. FIGS. 12 and 13 are similar to FIGS. 9 and 10, and thus will not be described below. Referring to FIG. 14, if a surface portion E of 0 V passed through the charging device 2, the solid black development would be carried out by the developing device 3. However, owing to the application of the voltage which satisfies the above expression (1), a portion D of a portion of which potential is reduced to −500 V shown in FIG. 14, and a portion E of 0 V are charged by the regular voltage of −700 V as shown in FIG. 15. Therefore, even if they reach the developing device 3 as they are, and the developing bias voltage is maintained at −250 V, the development with the negative toner is not carried out.

Now, specific embodiments of the invention and examples for comparison will be described below. In the following description, evaluation of the striped noises is carried out for evaluating whether the stain by the fine powder on the brush charging device 2 is removed well. If there is the fine powder stain on the brush hairs in the charging device 2, irregular charging is caused on the surface of the photosensitive drum 1 in a direction perpendicular to the advancing direction thereof. This irregular charging will remains as an irregular post-exposure potential even after the exposure of the image.

Thus, a portion, which has a potential higher than that of the other portion immediately after the charging by the charging device, will become a portion having a higher potential even after the exposure.

In a case of the reversal development, a larger amount of toner adheres to a portion having a lower potential. The irregularity in the potential in the charging by the charging device causes the irregularity in the potential even after the image exposure, and ultimately causes the irregularity in the image, particularly the striped noise. In view of the foregoing, the evaluation of the fine powder stain on the charging device 2 is conducted by evaluating the striped noise. The striped noises is evaluated in the following manner.

Figure 16:
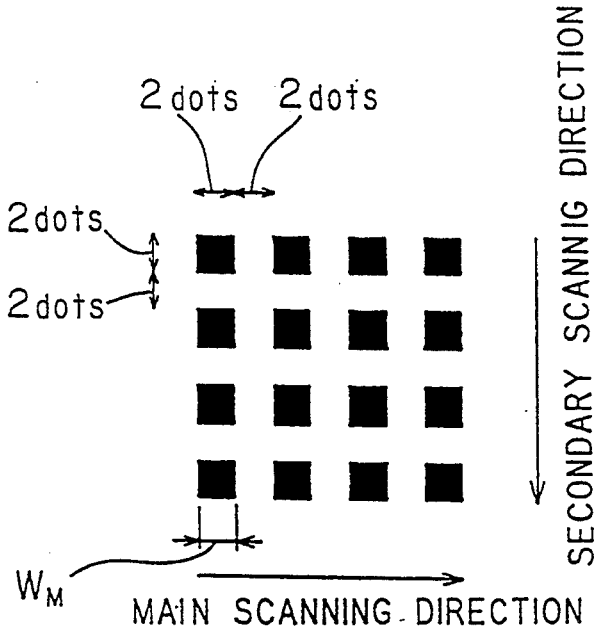
FIG. 16 shows an image pattern used for evaluation of an image noise.

The printer in FIG. 1 is used. After charging the photosensitive drum 1, a repetitive pattern of 2 dot on (turn on) and 2 dot off (turn off) is written in the main scanning direction by a laser. Similarly, the pattern of 2 dot on (turn on) and 2 dot off (turn off) is written in the secondary scanning direction by the laser, of which lighting timing is adjusted. Thereafter, a printer image shown in FIG. 16 is formed by the reversal development, transfer and fixing processes.

It is assumed that the small black solid pattern of 2 dots by 2 dots on the printed image has a maximum width of $W_M$ in the main scanning direction.

The width $W_M$ of the 30 small black solid patterns which are continuous in the main scanning direction has a standard deviation of $\sigma$. Depending on the standard deviation $\sigma$, the image noises are ranked as follows.

| Standard Deviation $\sigma$ | Evaluation Mark |
|---|---|
| $0\ \mu m \leqq \sigma < 25\ \mu m$ | ○ |
| $25\ \mu m \leqq \sigma < 40\ \mu m$ | Δ |
| $40\ \mu m \leqq \sigma$ | X |

In the above evaluation, the circular mark indicates a condition in which the noise is not recognized or can be negligible. The triangular mark indicates a condition in which the image noise is recognized but is practically allowable, and the mark "X" indicates a condition in which the image noise is not practically allowed. Large values of the standard deviation $\sigma$ indicate the fact that the width of the small black solid pattern in the main scanning direction deviates to a large extent in the main scanning direction.

In the printed dot patterns described before, the deviation $\sigma$ of 40 μm or more has been experientially recognized as an unpreferably strong noise. Therefore, the preferred value of $\sigma$ is lower than 40 μm. The value of $\sigma$ lower than 10 μm is further preferable, in which case the striped noise cannot be recognized.

EMBODIMENT 1

Figure 4:
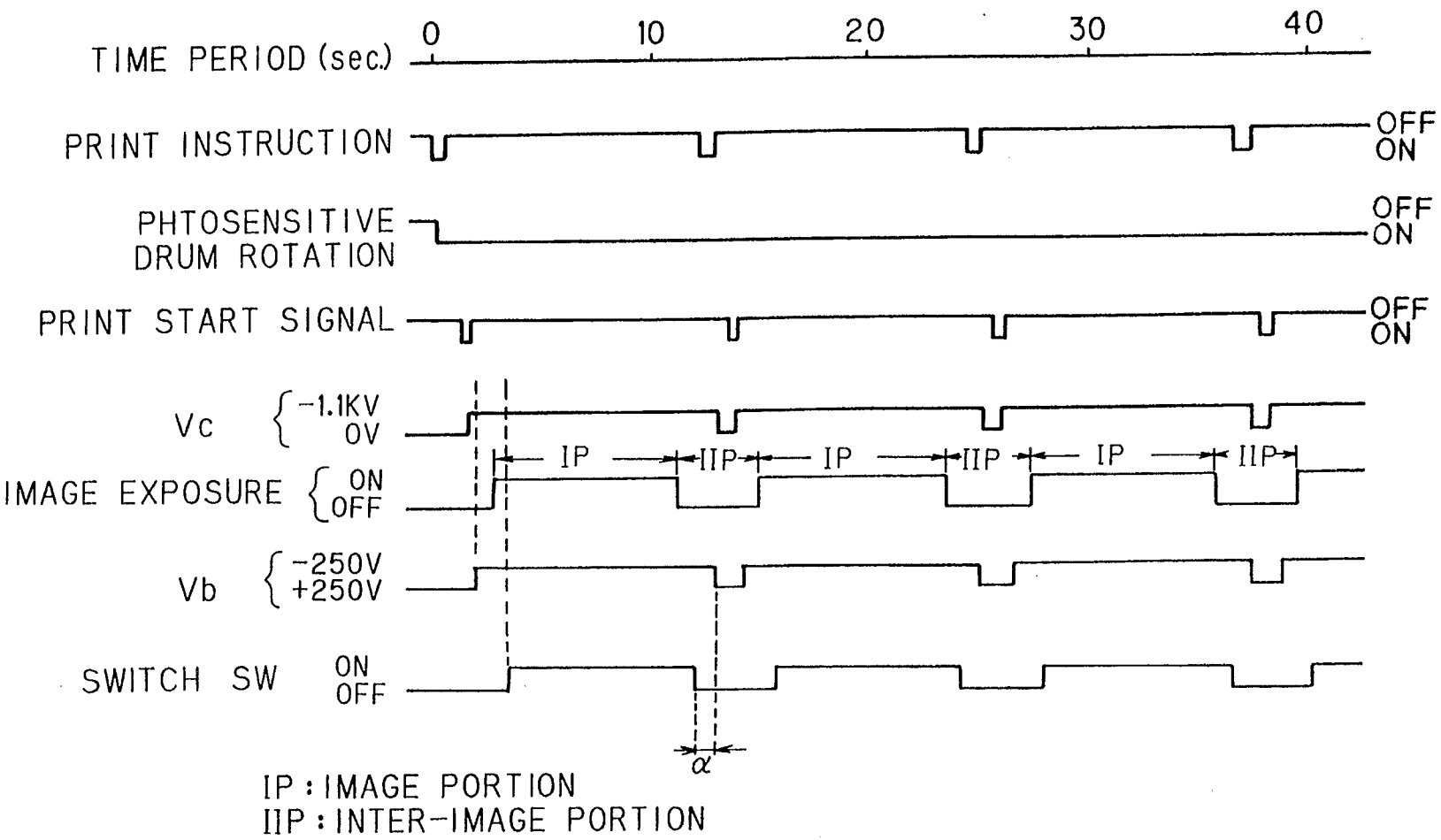
FIG. 4 is a timing chart showing timings of a print instruction, rotation of a photosensitive drum, print start signal, change of a voltage Vc applied to a charging device, image exposure, change of a bias voltage Vb applied to a developing device, and passage of a transfer sheet, e.g., in an embodiment 1.

In accordance with the timing shown in FIG. 4, the non-image period (inter-image period) of about 3.6 seconds contains a time period for which the voltage Vc applied to the brush charging device 2 is the ground potential. The time period for applying the voltage of 0 V is 0.7 seconds. In this embodiment, 0.29 seconds are required for the nip portion, at which the contact charging device 2 contact the photosensitive drum 1, to pass through the charging device 2, because the nip portion is 10 mm in width and the moving speed of the photosensitive drum is 35 mm/sec. The regular charging voltage applied to the charging device 2 in the printing operation is −1.1 KV (Vc=−1.1 KV). The surface of the photosensitive drum is uniformly charged at −700 V. The developing bias voltage Vb is −250 V (but +250 V in the inter-image period). Under the above conditions, 7000 sheets were continuously printed, and the striped noise was evaluated. The obtained result was good (circular mark).

In FIG. 4, $\alpha$ indicates a timing for changing Vc and Vb, regarding a predetermined time period after the rear edge of the transfer sheet passed the switch SW as the inter-image period (i.e., time lag between the passages of one and next transfer sheets).

EMBODIMENT 2

The timing shown in FIG. 4 is employed. The power supply 29 in FIG. 2(A) is used for the inter-image period. The voltage applied to the charging device 2 by the power supply 29 is not 0 V but is −350 V (Vc=−350) for the inter-image period. Other conditions are the same as those for the embodiment 1. After the continuous printing of 7000 sheets, the striped noises were evaluated, and the result was good (circular mark).

EMBODIMENT 3

The voltage is applied to the charging device 2 by the unillustrated power supply for the inter-image period. The voltage is determined to be −900 V, which is larger than the regular surface potential of the photosensitive drum applied by the charging device 2 but has the absolute value lower than that of the regular charging voltage of −1.1 KV. The bias voltage Vb is −250 V, but is 0 V for the inter-image period. Other conditions are the same as those for the embodiment 1. After the continuous printing of 7000 sheets, the striped noises were evaluated, and the result was allowable (triangular mark).

EMBODIMENT 4

Figure 5:
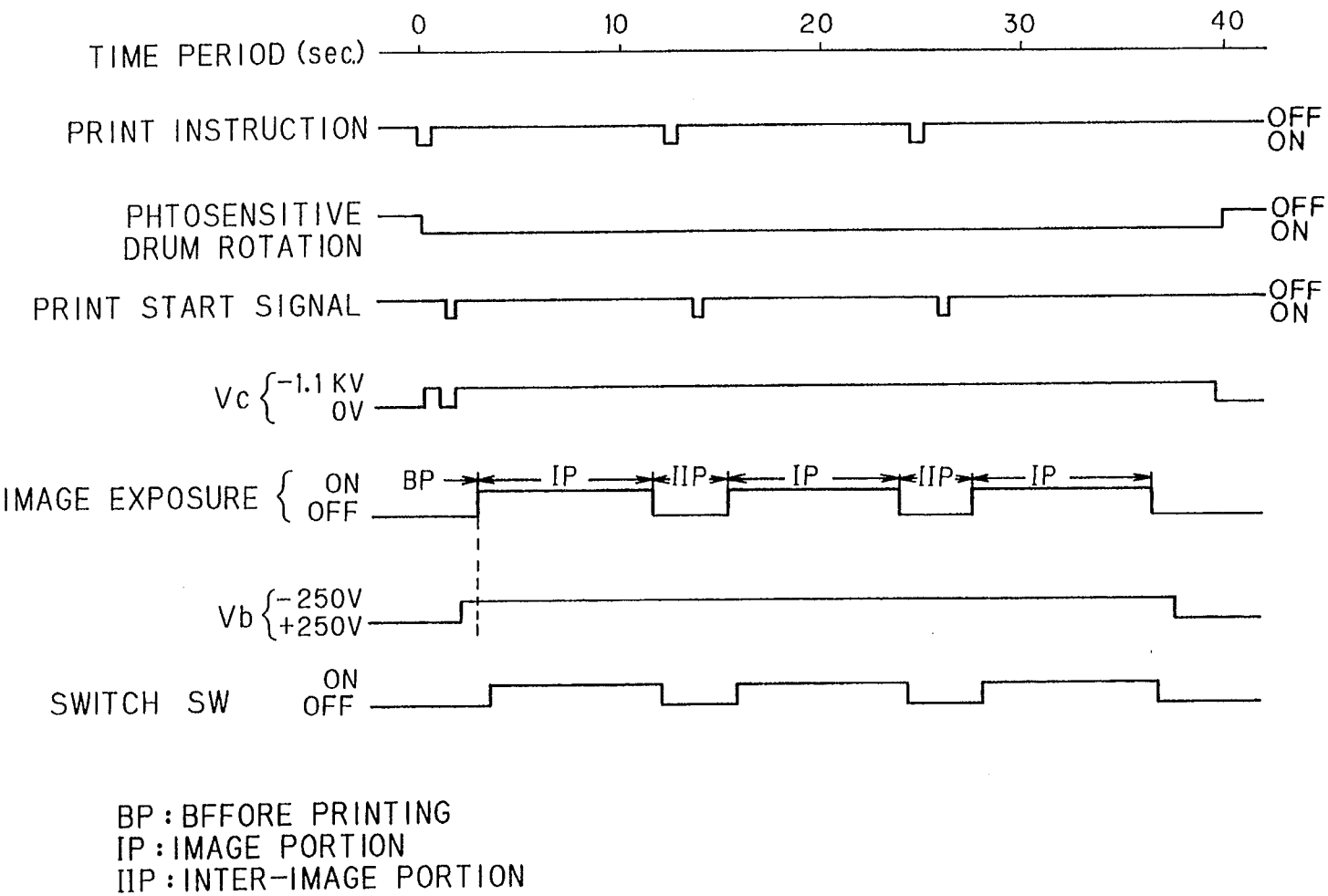
FIG. 5 is a timing chart for an embodiment 4 corresponding to FIG. 4.

In accordance with the timing in FIG. 5, there is provided a time period, for which the voltage Vc applied to the brush charging device 2 is the ground potential, prior to the start of the continuous printing, i.e., after the supply of the print instruction and before the turn-on of the switch SW. The time period for applying the voltage of 0 V is 0.7 seconds. The regular charging voltage Vc applied to the charging device 2 in the printing operation is −1.1 KV. The surface of the drum 1 is uniformly charged at −700 V. The developing bias voltage Vb is −250 V (+250 V before formation of the electrostatic latent image). Under these conditions, 7000 sheets were printed by intermittently repeating the printing of three sheets. The striped noises were evaluated, and the result was good (circular mark).

EMBODIMENT 5

Figure 6:
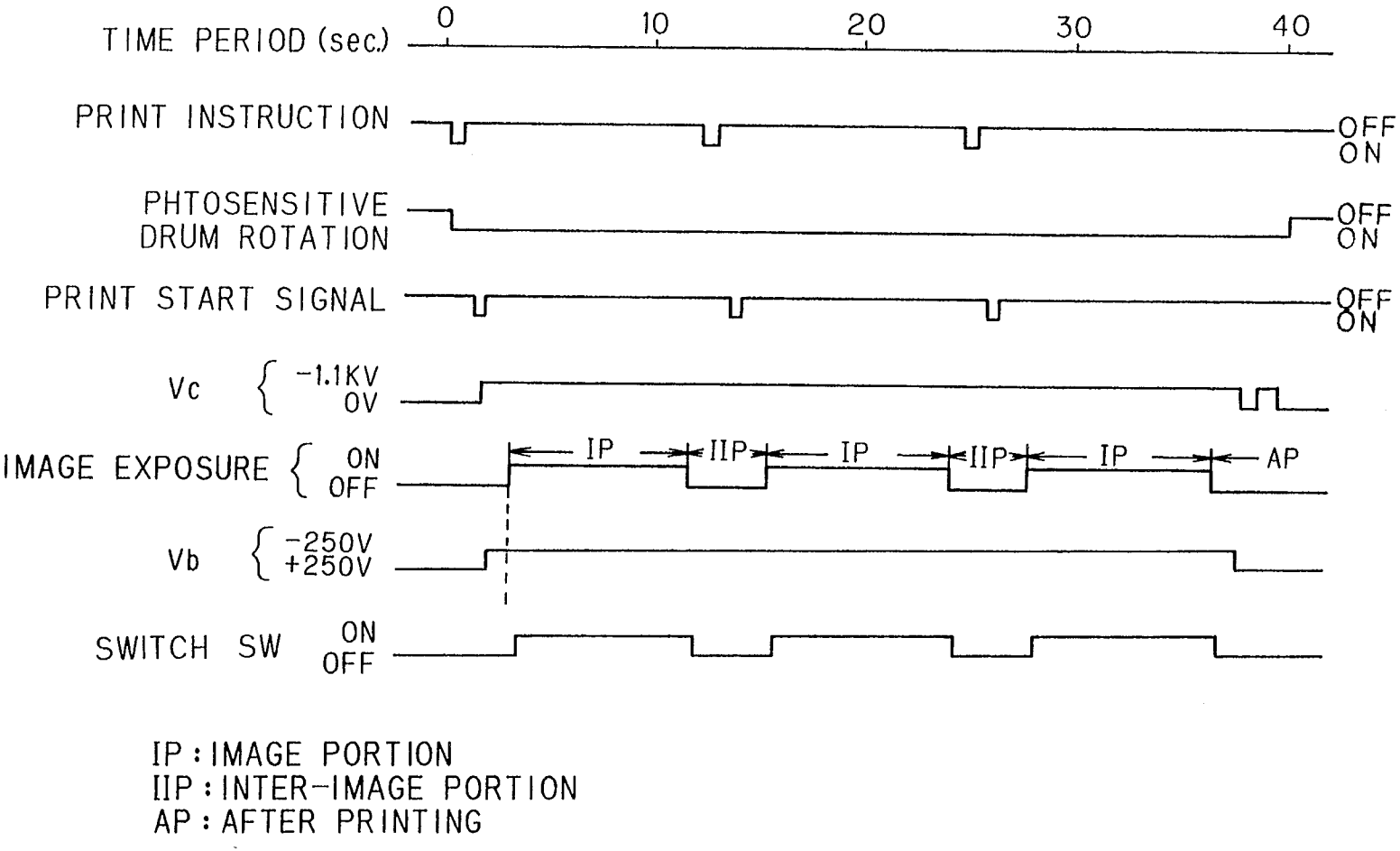
FIG. 6 is a timing chart for an embodiment 5 corresponding to FIG. 4.

In accordance with the timing in FIG. 6, there is provided a time period, for which the voltage Vc applied to the brush charging device 2 is the ground potential, after the continuous printing, i.e., after the turn-off of the switch SW and before the stop of the rotation of the photosensitive drum. The time period for applying the voltage of 0 V is 0.7 seconds. The regular charging voltage Vc applied to the charging device 2 in the printing operation is −1.1 KV. The drum is uniformly charged at −700 V. The developing bias voltage Vb is −250 V (+250 V after the continuous printing). Under these conditions, 7000 sheets were printed by intermittently repeating the printing of three sheets. The striped noises were evaluated, and the result was good (circular mark).

EMBODIMENT 6

Figure 7:
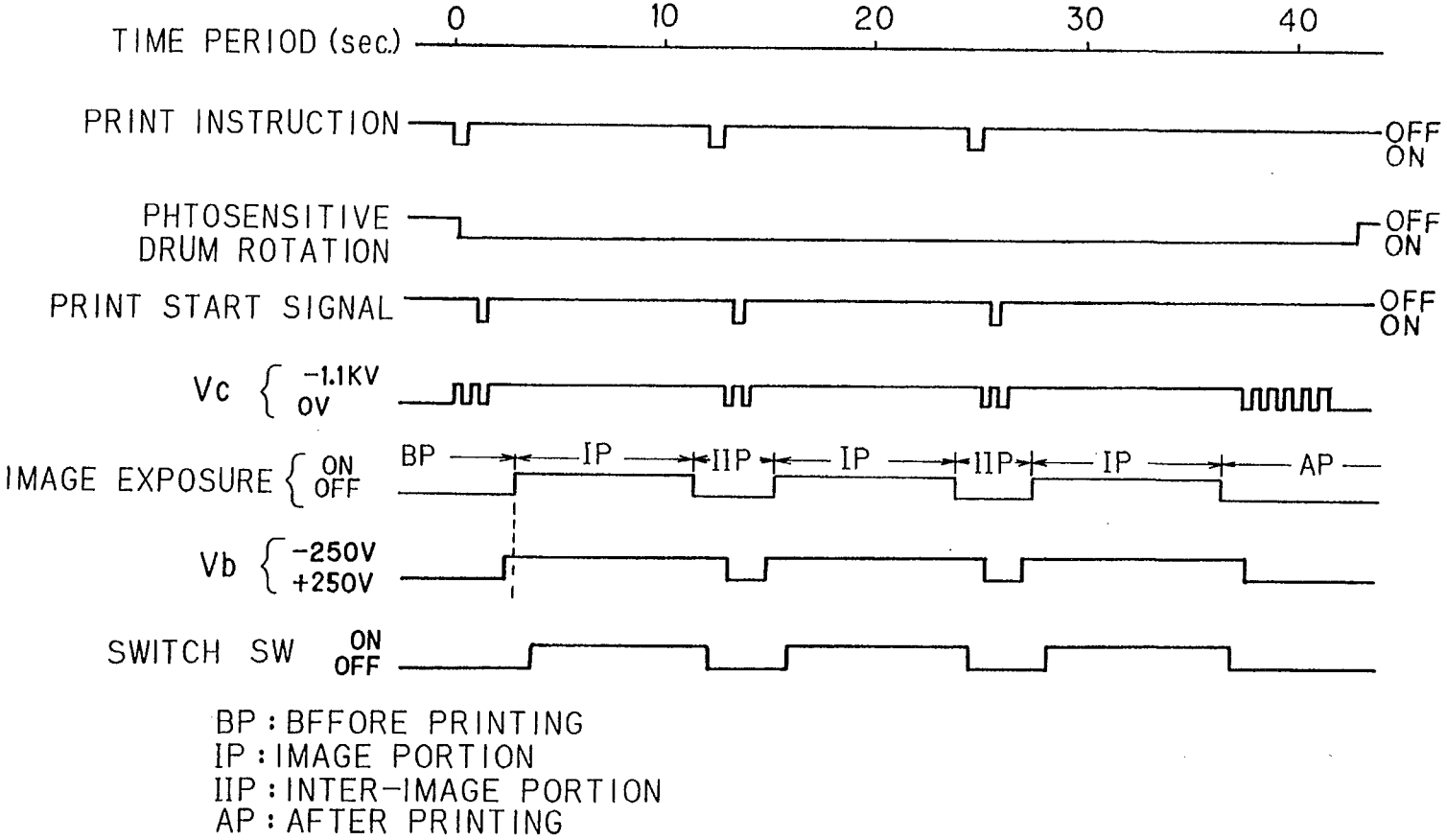
FIG. 7 is a timing chart for an embodiment 6 corresponding to FIG. 4.

In accordance with the timing in FIG. 7, there are provided two time periods before the start of the continuous printing, two time periods in each inter-image period and five time periods after the completion of the printing. During these time periods, the voltage Vc applied to the brush charging device 2 is the ground potential. The time period for applying the voltage of 0 V is 0.4 seconds per one application. The regular charging voltage Vc applied to the charging device 2 in the printing operation is −1.1 KV. The time period for applying this regular voltage of −1.1 KV is 0.4 seconds per one application. The surface of the drum 1 is uniformly charged at −700 V. The bias voltage Vb is −250 V, (but +250 V before and after the continuous printing and during the inter-image period). Under these conditions, 7000 sheets were printed by intermittently repeating the printing of three sheets. The striped noises were evaluated, and the result was good (circular mark).

EMBODIMENT 7

Figure 8:
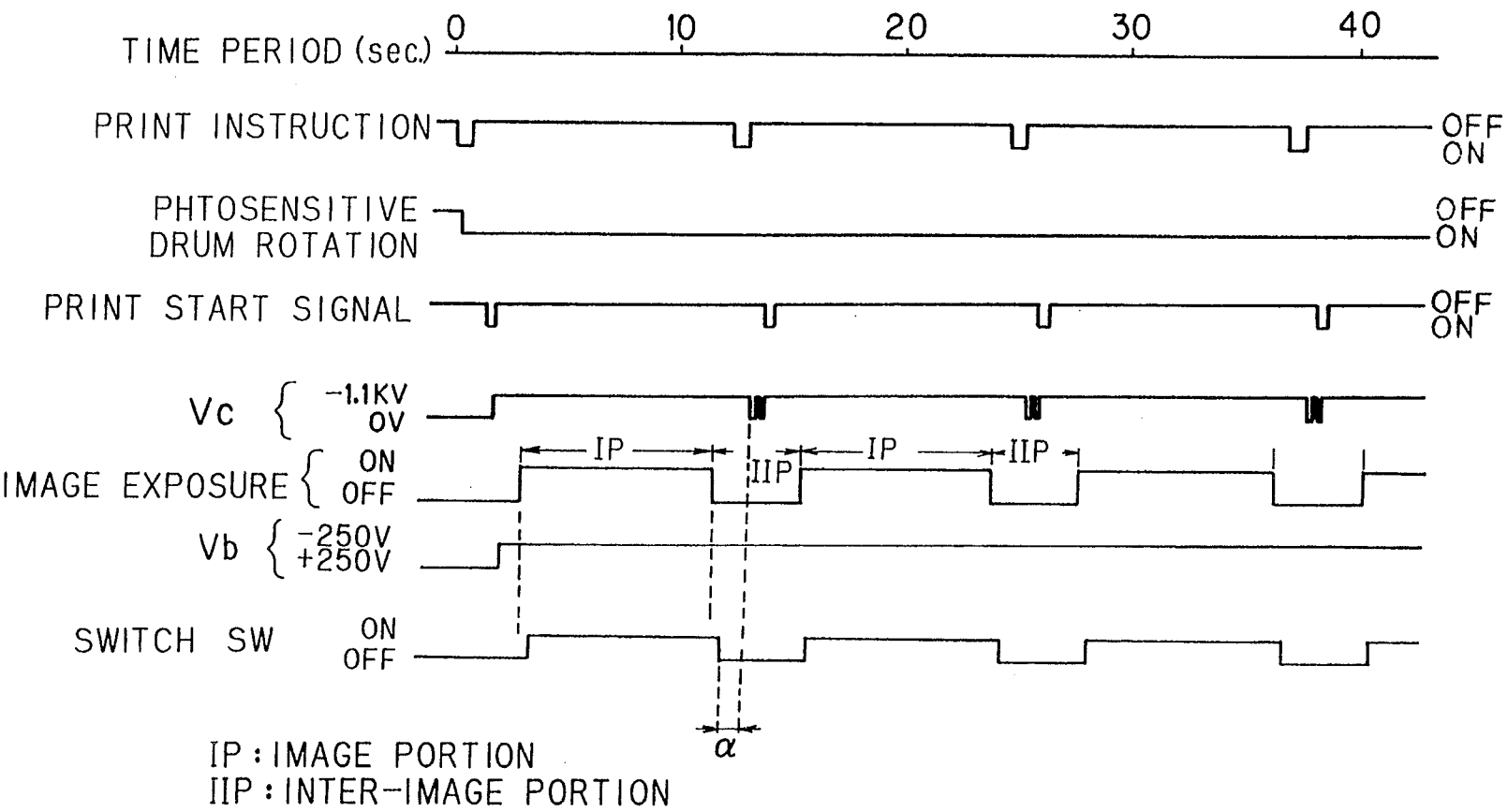
FIG. 8 is a timing chart for an embodiment 7 corresponding to FIG. 4.

In accordance with the timing in FIG. 8, there is provided two time periods, for which the voltage Vc applied to the brush charging device 2 is the ground potential, in each inter-image period. The time period for one application of the voltage of 0 V is 0.15 seconds, which is shorter than the nip passing time period of 0.29 seconds (in the case that the nip width of the contact charging device is 10 mm and the moving speed of the surface of the photosensitive drum is 35 mm/sec.). The regular charging voltage Vc applied to the charging device 2 in the printing operation is − 1.1 KV. The drum is uniformly charged at −700 V. The developing bias voltage Vb is −250 V (+250 V during the inter-image period). Under these conditions, 7000 sheets were printed by intermittently repeating the printing of three sheets. The striped noises were evaluated, and the result was good (circular mark).

Example 1 for Comparison

This example employs conditions similar to those of the embodiment 1, except for that there is not provided a time period, for which the voltage applied to the charging device 2 is the ground potential, in the inter-image period. Under these conditions, 7000 sheets were continuously printed. The striped noises were evaluated, and the result was unacceptable ("x" mark).

Example 2 for Comparison

In accordance with the timing in FIG. 4, there is provided a time period, for which the voltage applied by an unillustrated power supply to the charging device 2 is the voltage of +600 V having the polarity opposite to the charge polarity of the drum 1, in the inter-image period. The time period for applying the voltage of +600 V is 0.7 seconds. The other conditions are similar to those for the embodiment 1. Under these conditions, 7000 sheets were continuously printed. The striped noises were evaluated, and the result was good (circular mark). However, defective charging in a striped form was caused in the second rotation of the drum 1. Such insufficient charging was not caused in the embodiments 1, 2 and 3 and the example 1 for comparison. Specifically, when a portion of the photosensitive drum 1 corresponding to the portion, to which +600 V was applied, was charged with the regular voltage of −1.1 KV at the second rotation, the intended surface potential of −700 V could not be obtained but the lower potential of −620 V was obtained. As a result, thin lines in an original was remarkably thickened in the obtained image.

According to the printer of the embodiment, as described hereinabove, the voltage, which has the same polarity as the charge polarity of the photosensitive drum 1 and has the absolute value lower than that of the regular charging voltage supplied by the power supply 25, is applied to the charging device 2 during the non-image period in the continuous printing operation. Thereby, the fine powder stain in the charging device 2 can be facilely removed without generating disadvantageous charge memory on the surface of the photosensitive drum 1.

As described before, the present invention can provide the image forming apparatus using the contact charging device, in which the stain by the fine powder adhered to the charging device can be facilely removed, without disadvantages such as reduction of the charged amount of the surface of the electrostatic latent image carrier and generation of the irregular charging.

In a preferred form of the present invention, the voltage, which has the same polarity as the regular charge polarity of the surface of the electrostatic latent image carrier and has the absolute value lower than that of the regular voltage applied to the contact charging device, is applied to the charging device for a period of {(charging width of contact charging device)/(speed of electrostatic latent image carrier)} or less before and/or after the image formation, and/or during the inter-image period, as described with reference to the embodiment 7. Thereby, this form is based on the discovery that, owing to the application of the voltage described above, the fine powder, which has adhered to the charging device and has the polarity opposite to the regular charge polarity of the toner, can be effectively moved toward the electrostatic latent image carrier in a short cleaning time.

Thus, in this preferred form of the invention, the voltage, which has the same polarity as the regular charge polarity of the surface of the electrostatic latent image carrier and has the absolute value lower than that of the regular voltage applied to the contact charging device, is applied to the charging device in a pulse form at least before or after the image formation, and/or during the inter-image period. A time period from one pulse to a next pulse (one cycle period) is not more than {(charging width of contact charging device)/(speed of electrostatic latent image carrier)}.

Figure 21:
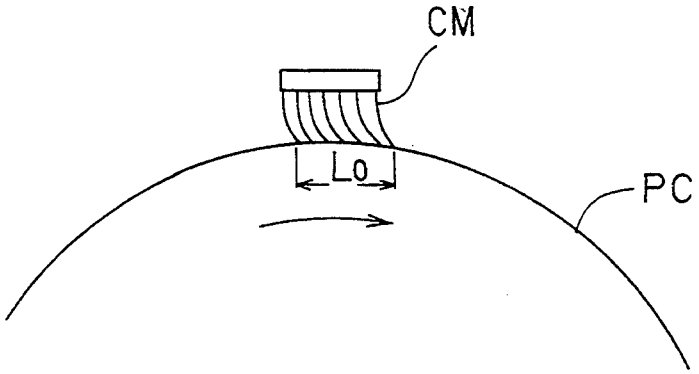
FIG. 21 is a diagram for explaining a charging width of a charging device.

The above "charging width" is a width Lo of a portion, shown in FIG. 21, through which a charging member CM of the charging device contacts an electrostatic latent image carrier PC. The "speed of electrostatic latent image carrier" is a moving speed of the surface of the carrier contacting the charging member, and thus is a peripheral speed if the carrier is of a drum type.

The above words "before the image formation" means the time before the image is formed, and also means the time before a portion of the image carrier corresponding to the front edge of the next transfer sheet reaches the charging device. The above words "after the image formation" means the time after the image is formed, and also means the time after a portion of the drum corresponding to the rear edge of the transfer sheet passes the charging device in the continuous printing (copying) operation. The above words "inter-image period" means the time period during which the portion of the drum corresponding to the portion between two transfer sheets is passing the charging device in the continuous printing (copying) operation.

The time at which the image forming apparatus is powered on is contained in "before the image formation". Further, there may be another time or time period, e.g., a time period for restoration from the jamming, a time period for which a pulse voltage is applied based on information from means provided for monitoring quality of the image, and a time period for which a cleaning operation is carried out in accordance with an instruction supplied by means of a manual switch operated by an operator. These time periods are included in the above described "before or after the image formation" or "inter-image period".

Further, the above described "one cycle period" is a time period from the start of application of one pulse voltage to the start of application of the next pulse voltage.

The time period for which the pulse voltages are applied, i.e., {(application period)×(times of application of pulse voltage)} is preferably in a range from 0.01 second to 20 seconds per one printing (or copying). This is preferable in view of reduction of the time period for cleaning the charging device and increase of the effect for removing the stain.

The above described "one cycle period" not more than {(charging width)/(speed of electrostatic latent image carrier)} and "times of application of pulse voltage" can be changed for each pulse application, and thus the wordings "one cycle period" and "times of application" also contain the average "one cycle period" and average "application times". The applied pulse may have a square wave form as well as other wave form such as a sinusoidal wave form and a triangular wave form.

The pulse form of the applied voltage enables more effective movement of the defectively charged toner fragments and others onto the photosensitive drum 1. The reason of this can be considered as the increase of the times of vibration of the adhered toner fragments and others, which is caused by the change of the electrostatic attractive force between the charging device and the surface of the electrostatic latent image carrier in accordance with change of the voltage applied to the charging device. As already described in the former embodiment, when the erases 6 reduces the potential of the rear half portion C of the inter-image portion A to 0 V, the positively charged toner fragments and others does not move onto this portion C, but an electric field, which moves the positively charged toner fragments and others onto the portion including the rear half portion C, is formed between the photosensitive drum 1 and the contact charging device 2. This increases the cleaning effect.

Figure 17:
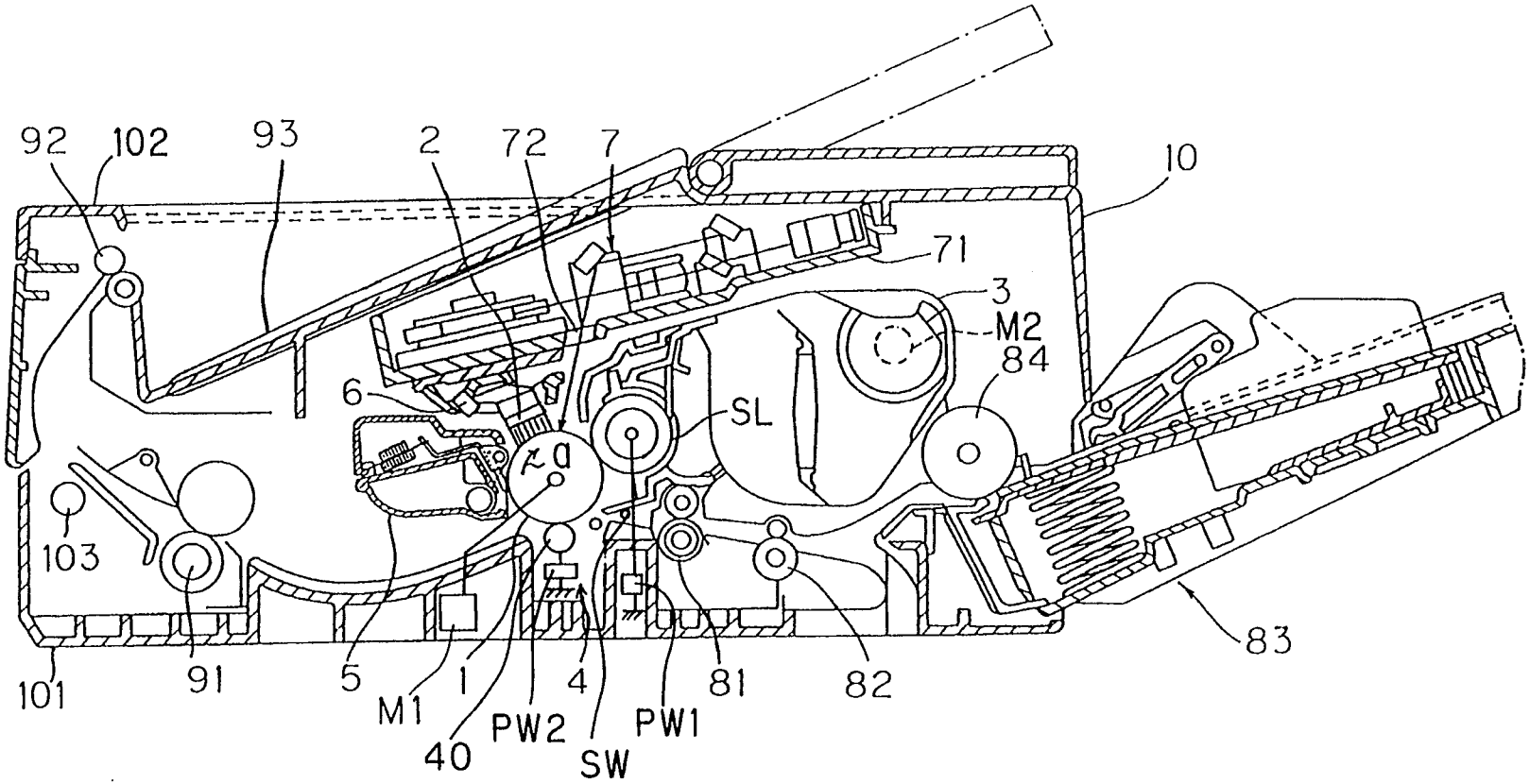
FIG. 17 is a cross section showing a schematic construction of a printer of another embodiment of the invention.

The embodiments will be described further in detail with reference to the drawings. An apparatus shown in FIG. 17 is similar to that shown in FIG. 1 except for that the transfer device 4 is not formed of the transfer charger (corona charging), but is formed of a transfer roller 40, i.e., electrically conductive rubber roller, and thus will not be described in detail hereinafter, and the width W of the brush 20 of the charging device 2 is 7 mm.

The system speed of the printer, i.e., the peripheral speed of the photosensitive drum 1 is 3.5 cm/sec. The diameter of the photosensitive drum 1 is 30 mm. Therefore, one rotation of the drum 1 requires 2.7 seconds.

Figure 18A:
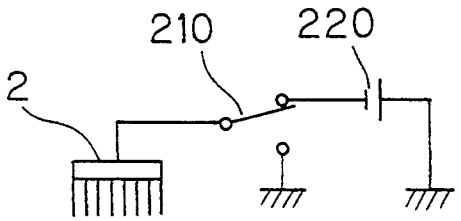
FIG. 18(A) shows means for applying a voltage to a charging device in a printer in FIG. 17.

The charging device 2 is connected to a power supply 220 through a switch 210, as shown in FIG. 18(A), or is grounded. The voltage Vc applied to the charging device 2 is −1.1 KV, if connected to the power supply 220, or is 0 V if grounded. In this embodiment, the voltage Vc is maintained at −1.1 KV during the ordinary charging. During the inter-image period between the actual image forming operations, the voltage Vc of 0 V in the pulse form is continuously applied five times at the cycle period of 200 msec (at a frequency of 5 Hz), as shown at an enlarged portion #A in FIG. 21. The ground potential for applying the pulse voltage may be replaced with a power supply which applies a voltage having the absolute value lower than that of the power supply 220 and the same polarity as the charge polarity of the drum 1.

Figure 18B:
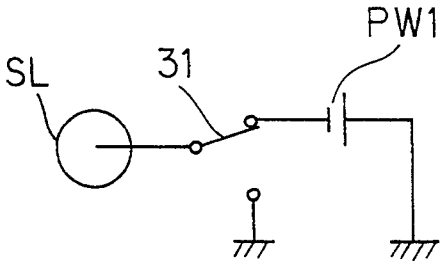
FIG. 18(B) shows means for applying a voltage to a developing device in a printer in FIG. 17.

The developing device 3 is a contact developing device using one-component developer. A developing sleeve SL is connected, as shown in FIG. 18(B), to a power supply PW1 through a switch 31, or is grounded. The bias voltage Vb applied to the developing device is −250 V, if it is applied by the power supply PW1, and is 0 V, if grounded. For the ordinary image formation by the developing device 3, the reversal development is carried out with the toner of the same charge polarity as the charge polarity of the drum 1 under the developing bias voltage Vb of −250 V.

Figure 18C:
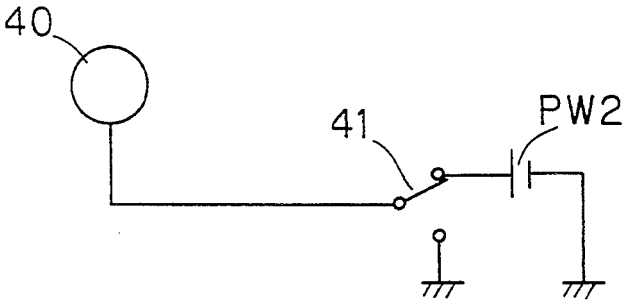
FIG. 18(c) shows means for applying a voltage to a transfer device in a printer in FIG. 17.

The transfer device 4 is of a roller type. The transfer roller 40 is connected, as shown in FIG. 18(C), to a power supply PW2 through a switch 41, or is grounded. A voltage $V_T$ applied to the transfer roller 40 is +1.1 KV if the toner image on the photosensitive member is to be transferred onto the transfer sheet, and is 0 V, if grounded.

Figure 19:
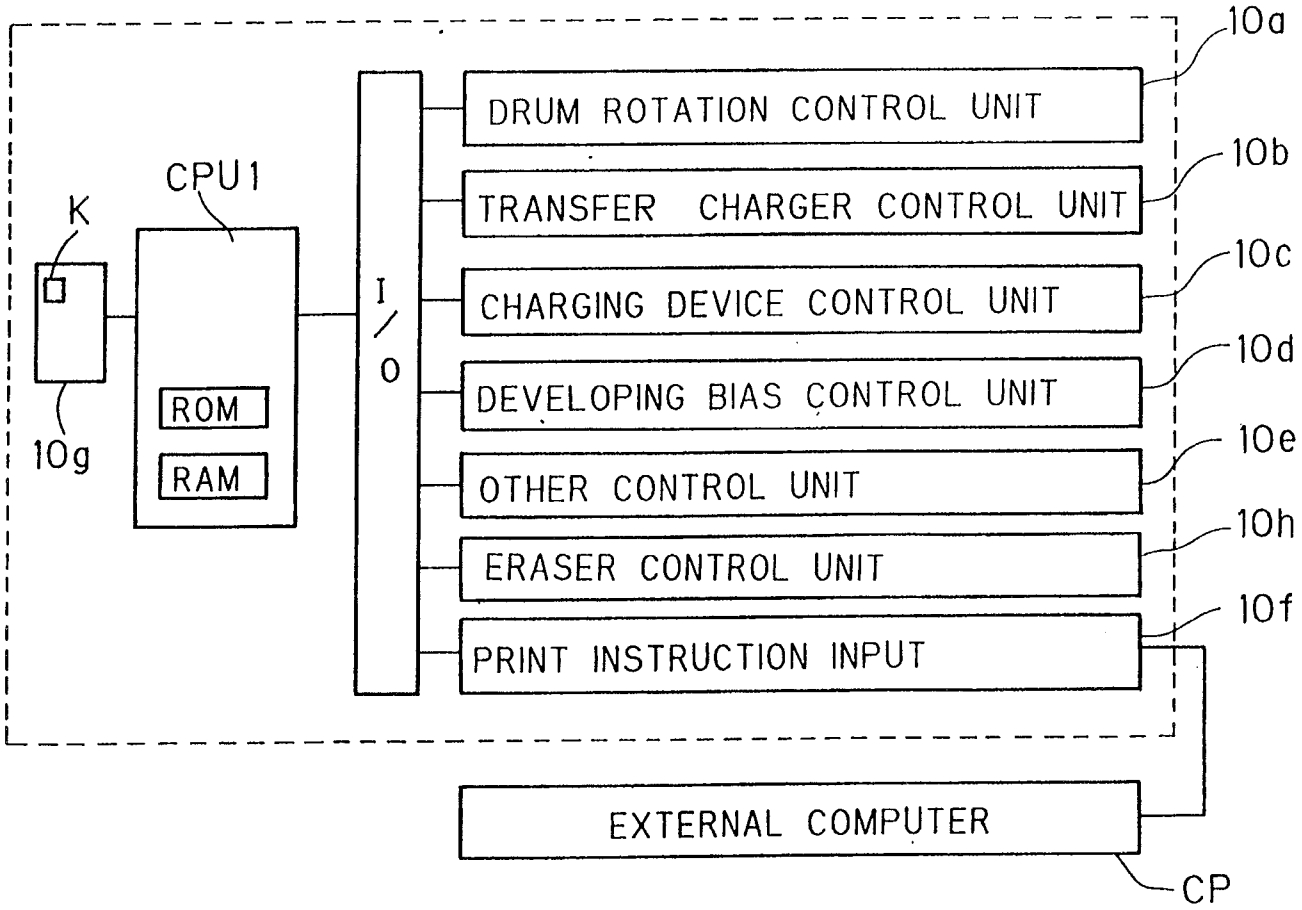
FIG. 19 is a block diagram showing a control circuit of a printer in FIG. 17.

FIG. 19 is a block diagram showing a major part of a control circuit of the printer. The construction of this circuit is similar to that of the control circuit shown in FIG. 2(B). However, the operation control of each elements by the microprocessor CPU1 is different. This control circuit includes, as a major component, a microprocessor CPU1 including a read only memory and a random access memory. The whole operation of the printer is controlled by this microprocessor CPU1.

The microprocessor CPU1 is connected through an interface circuit I/O to a rotation control unit **10*a* for the photosensitive drum 1, a control unit 10*b* for the transfer device 4, a control unit 10*c* for the charging device 2, a developing bias control unit 10*d*, an eraser control unit 10*h* and other control unit 10*e*, and is also connected to a print instruction input 10*f***.

A processing program of the microprocessor CPU1 is stored in the ROM. The print instruction input **10*f*** receives a printer control signal from an external computer such as a personal computer and sends the same to the microprocessor CPU1.

In this case, the ROM has also stored time periods from the receipt of the print instruction to various actions such as start and stop of the rotation of the photosensitive drum 1, application and interruption of the voltage $V_T$ to the transfer roller 40, application of the voltage Vc to the charging device 2, setting of the voltage Vc at the ground potential, application and interruption of the developing bias voltage Vb, turn-on and turn-off of the eraser 6. Based on these stored contents, ON/OFF and switch selection signals are supplied through the interface I/O to the photosensitive member rotation control unit 10*a*, transfer device control unit 10*b* , charging device control unit 10*c*, developing bias control unit 10*d* and eraser control unit 10*h*. The change of the voltage Vc applied to the charging device 2 is instructed by the control unit 10*c*. The change of the developing bias voltage Vb applied to the developing device 3 is instructed by the control unit 10*d*. The change of the voltage $V_T$ applied to the transfer roller 40 is instructed by the control unit 10*b*. Turn-on and turn-off of the eraser 6 is instructed by the control unit 10*h*.

The microprocessor CPU1 is also connected to the operator panel 10*g*, which is provided with the print key K for allowing the start of print.

The transfer roller 40 of the transfer device 4 is a roller made from electrically conductive urethane rubber and having an electrical resistance of $10^5$ Ω, and is pressed against the photosensitive drum 1 at a linear pressure of 30 g/cm.

In the ordinary image forming operation by this printer, the surface of the photosensitive drum 1 is uniformly charged at the predetermined potential by the charging device 2 connected to the power supply 220, and the charged region is subjected to the image exposure by the optical system 7 to form the electrostatic latent image. The electrostatic latent image thus formed is developed by the developing device 3 into the toner image, which is moved to the transfer region confronting the transfer roller 40.

EMBODIMENT 8

Figure 20:
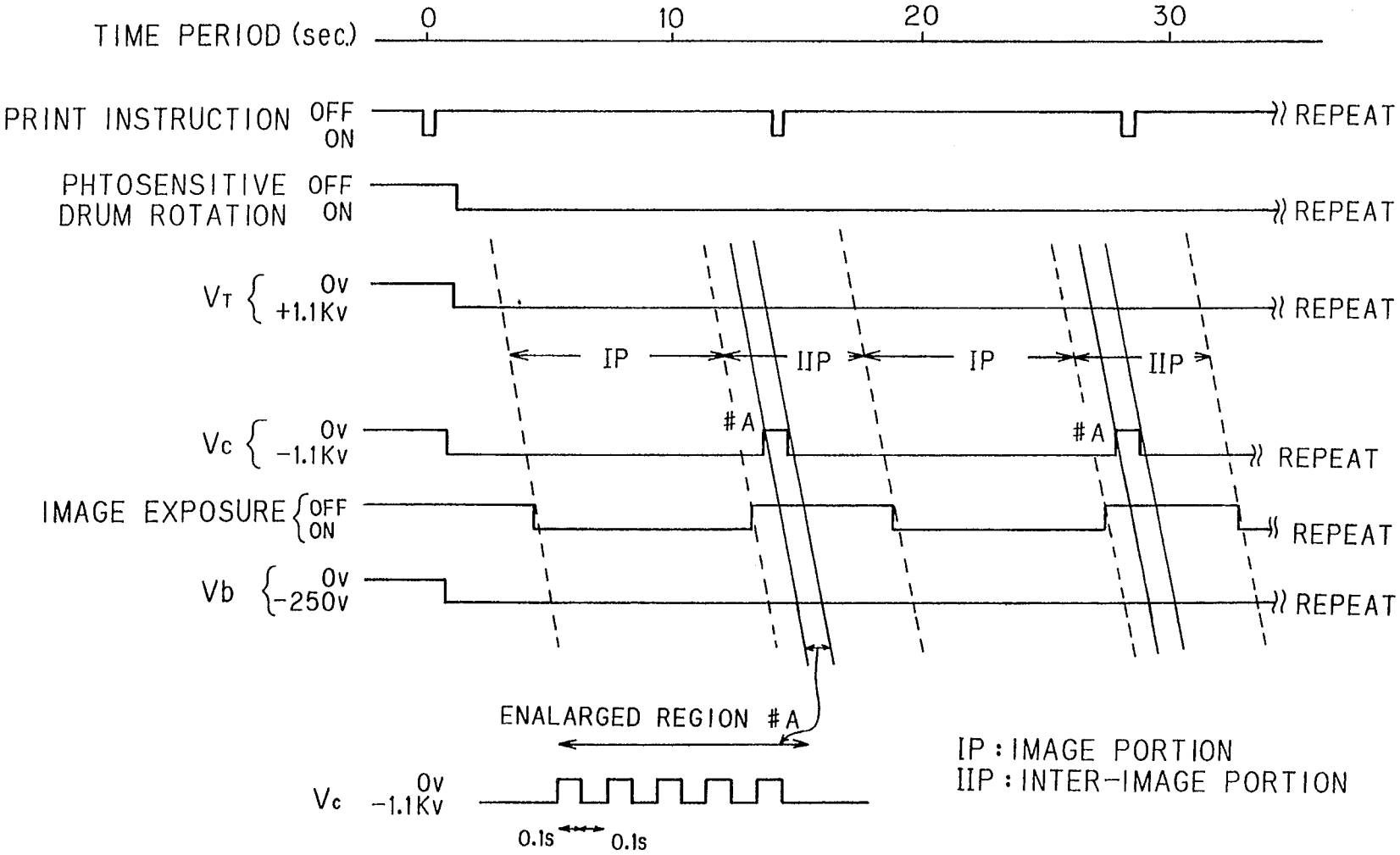
FIG. 20 is a timing chart showing timings of a print instruction, rotation of a photosensitive drum, change of a voltage Vc applied to a charging device, change of a bias voltage Vb applied to a developing device, change of a voltage $V_T$ applied to a transfer device, and image exposure in a printer in FIG. 17.

This printer carries out the printing in a manner described below in accordance with the timing shown in the timing chart of FIG. 20.

First, the print key K is in the on-state and the printer receives the print instruction from the external computer CP, whereby the photosensitive drum 1 starts to rotate. Then, the voltage Vc of −1.1 KV is applied to the charging device 2 to charge the drum 1. Simultaneously with the start of the application of the voltage Vc of −1.1 KV, the developing bias voltage Vb of −250 V, starts to be applied to the developing device 3, and the transfer voltage $V_T$ of +1.1 KV starts to be applied to the transfer roller 40. Also the eraser is turned on.

Oblique lines, e.g., indicated in region (#A) in the timing chart are linear lines each connecting time points at which one certain point on the drum 1 passes over the respective elements, i.e., charging device, developing device and transfer device.

The region (#A) is in the inter-image period, in which the voltage Vc applied to the charging device 2 is continuously changed five times to the ground potential (Vc=0 V,) at the cycle period of 200 msec, as shown in the enlarged portion (#A) in the figure. Owing to the application of the pulse voltage, there is generated an electric field by which the positively charged stain adhered to the brush of the charging device 2 is moved toward the negatively charged portion of the drum 1. The brush is cleaned in this manner.

In the operation for cleaning off the fine powder, the charging device 2 does not receive the positive voltage which is opposite to the charge polarity (negative polarity) of the photosensitive drum 1, so that disadvantageous positive memory is not generated on the photosensitive drum. Therefore, when the regular charging voltage is applied to the photosensitive drum for the printing operation, the surface of the photosensitive drum is uniformly charged to have the predetermined charged amount.

The stain adhered to the charging device 2 is removed in this manner. This prevents the possible defective charging in the striped form due to the stain inherent to the contact charging device, and thus prevents the generation of the striped image noise.

The print out (A4 size, longitudinal direction) at a B/W ratio of 2.5% was carried out in the printing manner described above, and following evaluation 1–4 was carried out.

Evaluation 1 (for toner consumption)

The weight of the consumed toner is measured after the printing of 5000 sheets. The consumption evaluation is ranked as follows.

| Toner Consumption | Evaluation |
|---|---|
| less than 90 g | ○ |
| 90 g or more | X |

Evaluation 2 (for stain on the brush of the charging device)

The weight of the stain, i.e., fine powder adhered the charging brush is measured after the printing of 5000 sheets, and the weight is ranked as follows. The following weight is the weight of the fine powder adhered to one charging brush fiber.

| Amount of Stain | Evaluation |
|---|---|
| less than 30 mg | ○ |
| 30 mg or more and less than 60 mg | Δ |
| 60 mg or more | X |

Evaluation 3 (for the charged amount of the stain on the brush)

The charged amount of the stain, i.e., the fine powder adhered to the charging brush is measured after the printing of 5000 sheets, and the amount is ranked as follows. The following charged amount is the value per a unit weight.

| Charged Amount | Evaluation |
|---|---|
| less than +1.5 μC/g | ⊙ |
| +1.5 μC/g or more and less than +3.0 μC/g | ○ |
| +3.0 μC/g or more and less than +4.5 μC/g | Δ |
| 4.5 μC/g or more | X |

Evaluation 4 (for generation of the striped image noises)

The image noises are evaluated in the same manner as that already described with reference to FIG. 16. However, the image noises are ranked as follows on the basis of the value of σ.

| Standard Deviation σ | Evaluation Mark |
|---|---|
| $\sigma < 30$ μm | ○ |
| 30 μm ≦ σ | X |

In the above evaluation, the circular mark indicates a condition in which the noise is not recognized or can be negligible. The mark "X" indicates a condition in which the image noise is not practically allowed. Large values of the standard deviation $\sigma$ indicate the fact that the width of the small black solid pattern in the main scanning direction deviates to a large extent in the main scanning direction.

Evaluation 5 (Total Evaluation)

The total evaluation is conducted on the basis of the results of the evaluation 1 (toner consumption) and the evaluation 4 (striped noise).

X: unacceptable

Δ: acceptable

: good

The evaluation 2 and 3 are conducted as the evaluation in the intermediate stage for the purpose of searching the cause of generation of the striped noises, and is not directly utilized for the total evaluation.

According to the printing manner in the embodiment 8 described before, all the items were ranked as good (circular mark), as shown in Table 1.

The evaluation 1–4 was conducted with respect to the printing which was carried out in the manners described as following embodiments 9–48 with the above described printer. In these embodiments, various factors were changed. Specifically, the printing was conducted, variously changing the charging brush width W of the charging device 2, peripheral speed of the photosensitive drum 1, pulse application timing (between images, or before or behind the image) at which the pulse voltage (Vc=0) was applied for removing the stain on the charging brush, pulse cycle period for applying the pulse voltage, pulse frequency (1/pulse cycle period), times of application of the pulses per one sheet, and total time period (times×cycle period) required for applying the pulses per one sheet.

The results of the embodiments 9–48 as well as the result of the above described embodiment 8 are shown in Tables 1–4. The times of pulses relating to the embodiments 47 and 48 in Table 4 are times per multiple sheets.

WITH RESPECT TO EMBODIMENT 9–18

The pulse cycle periods (frequencies) and times of application of the pulses are variously changed, but the pulse application time period {(pulse application times)×(pulse cycle period)} is constant. Under these conditions, the printing is carried out for the evaluation.

Other conditions are the same as those of the embodiment 8.

If the pulse cycle period is less than 0.1 msec, the charging brush is stained to a large extent, resulting in disadvantageous striped noise.

If the pulse cycle period is 5 msec or more, the effect for removing the stain on the charging brush is large, so that the striped noise is scarcely generated and thus the advantageous result can be obtained.

The reason for this can be considered as that, if the pulse cycle period is short, the fine powder adhered to the charging brush cannot respond to the opposite electric field generated by the application of the pulses, and thus cannot move toward the photosensitive drum.

If the pulse cycle period exceeds a value of 200 msec equal to {(brush width)/(speed)}, the toner consumption tends to rapidly increase.

The reason for this can be considered as that, if the pulse cycle period exceeds the value of {(brush width)/(speed)}, a portion having a remarkably low potential is formed in the surface of the photosensitive drum during the inter-image period, resulting in the toner development.

WITH RESPECT TO EMBODIMENT 19 and 20

The conditions are similar to those of the embodiment 8, except for that the application of the pulse is carried out not during the inter-image period, but before or after the image formation. Under these conditions, the printing is carried out for evaluation.

The obtained results are the same as that of the embodiment 8.

WITH RESPECT TO EMBODIMENTS 21–29

The printing and evaluation are carried out under the same conditions as those of the embodiments 8–18 except for that the peripheral speed of the photosensitive drum is increased to 140 mm/sec.

The very good result is obtained with the pulse cycle period of 5 msec or more. If the pulse cycle period is larger than 50 msec, i.e., the value of {(brush width)/(speed)}, the toner consumption tends to increase.

WITH RESPECT TO EMBODIMENTS 30–41

The printing and evaluation are carried out under the same conditions as those of the embodiments 8–18 except for that the charging brush width is increased to 21 mm.

The unpreferable result is obtained if the pulse cycle period is lower than 0.1 msec. The very good result is obtained if the pulse cycle period is 5 msec or more. If the pulse cycle period is larger than 600 msec, i.e., the value of {(brush width)/(speed)}, the toner consumption tends to increase.

WITH RESPECT TO EMBODIMENTS 42–48

The printing and evaluation are carried out under the same conditions as those of the embodiment 8 except for that the pulse application times, i.e., times of application of the pulses are variously changed.

If the pulse application time per one print is less than 0.1 (one time per ten prints), the remarkable striped noise is generated, and thus the result is not preferable.

If the pulse application time per one print is one or more, the particularly preferable result is obtained. The reason for this can be considered that, as the times of cleaning reduces, the fine powder adhered to the charging brush cannot be sufficiently removed, and thus the striped noise is generated.

In the following tables, "Location" indicates pulse application location or timing, "Period" indicates pulse cycle period, "Frequency" indicates pulse frequency, "W/S" indicates {(brush width)(mm)/(speed)(mm/sec))=passage time period (msec), "P. Times" indicates "pulse application times" (times/sheet), and "Tm.×Prd." indicates {(times)×(pulse cycle period)}(sec).

TABLE 1

| Embodiment 18 | |
|---|---|
| Location: Inter-image | Period: 0.1 msec |
| Frequency: 10000 Hz | W/S: 7/35 = 200 msec |
| P. Times: 10000 times/sheet | Tm. × Prd.: 1 sec |
| Toner consumption: ○ | Amount of Stain: Δ |
| Charged Amount of Stain: ◎ | Striped Noise: Δ |
| Total Evaluation: Δ | |

TABLE 1-continued

Embodiment 9

| | |
|---|---|
| Location: Inter-image | Period: 0.2 msec |
| Frequency: 5000 Hz | W/S: 7/35 = 200 msec |
| P. Times: 5000 times/sheet | Tm. × Prd.: 1 sec |
| Toner consumption: ○ | Amount of Stain: Δ |
| Charged Amount of Stain: ◎ | Striped Noise: Δ |
| Total Evaluation: Δ | |

Embodiment 10

| | |
|---|---|
| Location: Inter-image | Period: 0.5 msec |
| Frequency: 2000 Hz | W/S: 7/35 = 200 msec |
| P. Times: 2000 times/sheet | Tm. × Prd.: 1 sec |
| Toner consumption: ○ | Amount of Stain: Δ |
| Charged Amount of Stain: ◎ | Striped Noise: Δ |
| Total Evaluation: Δ | |

Embodiment 11

| | |
|---|---|
| Location: Inter-image | Period: 1 msec |
| Frequency: 1000 Hz | W/S: 7/35 = 200 msec |
| P. Times: 1000 times/sheet | Tm. × Prd.: 1 sec |
| Toner consumption: ○ | Amount of Stain: Δ |
| Charged Amount of Stain: ◎ | Striped Noise: Δ |
| Total Evaluation: Δ | |

Embodiment 12

| | |
|---|---|
| Location: Inter-image | Period: 2 msec |
| Frequency: 500 Hz | W/S: 7/35 = 200 msec |
| P. Times: 500 times/sheet | Tm. × Prd.: 1 sec |
| Toner consumption: ○ | Amount of Stain: Δ |
| Charged Amount of Stain: ◎ | Striped Noise: Δ |
| Total Evaluation: Δ | |

Embodiment 13

| | |
|---|---|
| Location: Inter-image | Period: 5 msec |
| Frequency: 200 Hz | W/S: 7/35 = 200 msec |
| P. Times: 200 times/sheet | Tm. × Prd.: 1 sec |
| Toner consumption: ○ | Amount of Stain: ○ |
| Charged Amount of Stain: ○ | Striped Noise: ○ |
| Total Evaluation: ○ | |

Embodiment 14

| | |
|---|---|
| Location: Inter-image | Period: 10 msec |
| Frequency: 100 Hz | W/S: 7/35 = 200 msec |
| P. Times: 100 times/sheet | Tm. × Prd.: 1 sec |
| Toner consumption: ○ | Amount of Stain: ○ |
| Charged Amount of Stain: ○ | Striped Noise: ○ |
| Total Evaluation: ○ | |

Embodiment 15

| | |
|---|---|
| Location: Inter-image | Period: 20 msec |
| Frequency: 50 Hz | W/S: 7/35 = 200 msec |
| P. Times: 50 times/sheet | Tm. × Prd.: 1 sec |
| Toner consumption: ○ | Amount of Stain: ○ |
| Charged Amount of Stain: ○ | Striped Noise: ○ |
| Total Evaluation: ○ | |

Embodiment 16

| | |
|---|---|
| Location: Inter-image | Period: 50 msec |
| Frequency: 20 Hz | W/S: 7/35 = 200 msec |
| P. Times: 20 times/sheet | Tm. × Prd.: 1 sec |
| Toner consumption: ○ | Amount of Stain: ○ |
| Charged Amount of Stain: ○ | Striped Noise: ○ |
| Total Evaluation: ○ | |

Embodiment 17

| | |
|---|---|
| Location: Inter-image | Period: 100 msec |
| Frequency: 10 Hz | W/S: 7/35 = 200 msec |
| P. Times: 10 times/sheet | Tm. × Prd.: 1 sec |
| Toner consumption: ○ | Amount of Stain: ○ |
| Charged Amount of Stain: ○ | Striped Noise: ○ |
| Total Evaluation: ○ | |

Embodiment 8

| | |
|---|---|
| Location: Inter-image | Period: 200 msec |
| Frequency: 5 Hz | W/S: 7/35 = 200 msec |
| P. Times: 5 times/sheet | Tm. × Prd.: 1 sec |
| Toner consumption: ○ | Amount of Stain: ○ |
| Charged Amount of Stain: ○ | Striped Noise: ○ |
| Total Evaluation: ○ | |

TABLE 2

Embodiment 19

| | |
|---|---|
| Location: Before image | Period: 200 msec |
| Frequency: 5 Hz | W/S: 7/35 = 200 msec |
| P. Times: 5 times/sheet | Tm. × Prd.: 1 sec |
| Toner consumption: ○ | Amount of Stain: ○ |

TABLE 2-continued

| | |
|---|---|
| Charged Amount of Stain: ○ | Striped Noise: ○ |
| Total Evaluation: ○ | |

Embodiment 20

| | |
|---|---|
| Location: After image | Period: 200 msec |
| Frequency: 5 Hz | W/S: 7/35 = 200 msec |
| P. Times: 5 times/sheet | Tm. × Prd.: 1 sec |
| Toner consumption: ○ | Amount of Stain: ○ |
| Charged Amount of Stain: ○ | Striped Noise: ○ |
| Total Evaluation: ○ | |

Embodiment 21

| | |
|---|---|
| Location: Inter-image | Period: 0.1 msec |
| Frequency: 10000 Hz | W/S: 7/140 = 50 msec |
| P. Times: 10000 times/sheet | Tm. × Prd.: 1 sec |
| Toner consumption: ○ | Amount of Stain: Δ |
| Charged Amount of Stain: ◎ | Striped Noise: Δ |
| Total Evaluation: Δ | |

Embodiment 22

| | |
|---|---|
| Location: Inter-image | Period: 0.2 msec |
| Frequency: 5000 Hz | W/S: 7/140 = 50 msec |
| P. Times: 500 times/sheet | Tm. × Prd.: 1 sec |
| Toner consumption: ○ | Amount of Stain: Δ |
| Charged Amount of Stain: ◎ | Striped Noise: Δ |
| Total Evaluation: Δ | |

Embodiment 23

| | |
|---|---|
| Location: Inter-image | Period: 0.5 msec |
| Frequency: 2000 Hz | W/S: 7/140 = 50 msec |
| P. Times: 2000 times/sheet | Tm. × Prd.: 1 sec |
| Toner consumption: ○ | Amount of Stain: Δ |
| Charged Amount of Stain: ◎ | Striped Noise: Δ |
| Total Evaluation: Δ | |

Embodiment 24

| | |
|---|---|
| Location: Inter-image | Period: 1 msec |
| Frequency: 1000 Hz | W/S: 7/140 = 50 msec |
| P. Times: 1000 times/sheet | Tm. × Prd.: 1 sec |
| Toner consumption: ○ | Amount of Stain: Δ |
| Charged Amount of Stain: ◎ | Striped Noise: Δ |
| Total Evaluation: Δ | |

Embodiment 25

| | |
|---|---|
| Location: Inter-image | Period: 2 msec |
| Frequency: 500 Hz | W/S: 7/140 = 50 msec |
| P. Times: 500 times/sheet | Tm. × Prd.: 1 sec |
| Toner consumption: ○ | Amount of Stain: Δ |
| Charged Amount of Stain: ◎ | Striped Noise: Δ |
| Total Evaluation: Δ | |

Embodiment 26

| | |
|---|---|
| Location: Inter-image | Period: 5 msec |
| Frequency: 200 Hz | W/S: 7/140 = 50 msec |
| P. Times: 200 times/sheet | Tm. × Prd.: 1 sec |
| Toner consumption: ○ | Amount of Stain: ○ |
| Charged Amount of Stain: ○ | Striped Noise: ○ |
| Total Evaluation: ○ | |

Embodiment 27

| | |
|---|---|
| Location: Inter-image | Period: 10 msec |
| Frequency: 100 Hz | W/S: 7/140 = 50 msec |
| P. Times: 100 times/sheet | Tm. × Prd.: 1 sec |
| Toner consumption: ○ | Amount of Stain: ○ |
| Charged Amount of Stain: ○ | Striped Noise: ○ |
| Total Evaluation: ○ | |

Embodiment 28

| | |
|---|---|
| Location: Inter-image | Period: 20 msec |
| Frequency: 50 Hz | W/S: 7/140 = 50 msec |
| P. Times: 50 times/sheet | Tm. × Prd.: 1 sec |
| Toner consumption: ○ | Amount of Stain: ○ |
| Charged Amount of Stain: ○ | Striped Noise: ○ |
| Total Evaluation: ○ | |

Embodiment 29

| | |
|---|---|
| Location: Inter-image | Period: 50 msec |
| Frequency: 20 Hz | W/S: 7/140 = 50 msec |
| P. Times: 20 times/sheet | Tm. × Prd.: 1 sec |
| Toner consumption: ○ | Amount of Stain: ○ |
| Charged Amount of Stain: ○ | Striped Noise: ○ |
| Total Evaluation: ○ | |

TABLE 3

Embodiment 30

| | |
|---|---|
| Location: Inter-image | Period: 0.1 msec |
| Frequency: 10000 Hz | W/S: 7/35 = 600 msec |

TABLE 3-continued

| | |
|---|---|
| P. Times: 30000 times/sheet | Tm. × Prd.: 3 sec |
| Toner consumption: ○ | Amount of Stain: Δ |
| Charged Amount of Stain: ◎ | Striped Noise: Δ |
| Total Evaluation: Δ | |
| Embodiment 31 | |
| Location: Inter-image | Period: 0.2 msec |
| Frequency: 5000 Hz | W/S: 7/35 = 600 msec |
| P. Times: 15000 times/sheet | Tm. × Prd.: 3 sec |
| Toner consumption: ○ | Amount of Stain: Δ |
| Charged Amount of Stain: ◎ | Striped Noise: Δ |
| Total Evaluation: Δ | |
| Embodiment 32 | |
| Location: Inter-image | Period: 0.5 msec |
| Frequency: 2000 Hz | W/S: 7/35 = 600 msec |
| P. Times: 6000 times/sheet | Tm. × Prd.: 3 sec |
| Toner consumption: ○ | Amount of Stain: Δ |
| Charged Amount of Stain: ◎ | Striped Noise: Δ |
| Total Evaluation: Δ | |
| Embodiment 33 | |
| Location: Inter-image | Period: 1 msec |
| Frequency: 1000 Hz | W/S: 7/35 = 600 msec |
| P. Times: 3000 times/sheet | Tm. × Prd.: 3 sec |
| Toner consumption: ○ | Amount of Stain: Δ |
| Charged Amount of Stain: ◎ | Striped Noise: Δ |
| Total Evaluation: Δ | |
| Embodiment 34 | |
| Location: Inter-image | Period: 2 msec |
| Frequency: 500 Hz | W/S: 7/35 = 600 msec |
| P. Times: 1500 times/sheet | Tm. × Prd.: 3 sec |
| Toner consumption: ○ | Amount of Stain: Δ |
| Charged Amount of Stain: ◎ | Striped Noise: Δ |
| Total Evaluation: Δ | |
| Embodiment 35 | |
| Location: Inter-image | Period: 5 msec |
| Frequency: 200 Hz | W/S: 7/35 = 600 msec |
| P. Times: 600 times/sheet | Tm. × Prd.: 3 sec |
| Toner consumption: ○ | Amount of Stain: ○ |
| Charged Amount of Stain: ○ | Striped Noise: ○ |
| Total Evaluation: ○ | |
| Embodiment 36 | |
| Location: Inter-image | Period: 10 msec |
| Frequency: 100 Hz | W/S: 7/35 = 600 msec |
| P. Times: 300 times/sheet | Tm. × Prd.: 3 sec |
| Toner consumption: ○ | Amount of Stain: ○ |
| Charged Amount of Stain: ○ | Striped Noise: ○ |
| Total Evaluation: ○ | |
| Embodiment 37 | |
| Location: Inter-image | Period: 20 msec |
| Frequency: 50 Hz | W/S: 7/35 = 600 msec |
| P. Times: 150 times/sheet | Tm. × Prd.: 3 sec |
| Toner consumption: ○ | Amount of Stain: ○ |
| Charged Amount of Stain: ○ | Striped Noise: ○ |
| Total Evaluation: ○ | |
| Embodiment 38 | |
| Location: Inter-image | Period: 50 msec |
| Frequency: 20 Hz | W/S: 7/35 = 600 msec |
| P. Times: 60 times/sheet | Tm. × Prd.: 3 sec |
| Toner consumption: ○ | Amount of Stain: ○ |
| Charged Amount of Stain: ○ | Striped Noise: ○ |
| Total Evaluation: ○ | |
| Embodiment 39 | |
| Location: Inter-image | Period: 100 msec |
| Frequency: 10 Hz | W/S: 7/35 = 600 msec |
| P. Times: 30 times/sheet | Tm. × Prd.: 3 sec |
| Toner consumption: ○ | Amount of Stain: ○ |
| Charged Amount of Stain: ○ | Striped Noise: ○ |
| Total Evaluation: ○ | |
| Embodiment 40 | |
| Location: Inter-image | Period: 200 msec |
| Frequency: 5 Hz | W/S: 7/35 = 600 msec |
| P. Times: 15 times/sheet | Tm. × Prd.: 3 sec |
| Toner consumption: ○ | Amount of Stain: ○ |
| Charged Amount of Stain: ○ | Striped Noise: ○ |
| Total Evaluation: ○ | |
| Embodiment 41 | |
| Location: Inter-image | Period: 500 msec |
| Frequency: 2 Hz | W/S: 7/35 = 600 msec |
| P. Times: 6 times/sheet | Tm. × Prd.: 3 sec |
| Toner consumption: ○ | Amount of Stain: ○ |

TABLE 3-continued

| | |
|---|---|
| Charged Amount of Stain: ○ | Striped Noise: ○ |
| Total Evaluation: ○ | |

TABLE 4

| | |
|---|---|
| Embodiment 42 | |
| Location: Inter-image | Period: 200 msec |
| Frequency: 5 Hz | W/S: 7/35 = 200 msec |
| P. Times: 100 times/sheet | Tm. × Prd.: 20 sec |
| Toner consumption: ○ | Amount of Stain: ○ |
| Charged Amount of Stain: ○ | Striped Noise: ○ |
| Total Evaluation: ○ | |
| Embodiment 43 | |
| Location: Inter-image | Period: 200 msec |
| Frequency: 5 Hz | W/S: 7/35 = 200 msec |
| P. Times: 30 times/sheet | Tm. × Prd.: 6 sec |
| Toner consumption: ○ | Amount of Stain: ○ |
| Charged Amount of Stain: ○ | Striped Noise: ○ |
| Total Evaluation: ○ | |
| Embodiment 44 | |
| Location: Inter-image | Period: 200 msec |
| Frequency: 5 Hz | W/S: 7/35 = 200 msec |
| P. Times: 10 times/sheet | Tm. × Prd.: 2 sec |
| Toner consumption: ○ | Amount of Stain: ○ |
| Charged Amount of Stain: ○ | Striped Noise: ○ |
| Total Evaluation: ○ | |
| Embodiment 45 | |
| Location: Inter-image | Period: 200 msec |
| Frequency: 5 Hz | W/S: 7/35 = 200 msec |
| P. Times: 3 times/sheet | Tm. × Prd.: 600 msec |
| Toner consumption: ○ | Amount of Stain: ○ |
| Charged Amount of Stain: ○ | Striped Noise: ○ |
| Total Evaluation: ○ | |
| Embodiment 46 | |
| Location: Inter-image | Period: 200 msec |
| Frequency: 5 Hz | W/S: 7/35 = 200 msec |
| P. Times: 1 time/sheet | Tm. × Prd.: 200 msec |
| Toner consumption: ○ | Amount of Stain: ○ |
| Charged Amount of Stain: ○ | Striped Noise: ○ |
| Total Evaluation: ○ | |
| Embodiment 47 | |
| Location: Inter-image | Period: 200 msec |
| Frequency: 5 Hz | W/S: 7/35 = 200 msec |
| P. Times: ½ time/sheet | Tm. × Prd.: 67 msec |
| Toner consumption: ○ | Amount of Stain: Δ |
| Charged Amount of Stain: Δ | Striped Noise: Δ |
| Total Evaluation: Δ | |
| Embodiment 48 | |
| Location: Inter-image | Period: 200 msec |
| Frequency: 5 Hz | W/S: 7/35 = 20 msec |
| P. Times: 0.1 time/sheet | Tm. × Prd.: 20 msec |
| Toner consumption: ○ | Amount of Stain: Δ |
| Charged Amount of Stain: Δ | Striped Noise: Δ |
| Total Evaluation: Δ | |

In each embodiment described before, the pulse voltage Vc for removing stain on the charging brush is 0 V. However, it may be arbitrarily determined to be in a range between the voltage (−1.1 KV in the above examples) for the charging and 0 V. In short, it is required to form the opposite electric field between the electrostatic latent image carrier and the contact charging device.

In the embodiments described before, the fixed brush charging device is used as the contact charging device. However, the present invention can be applied to cases in which the contact charging device is a rotary brush charging device, roller charging device, blade charging device, electromagnetic brush charging device and others.

In the embodiments described before, the negatively chargeable photosensitive member is used as the electrostatic latent image carrier. Of course, the invention may be applied to a positively chargeable photosensitive member.

Further, in the embodiments described before, the reversal development, i.e., so-called negative-positive development is used. However, the present invention may be applied to a case of positive-positive development. That is; the charging device may be cleaned by an electric field opposite to that generated in the ordinary charging operation. In the regular development, i.e., in a case that the charging voltage polarity for the electrostatic latent image carrier is the same as that of the voltage applied to the transfer device and the toner has the opposite polarity, the fine toner powder having the same polarity as the toner as well as the shaved fine powder of the electrostatic latent image carrier adhere to the contact charging device. In this case, the cleaning can be carried out by applying the small or zero voltage to a contact charging device for cleaning after charging the electrostatic latent image carrier at the regular polarity by the contact charging device, in a manner similar to the reversal development.

In an electrophotographic image forming apparatus using a contact charging device according to a further preferred form of the invention, the contact charging device itself charges the electrostatic latent image carrier to form a charged region, and then the contact charging device contacts the charged region again, during which a voltage having the same polarity as a surface potential of the charged region and having an absolute value lower than that of a surface potential of the charged region is applied to the charging device.

In this case, the charging of the electrostatic latent image carrier by the contact charging device is carried out by changing the voltage to be applied to the contact charging device to the voltage having the absolute value (including 0 V) lower than that of the charged potential which has been already applied to the electrostatic latent image carrier, for example, after one rotation of the electrostatic latent image carrier of a rotary type, or after one reciprocation of the electrostatic latent image carrier of a reciprocative type.

The contact charging device may be a rotary brush charging device, fixed brush charging device, roller charging device, blade charging device, electromagnetic brush charging device, charging device using a film member, or others. However, the present invention is particularly effective to the brush charging device having contacting members in a fiber form, to which stain is liable to fix.

EMBODIMENT 49

The printer used in this embodiment is similar to that already described with reference to FIG. 1, and thus will not be described below. However, the operation control of each element by the microprocessor CPU1 in the control circuit is different.

The printer carries out the printing in a manner described below in accordance with the timing shown in a timing chart of FIG. 22.

First, the print key K is in the on-state and the printer receives the print instruction from the external computer CP (1), whereby the photosensitive drum 1 starts to rotate (2). Then, the voltage Vc of −1.1 KV is applied to the contact charging device 2 to charge the drum 1 (3). Although the developing bias Vb is ordinarily set at +100 V (in this embodiment) in order to prevent the development when the surface of the drum 1 at the zero potential passes, it is changed to −250 V (Vb=−250 V) for the development (4). The voltage $V_T$ of +6.5 KV (in this embodiment) is applied to the transfer charger 4 for allowing the transfer operation.

Oblique lines, e.g., indicated by (#WO) in the timing chart are linear lines each connecting time points at which one certain point on the drum 1 passes over the respective elements, i.e., charging device, developing device and transfer device.

The region #A indicates a region which is charged but is not subjected to the processing by the transfer charger 4.

Figure 23:
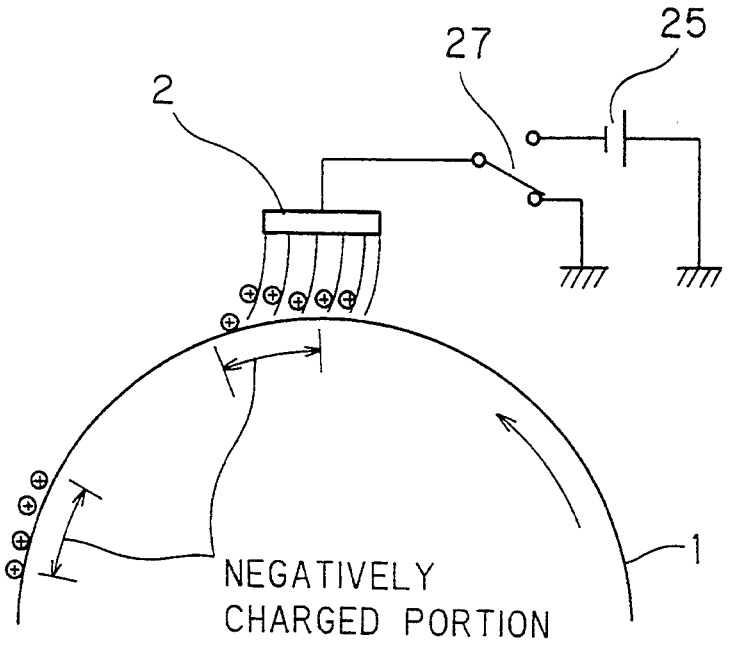
FIG. 23 shows a manner in which positively charged stain moves from a charging brush to a photosensitive drum.

As indicated by (6), (8), (9) and (11), the voltages Vc and $V_T$ applied to the charging device and transfer device are changed, whereby:

(a) the portion (#A), which is negatively charged but is not processed by the transfer charger 4 (and thus maintains a negatively charged state), is formed, and (b) the portion (#I), which corresponds to the portion (#A) on the drum 1 after one rotation, is in the negatively charged state when the contact charging device 2 to which 0 V is applied contacts the same. In this operation, the electric field acts to move the positively charged stain, which adheres to the brush of the charging device 2, to the drum 1. In this manner, the brush is cleaned. FIG. 23 shows the manner in which the positive stain on the charging device 2 moves onto the drum 1 owing to the voltage Vc of 0 V.

Figure 22:
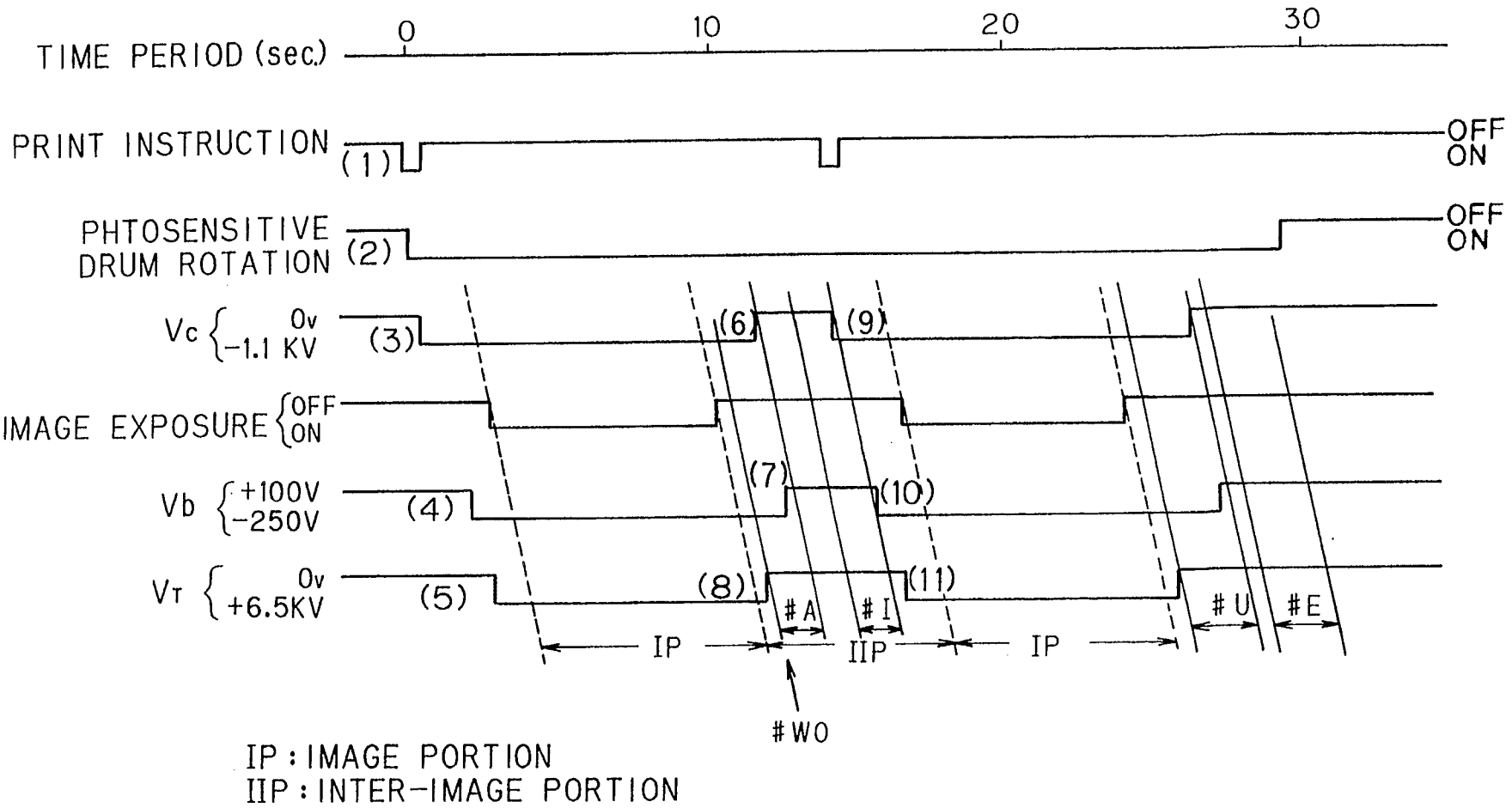
FIG. 22 is a timing chart showing an operation of a printer of still another embodiment of the invention.

(7) and (10) in FIG. 22 indicate the operations in which the developing bias is changed so as to prevent the adhesion of the toner onto the drum when the device 2 does not carry out the charging.

In the continuous printing, the voltage Vc of −1.1 KV is applied to the charging device 2 even after the continuous printing operation, so that a portion (#U), which is negatively charged but is not processed by the transfer charger (and thus maintains the negatively charged state), may be formed. A portion (#E) corresponding to the portion (#U) after one rotation is in the negatively charged state, and the contact charging device 2 to which 0 V is applied contacts the same for cleaning the device 2.

Since the stain adhered to the charging device 2 can be removed in this manner, the defective charging in a striped form due to the stain inherent to the contact charging device can be prevented.

The striped noises were evaluated after the printing of 5000 sheets carried out by intermittently repeating the continuous printing of two sheets, while removing the stain on the charging device 2 by changing the voltages applied to the charging device 2 and the transfer device 4, as described before. The result was good.

The evaluation of the striped noise was carried out for evaluating whether the stain of the brush charging device 2 by the fine powder was removed well. If there is the fine powder stain on the brush hairs in the charging device 2, irregular charging is caused on the surface of the photosensitive drum 1 in a direction perpendicular to the advancing direction thereof. This irregular charging will remains as an irregular post-exposure potential even after the exposure of the image. Thus, a portion, which has a potential higher than that of the other portion immediately after the charging by the charging device, will become a portion having a higher potential even after the exposure.

In a case of the reversal development, a larger amount of toner adheres to a portion having a lower potential. The irregularity in the potential in the charging by the charging device causes the irregularity in the potential even after the image exposure, and ultimately causes the irregularity in the image, i.e., the striped noise. In view of the foregoing, the evaluation of the fine powder stain of the charging device 2 is conducted by evaluating the striped noises. The striped noises is evaluated in the manner already described with reference to FIG. 16.

Depending on the standard deviation $\sigma$, the image noises are ranked as follows.

| Standard Deviation $\sigma$ | Evaluation Mark |
|---|---|
| $10\ \mu m \leqq \sigma < 30\ \mu m$ | ○ |
| $30\ \mu m \leqq \sigma$ | X |

In the above evaluation, the circular mark indicates a condition in which the noise is not recognized or can be negligible. The mark "X" indicates a condition in which the image noise exists and is not practically allowed. Large values of the standard deviation $\sigma$ indicate the fact that the width of the small black solid pattern in the main scanning direction deviates to a large extent in the main scanning direction.

In this embodiment, the striped noise after the printing of 5000 sheets is evaluated to be good (circular mark).

In order to carrying out the light erasing by the eraser 6 in the above embodiment, the timing for the turn-on and turn-off thereof must be carefully determined. That is; the light erasing must be interrupted for a predetermined time period so that the charge accumulated in the electrostatic latent image carrier, which enables the cleaning of the contact charging device, may not be erased.

The present invention may be embodied in various forms, other than the above embodiment.

The electrostatic latent image carrier to which the invention can be applied is not restricted to the negatively chargeable photosensitive member described before, and can be applied to the positively chargeable carrier. Further, the invention can be applied not only to the rotary type, but also to the reciprocative type.

The change of the voltages applied at least to the charging device, transfer device and developing device may be carried out at the same timing, whereby the common power supply can be used.

The change of the developing bias in the embodiment may be modified. Specifically, the changes of the polarity and voltage of the developing bias depend on the characteristics of the developing device. The change of the bias, which is carried out between the negative polarity and positive polarity in the embodiment, may be carried out in various manners, e.g., between the negative polarity and negative polarity (change of voltage), between negative polarity and 0 V, and between negative polarity and floating. In summary, it is advantageous to prevent the adhesion of the toner to the electrostatic latent image carrier during the cleaning operation for the charging device in order to reduce the toner consumption.

A.C. may be additionally applied to the image carrier charging device employed for cleaning the contact charging device. The important factor is the opposite electric field region, and the cleaning effect depends on the existence of the opposite electric field region.

The steps for charging the electrostatic latent image carrier and cleaning the contact charging device may be conducted before the start of the printing, after the printing, between the printing operations (during inter-image period), upon power-on of the image forming apparatus, and during the restoring operation from the jammed state, and also may be conducted on the basis of the information supplied from appropriate means which monitors the quality of the image. Further, the cleaning operation may be carried out in accordance with an instruction supplied, e.g., by means of a manual switch operated by an operator. Of course, the cleaning operation may be carried out in manners other than the foregoing.

As described before, the present invention can provide the image forming apparatus using the contact charging device, in which the stain by the fine powder adhered to the contact charging device can be facilely removed, without disadvantages such as reduction of the charged amount of the surface of the electrostatic latent image carrier and generation of the irregular charging.

EMBODIMENT 50

The printer in this embodiment is basically the same as that shown in FIG. 17.

A system speed of the printer, i.e., a peripheral speed of the photosensitive drum 1 is 3.5 cm/sec.

Figure 24A:
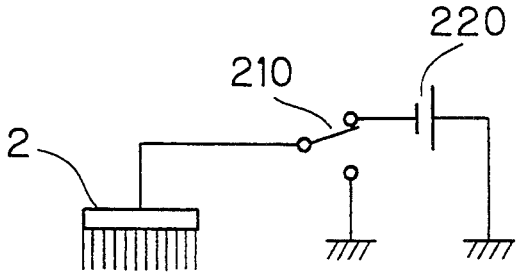
FIG. 24(A) shows means for applying a voltage to a charging device in a printer of yet another embodiment of the invention.

The charging device 2 is connected to the power supply 220 through the switch 210, as shown in FIG. 24(A), or is grounded. The voltage Vc applied to the charging device 2 is −1.1 KV with respect to the image forming portion, if connected to the power supply 220, and is 0 V with respect to the non-image portion, if grounded.

Figure 24B:
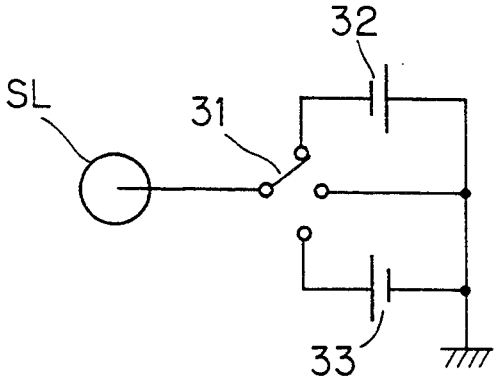
FIG. 24(B) shows means for applying a voltage to a developing sleeve in the same printer.
Figure 24:
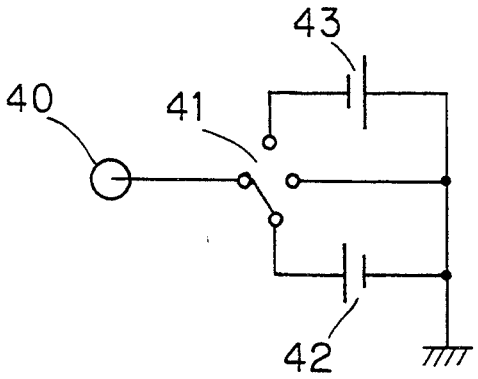
FIG. 24(C) shows means for applying a voltage to a transfer device in the same printer.

The developing device 3 is a contact developing device using one-component developer. A developing sleeve SL is connected, as shown in FIG. 24(B), to a power supply 32 or 33 through a switch 31, or is grounded. The bias voltage Vb applied to the developing device is −250 V with respect to the image forming portion, if it is applied by the power supply 32, is +250 V with respect to the non-image portion, if it is applied by the power supply 33, and is 0 V if grounded. For the ordinary image formation by the developing device 3, the reversal development is carried out with the toner which is frictionally charged at the same charge polarity as the charge polarity of the drum 1 under the developing bias voltage Vb of −250 V.

The transfer device 4 is connected, as shown in FIG. 24(C), to a power supply 42 or 43 through a switch 41, or is grounded. The voltage $V_T$ applied to the transfer roller 40 is +1.1 KV and has the polarity opposite to that of the toner, if it is supplied by the power supply 42 for transferring the toner image formed on the photosensitive member onto the transfer sheet. The voltage $V_T$ is −900 V and has the same polarity as the charge polarity of image forming portion, if it is supplied by the power supply 43, and is 0 V if grounded.

Figure 25:
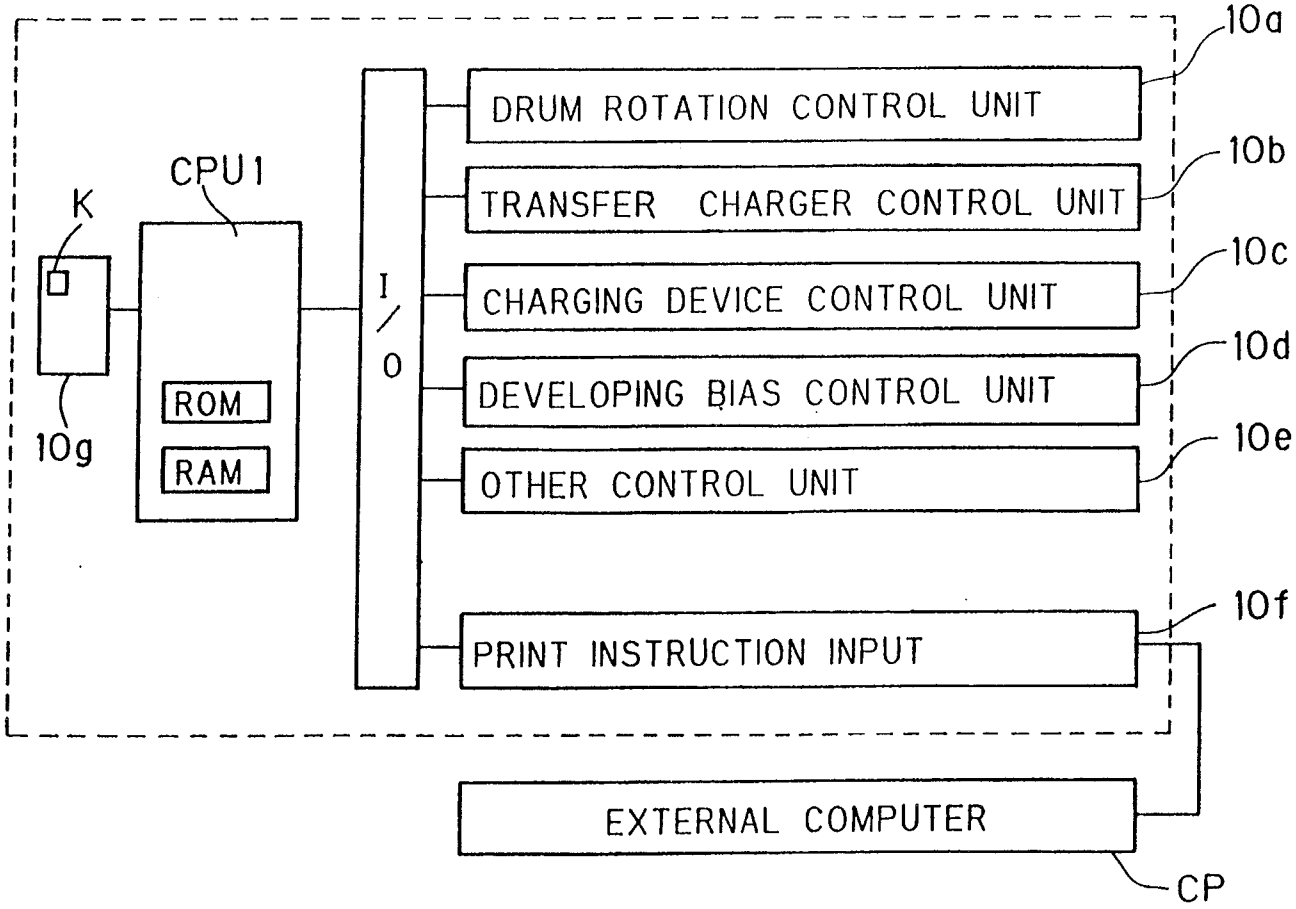
FIG. 25 is a block diagram showing a major part of a control circuit of a printer described with reference to FIG. 24(A)

FIG. 25 is a block diagram showing a major part of the control circuit of the printer which is basically the same as that shown in FIG. 2(B). However, the operation control of each element by the processor CPU1 is different. This control circuit includes, as a major component, the microprocessor CPU1 including the read only memory (ROM) and the random access memory (RAM). The whole operation of the printer is controlled by this microprocessor CPU1.

The microprocessor CPU1 is connected through the interface circuit I/O to the rotation control unit 10*a* for the photosensitive drum 1, the control unit 10*b* for the transfer device 4, the control unit 10*c* for the charging device 2, the developing bias control unit 10*d*, and other control unit 10*e*, and is also connected to the print instruction input 10*f*.

The processing program of the microprocessor CPU1 is stored in the ROM. The print instruction input 10*f* receives the printer control signal from the external computer CP such as a personal computer and sends the same to the microprocessor CPU1.

The ROM has also stored time periods from the receipt of the print instruction to various actions such as start and stop of the rotation of the photosensitive drum 1, application of the voltage $V_T$ to the transfer device 4, change of the voltage $V_T$, interruption of the voltage $V_T$, application of the voltage Vc to the charging device 2, change of the voltage Vc, interruption of the voltage Vc, application of the developing bias voltage Vb, change of the voltage Vb, and interruption of the voltage Vb. Based on these stored contents, ON/OFF and switch selection signals are supplied through the interface I/O to the photosensitive member rotation control unit 10*a* , transfer device control unit 10*b* , charging device control unit 10*c* , and developing bias control unit 10*d*. The change of the voltage Vc applied to the charging device 2 is instructed by the control unit 10*c* . The change of the developing bias voltage Vb applied to the developing device 3 is instructed by the control unit 10*d*. The change of the voltage $V_T$ applied to the transfer device 4 is instructed by the control unit 10*b*.

The microprocessor CPU1 is also connected to the operator panel 10*g*, which is provided with the print key K for allowing the start of print.

Figure 26:
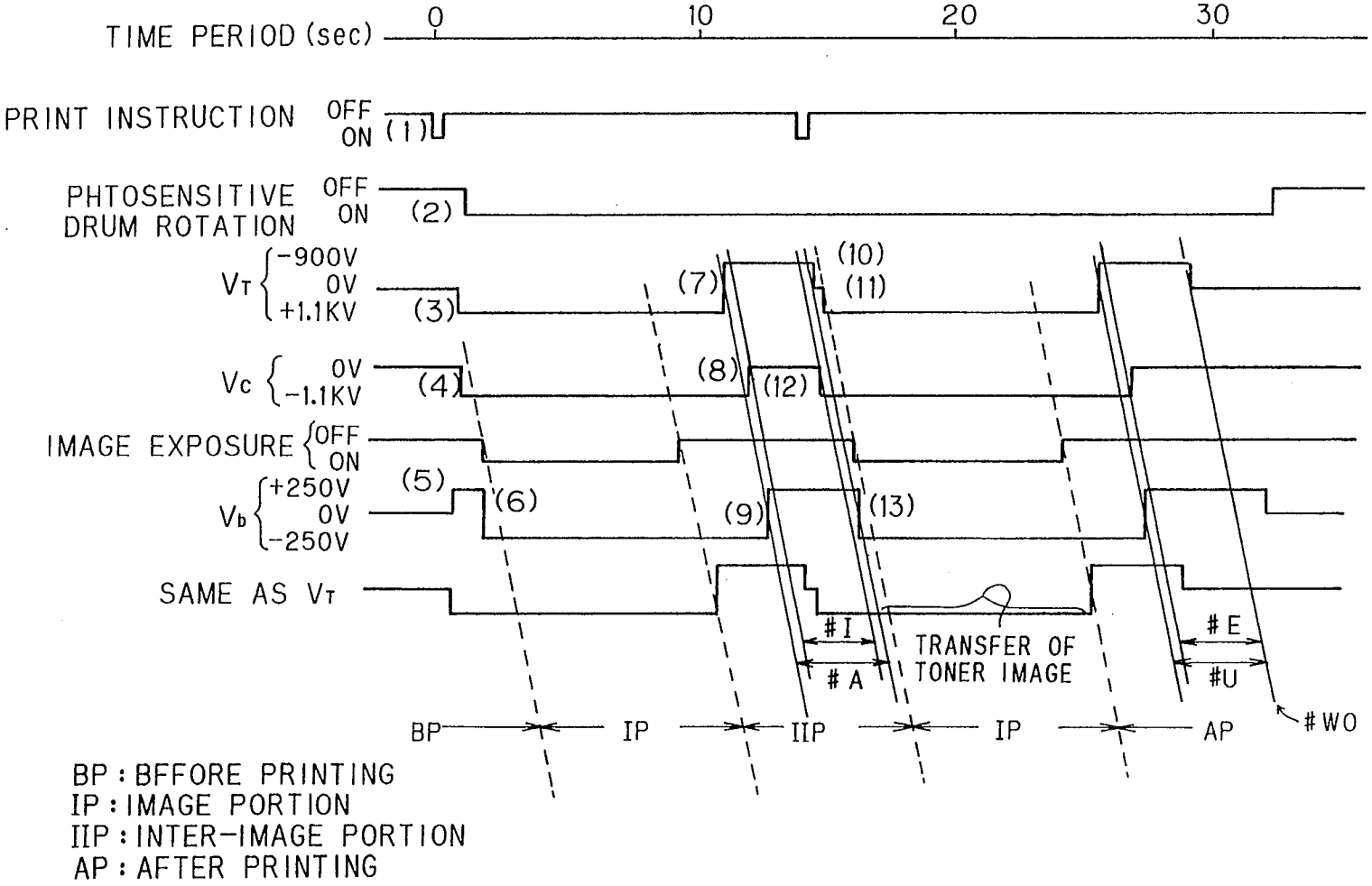
FIG. 26 is a timing chart showing an operation of a printer described with reference to FIG. 24(A)

The printer carries out the printing in a manner described below in accordance with the timing shown in a timing chart of FIG. 26.

First, the print key K is in the on-state and the printer receives the print instruction from the external computer CP (1), whereby the photosensitive drum 1 starts to rotate (2). Simultaneously, the voltage Vc of −1.1 KV is applied to the contact charging device 2 to charge the drum 1 (4). The charged region is subjected to the exposure by the optical system 7, and the developing device forms the toner image. Also simultaneously, the developing bias Vb (Vb = +250 V) is set at the polarity opposite to that for the image development (5), so that the toner may not be moved onto the drum when an uncharged portion of the drum 1 passes through the developing device.

At the same time, the voltage ($V_T$=+1.1 KV) for transferring the developed toner on the drum 1 to a transfer sheet is applied to the transfer device 4 (3).

After the uncharged portion of the drum 1 passed, the developing bias is set at the voltage (Vb=−250 V) suitable to the image development (6).

After the completion of the print, the polarity of the voltage applied to the transfer device 4 is inverted (Vc=−900 V) (7). Thus, the transfer device 4 charges the drum 1 at the negative polarity, i.e., regular charge polarity.

Oblique lines, e.g., indicated at (#O) in the timing chart are linear lines each connecting time points at which one certain point on the drum 1 passes over the respective elements, i.e., charging device, developing device and transfer device.

The region (#A) indicates the portion of the drum 1 which is negatively charged by the transfer device 4, i.e., the inter-image portion formed between the image formation portion and the subsequent image formation portion.

After the portion of the photosensitive drum 1 which has been negatively charged by the transfer device 4 reaches the charging device 2, the application voltage Vc of the charging device 2 is set at 0 V (8). Thereby, the surface potential of the drum 1 shifts to the negative side with respect to the potential (0 V) of the charging device 2 at any time, i.e., before it reaches the charging device 2, when it located under the charging device and after it passes through the charging device. Thereby, the stain by the positively charged toner fragments adhered to the charging device 2 is returned to the drum 1, and thus the charging device 2 is cleaned up.

The opposite electric field for cleaning the charging device 2 is formed in the region indicated by (#I).

The developing bias Vb is changed to +250 V before the portion of the drum 1, which corresponds to the voltage Vc applied to the charging device is 0 V, reaches the developing device 3 (9). Thereby, the unnecessary development due to the voltage Vc of 0 V applied by the charging device is prevented.

After the formation of the opposite electric field (#I) between the charging device 2 and the drum 1, the voltage of −1.1 KV is applied to the charging device 2 (12). Thereafter, the developing bias is returned to −250 V which is the same value as that for the printing (13). The voltage of −900 V, which was applied to the transfer device 4 for forming the opposite electric field, is returned to 0 V [(10)], and is further changed to +1.1 KV [(11)]. This change at the two stages is not essential, and it can be changed directly from −900 V to +1.1 KV.

For the multi-printing, it is required only to negatively charge the drum 1 by the transfer device 4 and form the opposite electric field between the charging device 2 and the drum 1 after the multi-printing (region (#E)).

The region (#E) is different from the formation (#I) of the opposite electric field between the images in that it is not necessary to apply +1.1 KV to the transfer device 4 again, to apply −1.1 KV to the charging device 2 again and to set the developing bias at −250 V.

During the ordinary printing, for example, −1.1 KV is applied to the charging device 2, during which the surface potential of the drum 1 is about −700 V, and the stain by the positive toner fragments and others adhered to the charging device 2 cannot be separated from the charging device 2 due to the electric field between the charging device 2 and the drum 1.

However, even if the opposite electric field is formed, in other words, even if the charging device 2 is set at 0 V, the surface potential of the drum 1 does not change completely to 0 V, and the surface potential nearly equal to the discharge stop voltage remains. Therefore, the surface potential of the drum 1 is about −400 V, and the positive stain on the charging device 2 moves from the charging device 2 to the drum 1. The stain adhered to the surface of the drum 1 is conveyed in accordance with the movement of the drum 1, from a position immediately below the charging device 2 via developing device 3 and transfer device 4 to the cleaning device 5. The stain is removed from the surface of the drum 1 by the developing device 3, transfer device 4 and cleaning device 5.

Figure 27:
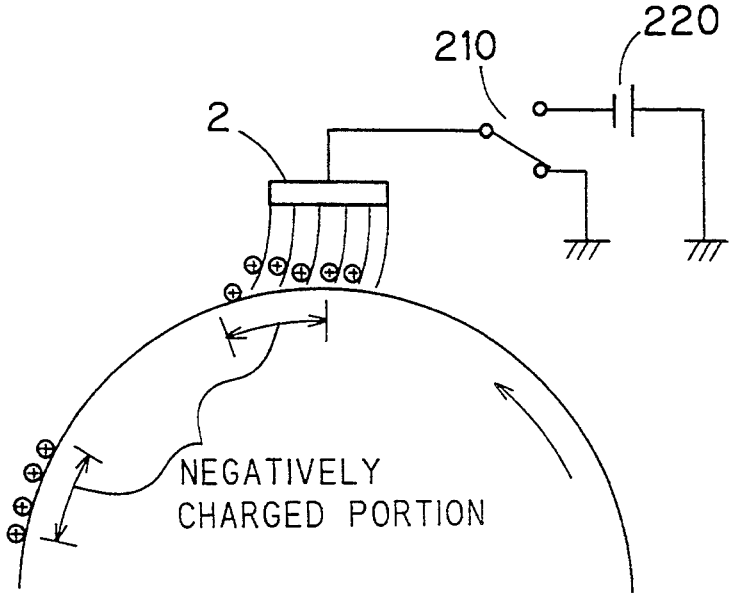
FIG. 27 shows a manner in which positively charged stain moves from a charging brush to a photosensitive drum.

FIG. 27 shows a state in which the positive stain on the charging device 2 is moved to the negatively charged portion of the drum 1 owing to the setting of Vc=0 V.

Since the stain adhered to the charging device 2 is removed in this manner, the defective charging in a striped form due to the stain inherent to the contact charging device can be prevented.

The striped noises were evaluated after the printing of 5000 sheets carried out by intermittently repeating the continuous printing of two sheets, while removing the stain on the charging device 2 by changing the voltages applied to the charging device 2 and the transfer roller 40, as described before. The result was good.

The evaluation of the striped noise was carried out for evaluating whether the stain of the brush charging device 2 by the fine powder was removed well. If there is the fine powder stain on the brush hairs in the charging device 2, irregular charging is caused on the surface of the photosensitive drum in the direction perpendicular to the advancing direction thereof. This irregular charging will remain as an irregular post-exposure potential even after the exposure of the image. Thus, a portion, which has a potential higher than that of the other portion immediately after the charging by the charging device, will become a portion having a higher potential even after the exposure. The specific manner for the evaluation is the same as that already described with reference to FIG. 16.

Depending on the standard deviation $\sigma$, the image noises are ranked as follows.

| Standard Deviation $\sigma$ | Evaluation Mark |
|---|---|
| $10\ \mu m \leqq \sigma < 30\ \mu m$ | ○ |
| $30\ \mu m \leqq \sigma$ | X |

In the above evaluation, the circular mark indicates a condition in which the noise is not recognized or can be negligible. The mark "X" indicates a condition in which the image noise exists and is not practically allowed. Large values of the standard deviation $\sigma$ indicate the fact that the width of the small black solid pattern in the main scanning direction deviates to a large extent in the main scanning direction.

In this embodiment, the striped noise after the printing of 5000 sheets is evaluated to be good (circular mark).

In the embodiments and examples for comparison described later, the circular mark and "x" mark used in the evaluation of the striped noise have the same meaning as the foregoing.

EMBODIMENT 51

Figure 28:
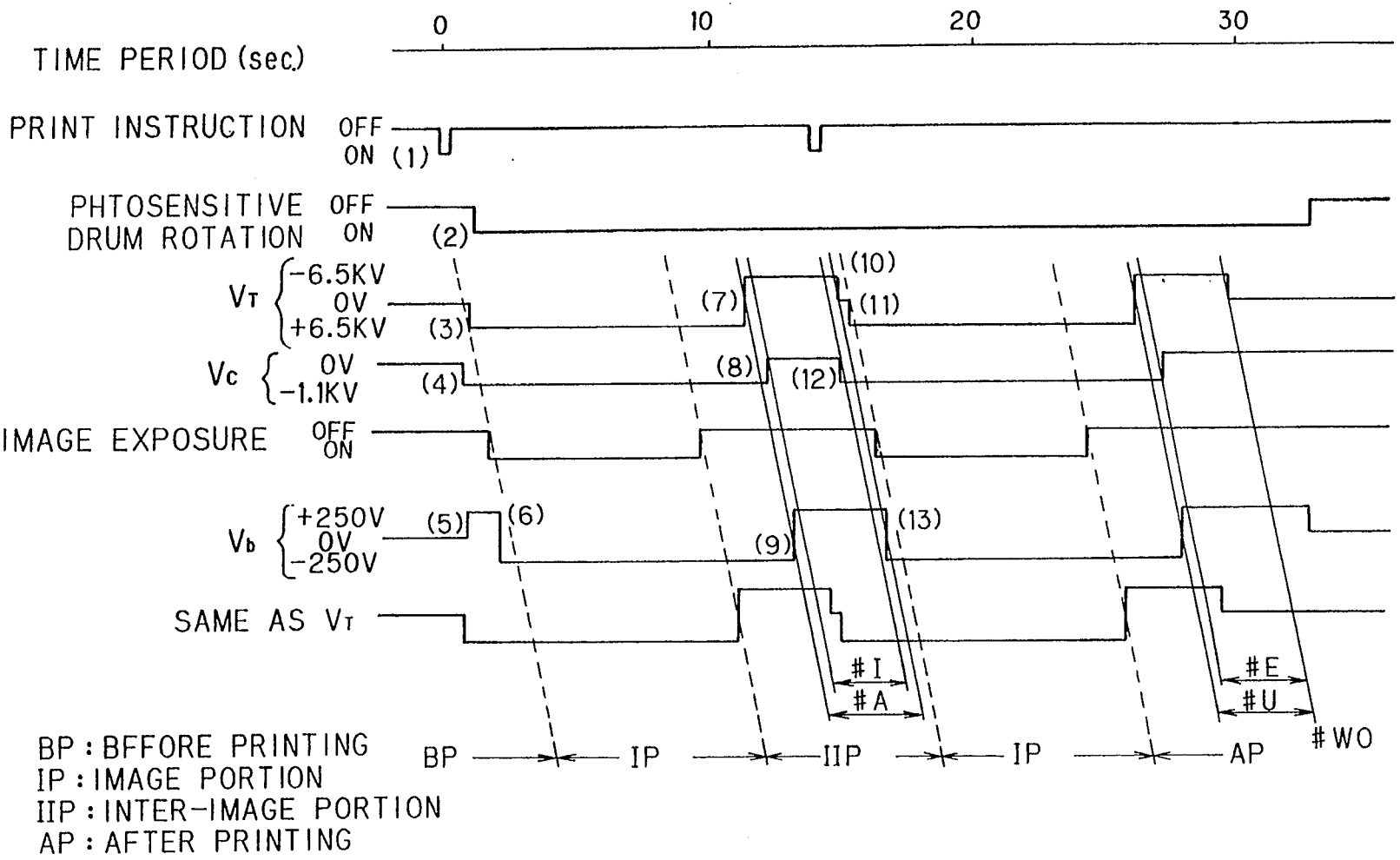
FIG. 28 is a timing chart showing an operation of a printer of further another embodiment.

A transfer charger in FIG. 1 utilizing the corona charging is employed instead of the transfer device 4 in the printer shown in FIG. 17, and the voltages Vc and $V_T$ applied to the contact charging device 2 and the transfer charger are changed in accordance with the timings shown in FIG. 28. The voltage $V_T$ applied to the transfer charger is changed between −6.5 KV, 0 V and +6.5 KV. The timing chart of FIG. 28 is the same as that shown in FIG. 26 except for the foregoing.

Under the above conditions, the printing of 5000 sheets was carried out by intermittently repeating the continuous printing of two sheets, and the striped noises were evaluated. The result was good (circular mark).

EMBODIMENT 52

Figure 29:
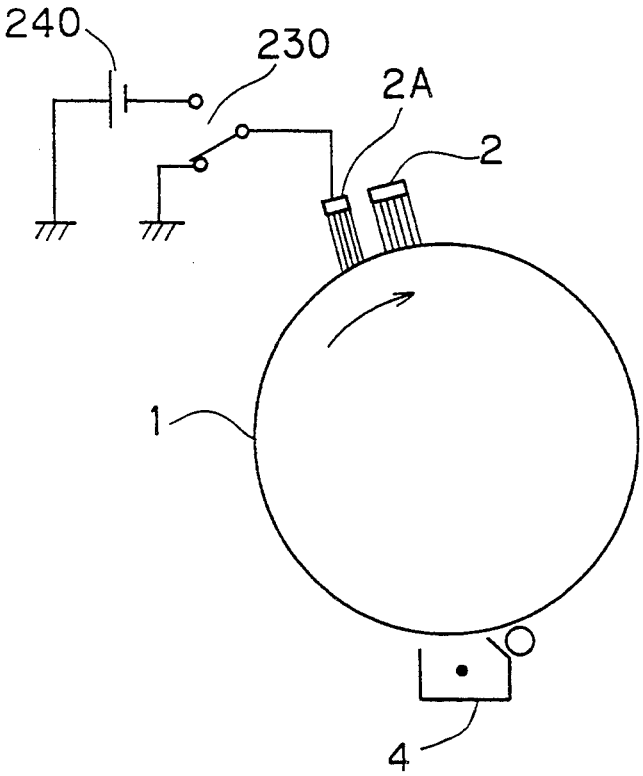
FIG. 29 shows a part of a construction of a printer of further another embodiment.
Figure 30:
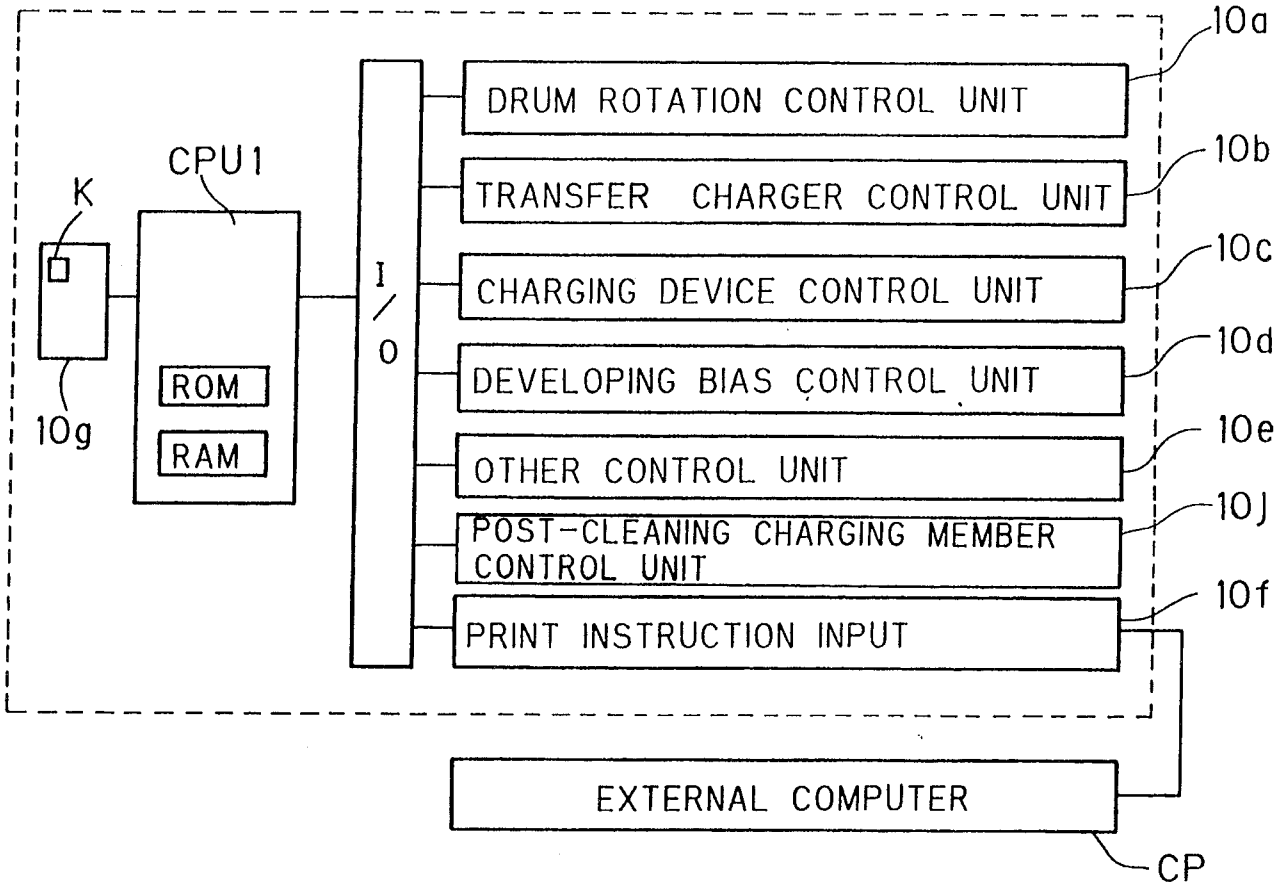
FIG. 30 is a block diagram showing a major part of a control circuit of a printer in FIG. 29.
Figure 31:
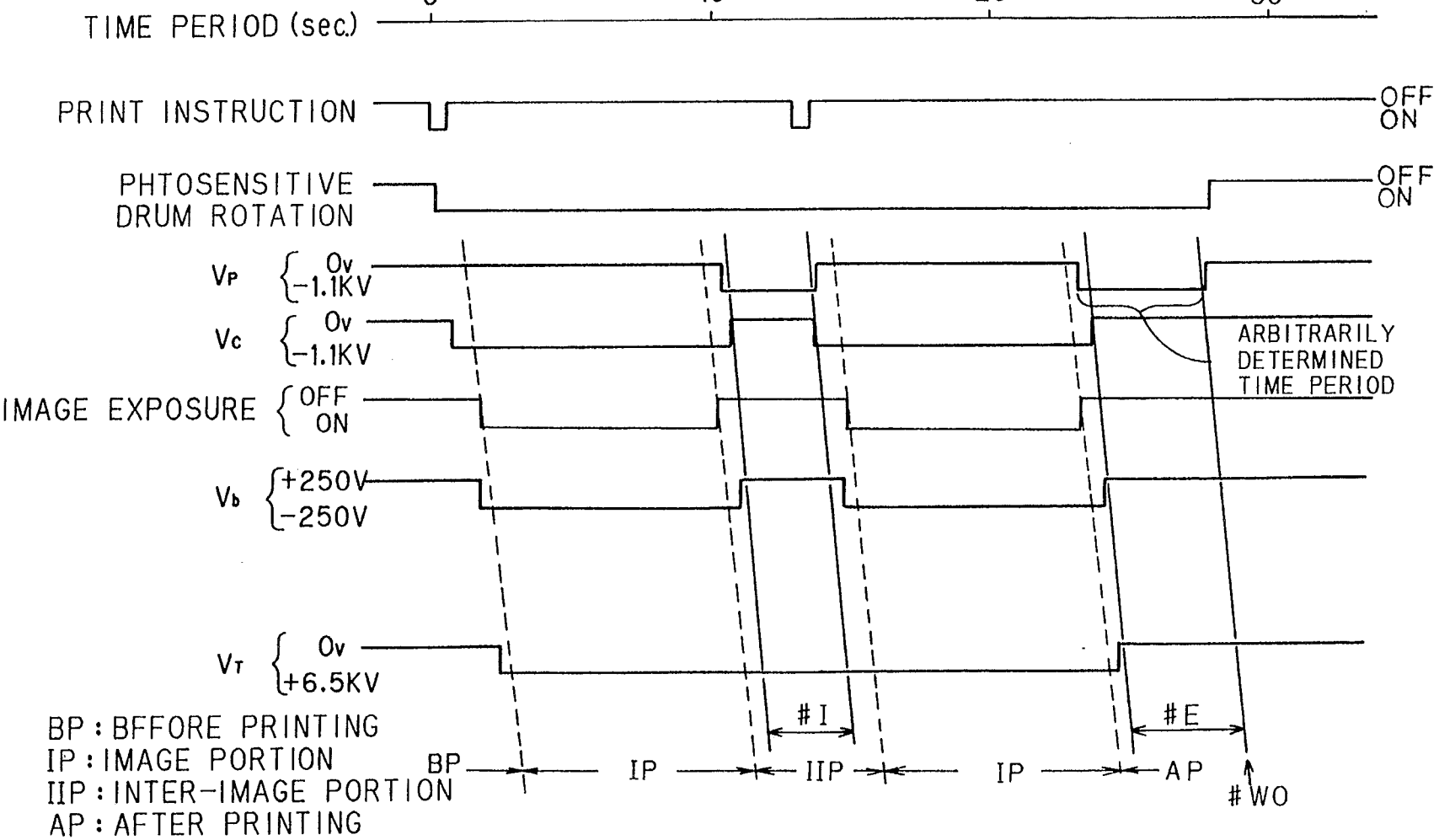
FIG. 31 is a timing chart showing an operation of a printer in FIG. 29.

As shown in FIG. 29, the printer shown in FIG. 1 is additionally provided with a post-cleaning charging member (brush) 2A, which can be connected to a power supply 240 through a switch 230, or can be grounded. The printer control circuit is additionally provided with a control unit 10*j* for the post-cleaning charging member 2A, as shown in FIG. 30. In the operation of this printer, the voltage Vc applied to the contact charging device 2 and a voltage Vp applied to the post-cleaning charging member 2A are changed in accordance with the timings shown in FIG. 31.

Under the above conditions, the printing of 5000 sheets was carried out by intermittently repeating the continuous printing of two sheets, and the striped noises were evaluated. The result was good (circular mark).

EMBODIMENT 53

Figure 32:
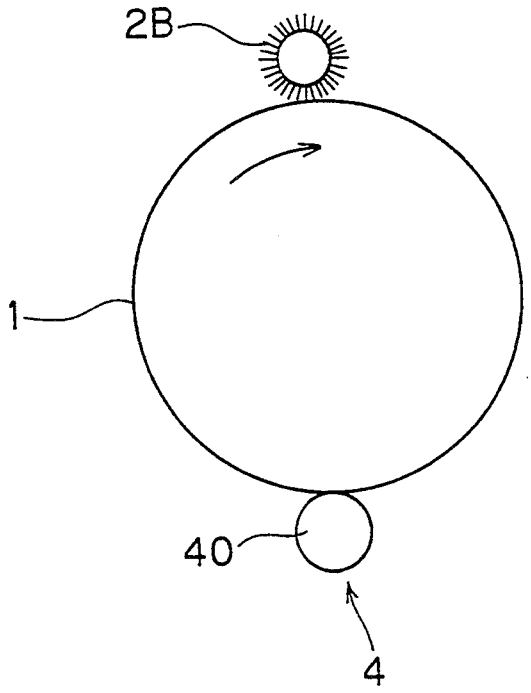
FIG. 32 shows a part of a construction of a printer of further another embodiment of the invention.

The printer shown in FIG. 17 is provided with a contact charging device 2B of a rotary brush type instead of the contact charging device 2, as shown in FIG. 32. Except for this, the printer has the substantially same construction as that of the printer shown in FIG. 17. In the operation of this printer, the voltage Vc applied to the contact charging device 2B and the voltage $V_T$ applied to the transfer device 4 are changed in accordance with the same timings as those shown in FIG. 26.

Under the above conditions, the printing of 5000 sheets was carried out by intermittently repeating the continuous printing of two sheets, and the striped noises were evaluated. The result was good (circular mark).

EMBODIMENT 54

Figure 33:
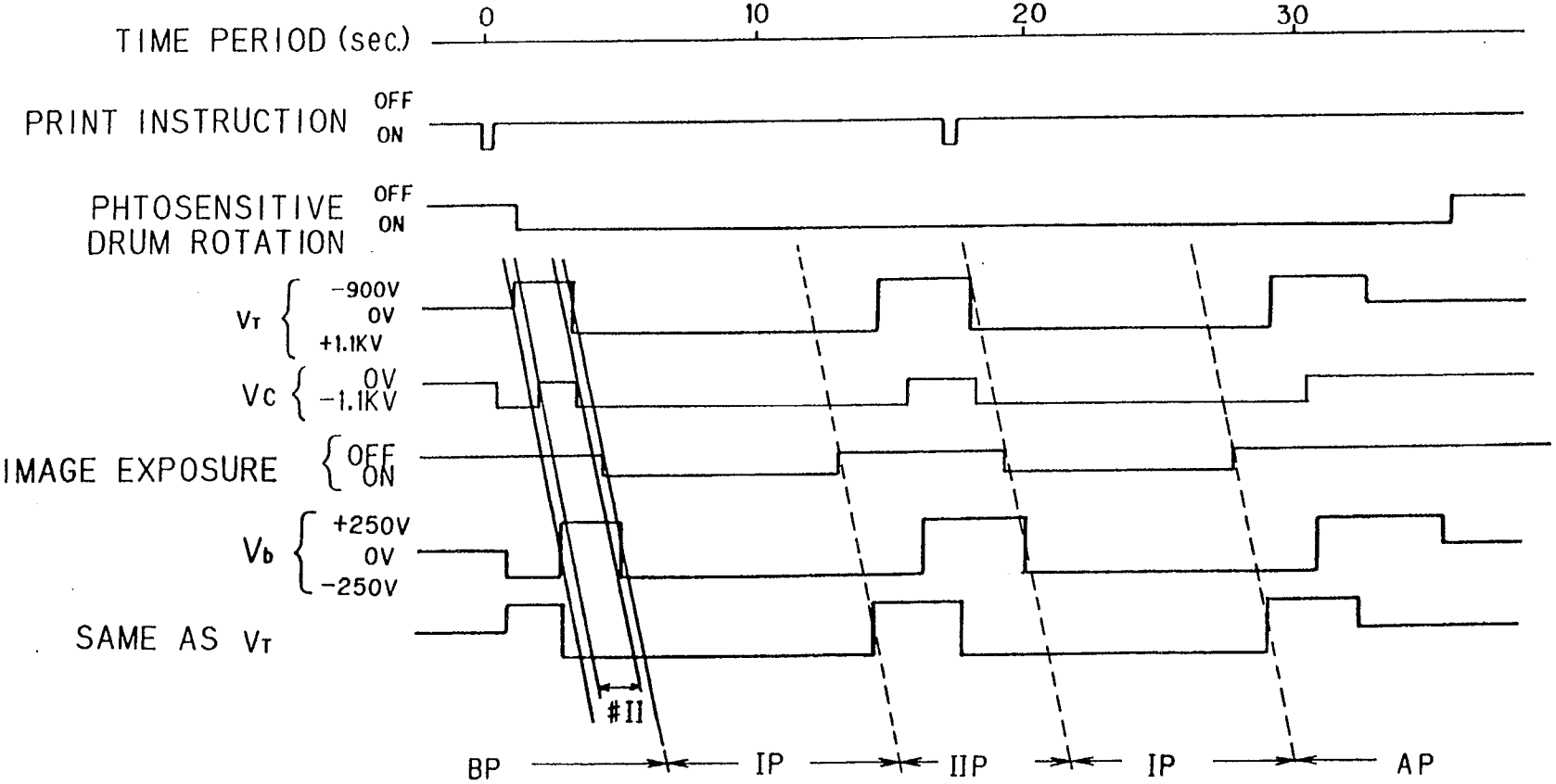
FIG. 33 is a timing chart showing an operation of a printer in FIG. 32.

The printer shown in FIG. 17 was used, and the voltages Vc and $V_T$ applied to the contact charging device 2 and the transfer roller 40 were changed in accordance with the timings shown in FIG. 33.

This embodiment is provided with a step, in which the photosensitive drum 1 is charged by the transfer device 4 also prior to the printing, and the voltage to the charging device 2 is shut off, whereby the stain adhered to the charging device 2 is removed. The operations during the inter-image period and after the printing are the same as those in the embodiment 50. The opposite electric field is formed in the region indicated by (#TI) shown in the timing chart of FIG. 33 for cleaning the charging device 2.

Under the above conditions, the printing of 5000 sheets was carried out by intermittently repeating the continuous printing of two sheets, and the striped noises were evaluated. The result was good (circular mark).

The cleaning step may be conducted before the printing, as described before.

In any of the embodiments described above, if the light erasing by the eraser 6 is to be carried out, the timing for the turn-on and turn-off thereof must be carefully determined. Specifically, the light erasing must be interrupted for a predetermined time period so that the charge accumulated in the electrostatic latent image carrier, which enables the cleaning of the contact charging device, may not be erased.

The present invention may be embodied in various forms, other that those described before.

The electrostatic latent image carrier to which the invention can be applied is not restricted to the negatively chargeable photosensitive member described before, and can be applied to the positively chargeable carrier. Further, the invention can be applied not only to the rotary type, but also to the reciprocative type. Although the embodiments described above employ the reversal development, the invention may be applied to the regular development.

The change of the voltages applied at least to the charging device, transfer device and developing device may be carried out at the same timing, whereby the common power supply can be used.

The manner for forming the opposite electric field for cleaning the contact charging device is not restricted to that already described in connection with the embodiments. For example, without changing the voltage applied to the charging device, the transfer device or other appropriate charging means may be used to charge the surface of the electrostatic latent image carrier at the potential of −1.5 KV, and the voltage of −1.1 KV may be applied to the charging device. In summary, it is necessary to form the opposite electric field without applying the voltage opposite to the charge polarity of the image carrier to the charging device.

The change of the developing bias in the embodiments may be modified. Specifically, the changes of the polarity and voltage of the developing bias depend on the characteristics of the developing device. The change of the bias, which is carried out between the negative polarity and positive polarity in the embodiments, may be carried out in various manners, e.g., between the negative polarity and negative polarity (change of voltage), between negative polarity and 0 V, and negative polarity and floating.

A.C. may be additionally applied to the image carrier charging device, which operates to clean up the contact charging device. The important factor is the opposite electric field region, and the cleaning effect depends on the existence of the opposite electric field region.

The steps for charging the electrostatic latent image carrier and cleaning the contact charging device may be conducted before the start of the printing, after the printing, between the printing operations (during inter-image period), upon power-on of the image forming apparatus, and during the restoring operation from the jammed state, and also may be conducted on the basis of the information supplied from appropriate means which monitors the quality of the image. Further, the cleaning operation may be carried out in accordance with an instruction supplied, e.g., by means of a manual switch operated by an operator. Of course, the cleaning operation may be carried out in accordance with manners other than the foregoing.

EMBODIMENT 55

The printer in this embodiment is basically the same as that shown in FIG. 17.

Figure 34A:
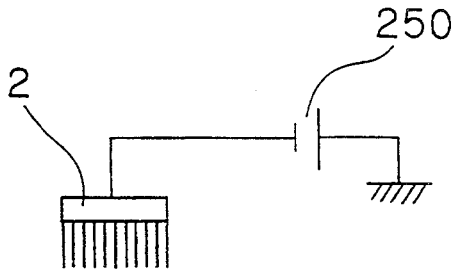
FIG. 34(A) shows means for applying a voltage to a charging device in a printer of another embodiment of the invention.

The system speed of the printer (i.e., peripheral speed of the photosensitive drum 1) is 3.0 cm/sec The charging device 2 is connected to the power supply 250 in this embodiment, as shown in FIG. 34(A). The voltage Vc applied to the charging device 2 is −1.2 KV.

Figure 34B:
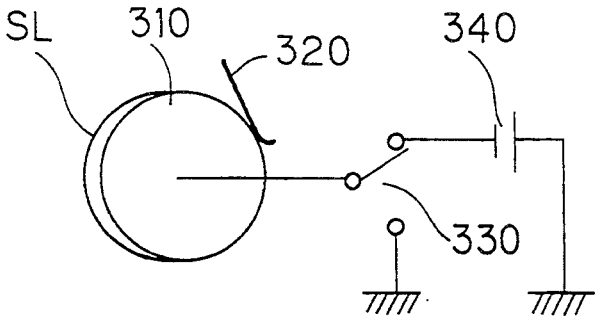
FIG. 34(B) shows means for applying a voltage to a developing device in the same printer.

The developing device 3 is a contact developing device using one-component developer, and includes a developing sleeve SL fitted onto a drive roller 310, as shown in FIG. 34(B), which is driven to rotate by a motor M2 (see FIG. 17) in a counterclockwise direction in the figure. The sleeve SL is pressed to the roller 310, and is in contact with a toner restricting blade 320. In accordance with the rotation of the roller 310, the sleeve SL is driven to rotate while contacting the drum 1. The toner is charged when passing through the restriction blade 320, and is transported to the developing region by the sleeve SL at a restricted transporation rate. As shown in FIG. 34(B), the developing sleeve SL may be connected to a power supply 340 through a switch 330, may be in a floating state, or may be grounded. The bias voltage Vb applied to the developing device is −270 V, if supplied by the power supply 340, and is 0 V, if grounded. In the ordinary image forming operation, the developing device 3 carries out the reversal development under the developing bias Vb of −270 V with the toner having the same charge polarity as the charge polarity of the drum 1.

Figure 34C:
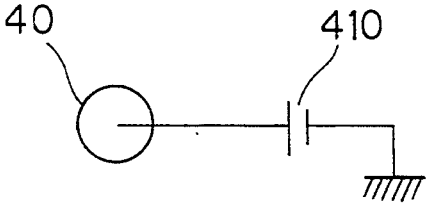
FIG. 34(C) shows means for applying a voltage to a transfer device in the same printer.

The transfer device 4 has the roller 40 connected to a power supply 410, as shown in FIG. 34(C). The voltage $V_T$ applied to the transfer roller 40 is +1 KV.

Figure 35:
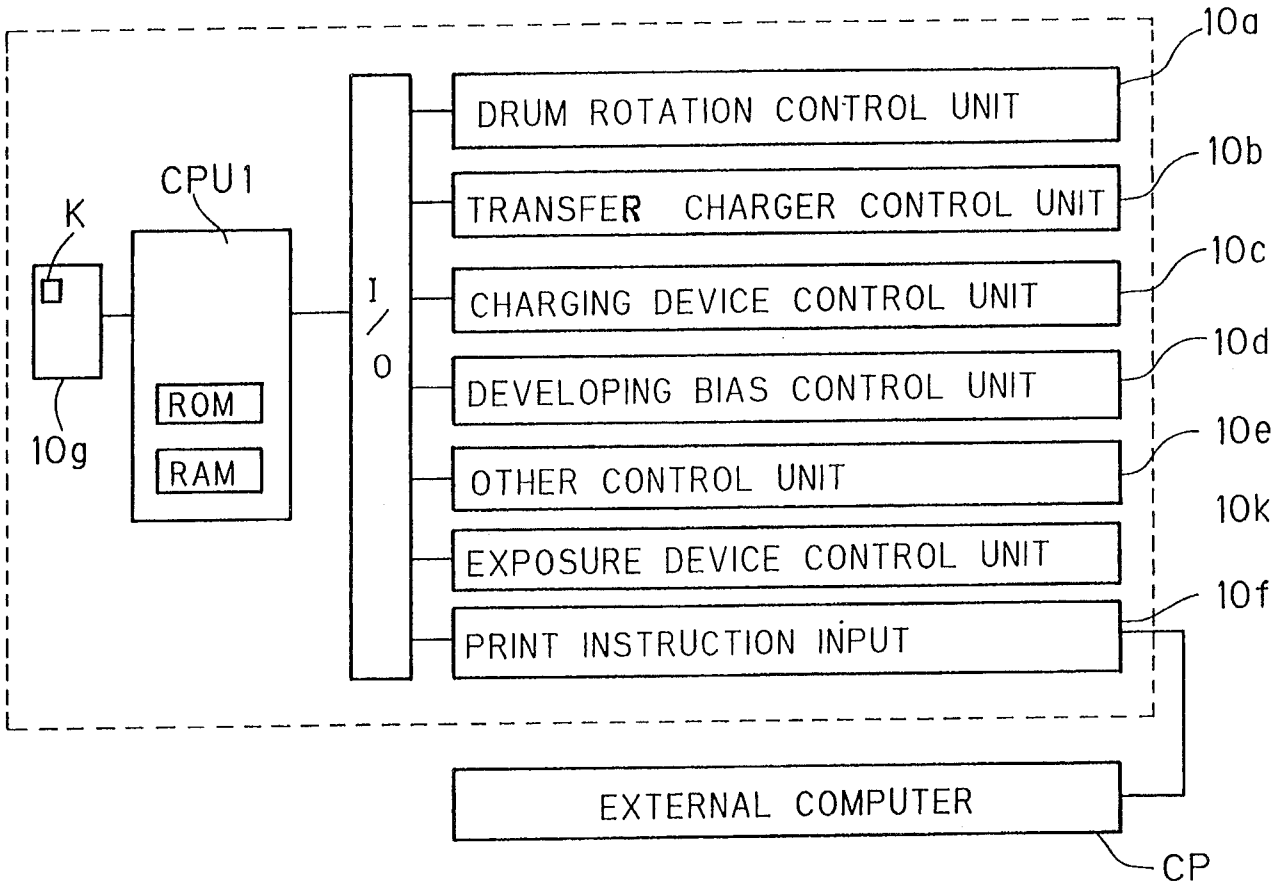
FIG. 35 is a block diagram showing a major part of a control circuit of a printer described with reference to FIG. 34(A)

FIG. 35 is a block diagram showing a major part of the control circuit of the printer which is basically the same as that shown in FIG. 2(B). However, the operation control of each element by the processor CPU1 is different. This control circuit includes, as a major component, the microprocessor CPU1 including the read only memory (ROM) and the random access memory (RAM). The whole operation of the printer is controlled by this microprocessor CPU1.

The microprocessor CPU1 is connected through the interface circuit I/O to the rotation control unit 10*a* for the photosensitive drum 1, the control unit 10*b* for the transfer device 4, the control unit 10*c* for the charging device 2, the developing bias control unit 10*d*, control unit 10*k* for the exposure device 7 and other control unit 10*e*, and is also connected to the print instruction input 10*f*.

The processing program of the microprocessor CPU1 is stored in the ROM. The print instruction input 10*f* receives the printer control signal from the external computer CP such as a personal computer and sends the same to the microprocessor CPU1.

The ROM has also stored time periods from the receipt of the print instruction to various actions such as start and stop of the rotation of the photosensitive drum 1, application of the voltage $V_T$ to the transfer device 4, interruption of the voltage $V_T$, application of the voltage Vc to the charging device 2, interruption of the voltage Vc, application of the developing bias voltage Vb, change of the voltage Vb, interruption of the voltage Vb, full turn-on of the exposure device 7, full turn-off of the same, and image exposure. Based on these stored contents, ON/OFF and switch selection signals are supplied through the interface I/O to the photosensitive member rotation control unit 10*a*, transfer device control unit 10*b*, charging device control unit 10*c*, developing bias control unit 10*d*, and exposure device control unit 10*k*. The application of the voltage Vc applied to the charging device 2 is instructed by the control unit 10*c*. The change of the developing bias voltage Vb applied to the developing device 3 is instructed by the control unit 10*d*. The application of the voltage $V_T$ to the transfer device 4 is instructed by the control unit 10*b*. The turn-on and turn-off of the exposure device 7 is instructed by the control unit 10*k*.

The microprocessor CPU1 is also connected to the operator panel 10*g*, which is provided with the print key K for allowing the start of print.

In the ordinary image forming operation by this printer, the surface of the photosensitive drum 1 is uniformly charged at the predetermined potential Vo of −800 V, by the charging device 2 connected to the power supply 250, and the charged region is subjected to the image exposure by the image exposure device 7 to form the electrostatic latent image (post-exposure potential Vi=−80 V). The electrostatic latent image thus formed is developed by the developing device 3 into the toner image, which is moved to the transfer region confronting the transfer device 4.

Meanwhile, the transfer sheet of paper is drawn by the feed roller 84 from the sheet feed cassette 83 through the intermediate roller pair 82 to the timing roller pair 81, from which the sheet is fed to the transfer region in synchronization with the toner image on the drum 1. In the transfer region, the transfer roller 40 transfers the toner image formed on the drum 1 to the transfer sheet. The transfer sheet moves to the fixing rollers 91, at which the toner image is fixed, and then the sheet is discharged by the discharge roller pair 92 to the discharge tray 93.

In this embodiment, the operation is carried out as follows in accordance with the sequence indicated by the timing chart of FIG. 36.

Figure 36:
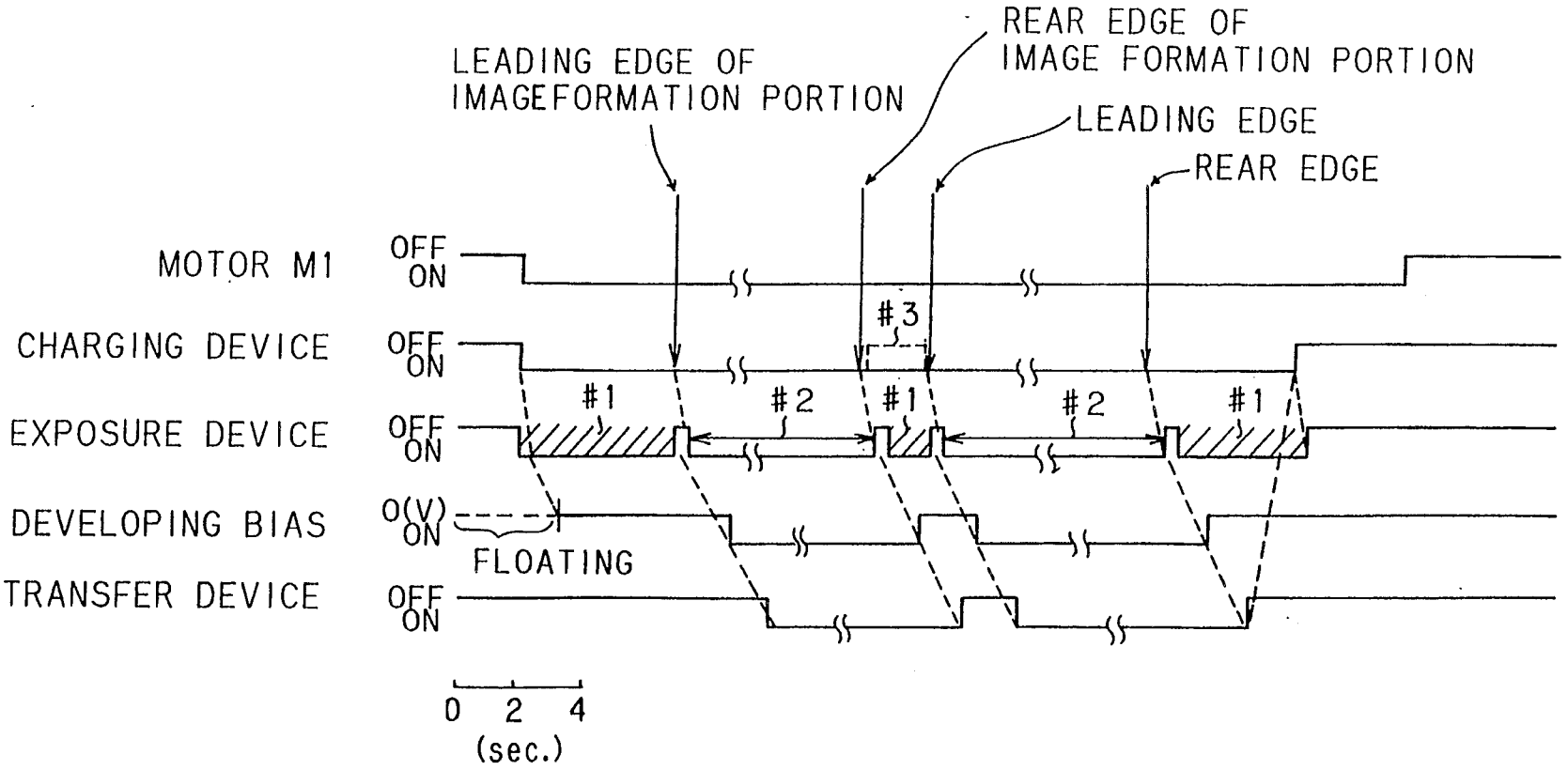
FIG. 36 is a timing chart showing an operation of a printer described with reference to FIG. 34(A)

Oblique lines in FIG. 36 are linear lines each connecting time points at which one certain point on the drum 1 passes over the respective elements such as the exposure device 7 and the developing device 3.

First, the print key K on the operation panel is depressed to start the main motor M1 for feeding the sheets. Simultaneously with the start of the drum 1, the charging device 2 is turned on, and the exposure device 7 is fully turned on to obtain the surface potential (post-exposure potential) Vi of −80 V of the drum 1. In FIG. 36, a hatched portion indicated by (#1) represents the full turn-on state.

The bias Vb of the developing device 3 is initially set at floating to prevent the solid black development at the initial stage, and then set at 0 V (Vb=0 V) when the charged portion on the drum 1 reaches the developing device 3.

The full turn-on exposure is stopped to set the surface potential Vo of the drum 1 at −800 V (Vo=−800) immediately before the leading edge of the image formation portion on the drum 1 reaches the exposure device 7. After the passage of the image margin, the image exposure is carried, out (#2). Also, after the stop of the full turn-on exposure, the developing bias Vb is switched to −270 V. Thereby, the electrostatic latent image is developed. The developed toner image is transferred onto the transfer sheet by turning-on of the transfer device 4.

The image exposure (#2) is stopped at a position 5 mm before the rear edge of said first image formation portion on the drum 1, so that the surface potential Vo of the drum 1 is returned to −800 V, whereby the formation of the electrostatic latent image is completed. After the rear edge passes through the exposure device 7, the full turn-on exposure is restarted and continued until the leading edge of the next image formation portion reaches the exposure device 7. After the passage of the image margin therethrough, the next development exposure (#2) is carried out. During the full turn-on exposure portion in the inter-image portion (between the rear edge of the image formation portion and the leading edge of the next image formation portion) on the drum 1 passes through the developing device 3, the developing bias Vb is set at 0 V. Immediately before the arrival at the image exposure portion, the bias Vb is set at −270 V, and the second development is carried out. After the last image formation, the full turn-on exposure is carried out by the exposure device 7. For this exposed portion, the developing bias Vb is changed to 0 V. After the final transfer of the toner image, the charging device 2 is turned off, and continuously the full turn-on exposure is turned off. Finally, the motor M1 is stopped after the discharge of the transfer sheet.

In accordance with the sequence described above, the surface potential of the photosensitive drum 1 has the post-exposure potential Vi of −80 V and the developing bias Vb is set at 0 V before the first image formation, during the inter-image period and after the last image formation. Therefore, the oppositely charged toner (positively charged toner in this embodiment) generated on the developing device 3 can be suppressed from adhering to the photosensitive drum 1, and correspondingly the unnecessary consumption is suppressed.

In the sequence described above, the charging device 2 may be turned off during the inter-image period, as indicated by (#3) in FIG. 36. Also in this case, the adhesion of the oppositely charged toner can be suppressed during the inter-image period.

In the embodiment 55 described above, the developing device 3 uses the electrically conductive developing sleeve SL having the flexibility. Instead of this, the developing device 3 may use a conductive roller, semiconducting roller or sleeve, or dielectric sleeve or roller, in which case the same effect can be obtained. If the dielectric sleeve or roller is used, a float electrode may be disposed on its surface.

Further, the full turn-on exposure during the inter-image period may be carried out by another dedicated exposure device, without using the device 7 for the image exposure. In this case, if the operation of the charging device, e.g., shown in FIG. 36 is to be conducted in accordance with the sequence indicated by (#3), the dedicated exposure device is disposed at a position downstream to the transfer roller 40 and upstream to the charging device 2.

EMBODIMENT 56

In the printer shown in FIG. 17, the photosensitive drum 1 and the toner are replaced with those which are positively chargeable, and the polarity of the power supply is inverted. In this case, the photosensitive drum 1 is of the positively chargeable type and includes a charge transporting layer formed on a cylindrical aluminium substrate. The charge transporting layer includes special α-type phthalocyanine (Toyo Ink Kabushiki Kaisha), acrylic melamine thermosetting resin, 4-diethylaminobenzaldehyde-dephenylihydrazone and others.

The toner is positively chargeable polyester-contained toner having a mean diameter of 10 μm and a distribution, in which 80 weight percents are included in a range of the particle diameters from 7 μm to 13 μm.

Using the printer described above, the printing of 500 sheets by intermittently repeating printing of one sheet and the continuous printing of 500 sheets were carried out. The obtained result is the same as that of the embodiment 55.

Figure 37:
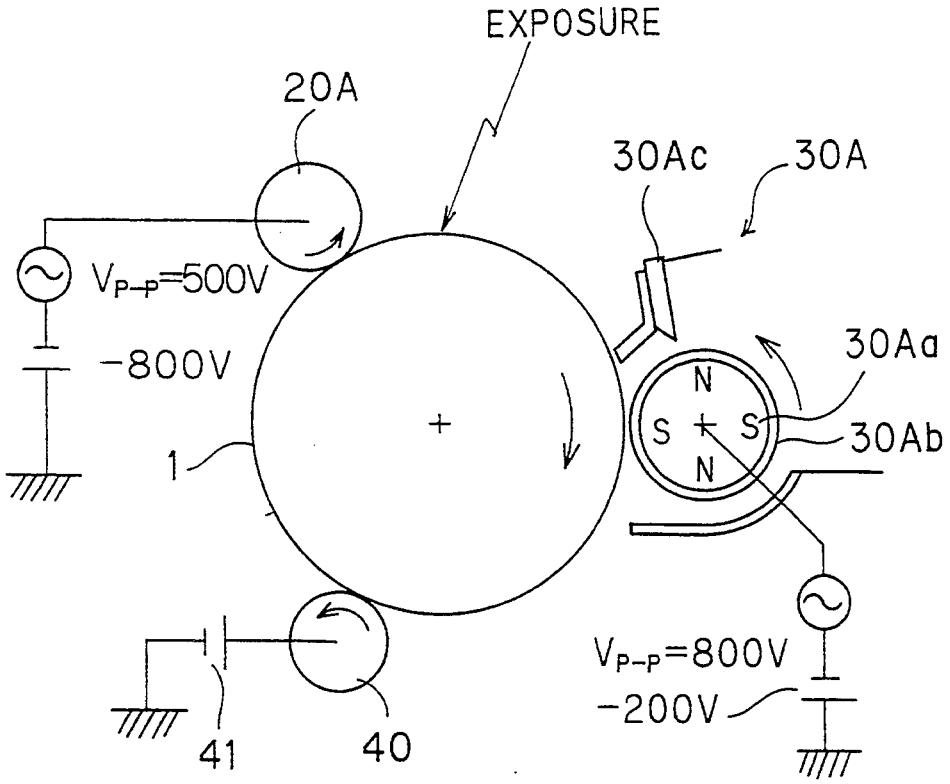
FIG. 37 shows a part of a construction of a printer of further another embodiment of the invention.

EMBODIMENT 57 (see FIG. 37)

In the printer shown in FIG. 17, the developing device 3 is replaced with a so-called jumping developing device 30A shown in FIG. 37, and the charging device 2 is replaced with a charging roller 20A.

The charging roller 20A receives the D.C. component of 800 V and A.C. component of 500 V at peak to peak, whereby the surface of the photosensitive drum 1 is charged to have the surface potential Vo of −800 V.

The charging device 30A includes a fixed magnet 30Aa and a non-magnetic developing sleeve 30Ab, which rotates around the magnet 30Aa at a speed equal to the peripheral speed of the drum 1. The sleeve 30Ab receives the D.C. component of 200 V and A.C. component of 800 V (500 Hz) at peak to peak. The toner is magnetic and negatively chargeable toner. The toner is transported to the developing region at a rate restricted by a toner restriction blade 30Ac, at which it flies from the sleeve 30Ab, to which the A.C. developing bias is applied, to the electrostatic latent image on the drum 1.

In the embodiment 57, the printing of 500 sheets were carried out by intermittently repeating the printing of one sheet bearing a character chart at the B/W ratio of 2.5%, in accordance with the same sequence as that shown in FIG. 36. In this case, the toner consumption was small.

Figure 38:
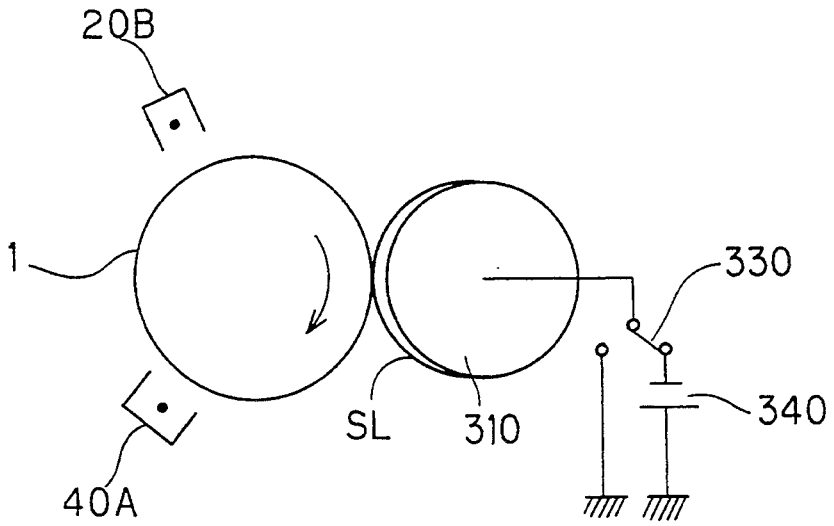
FIG. 38 shows a part of a construction of a printer of still another embodiment of the invention.
Figure 39:
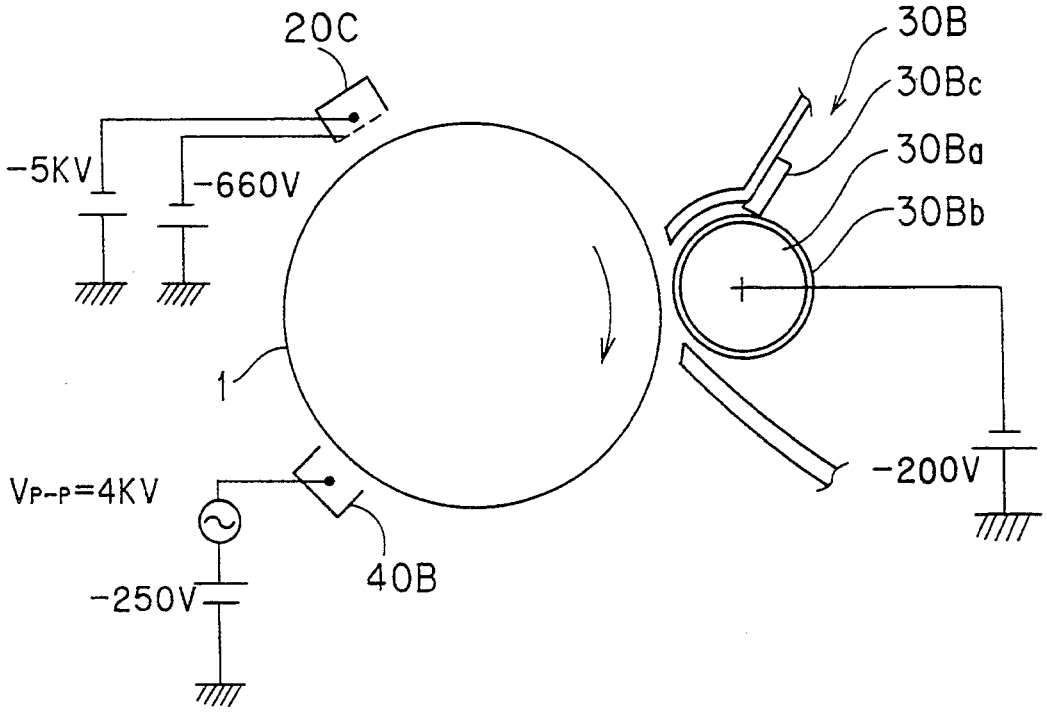
FIG. 39 shows a part of a construction of a printer of yet another embodiment of the invention.
Figure 40:
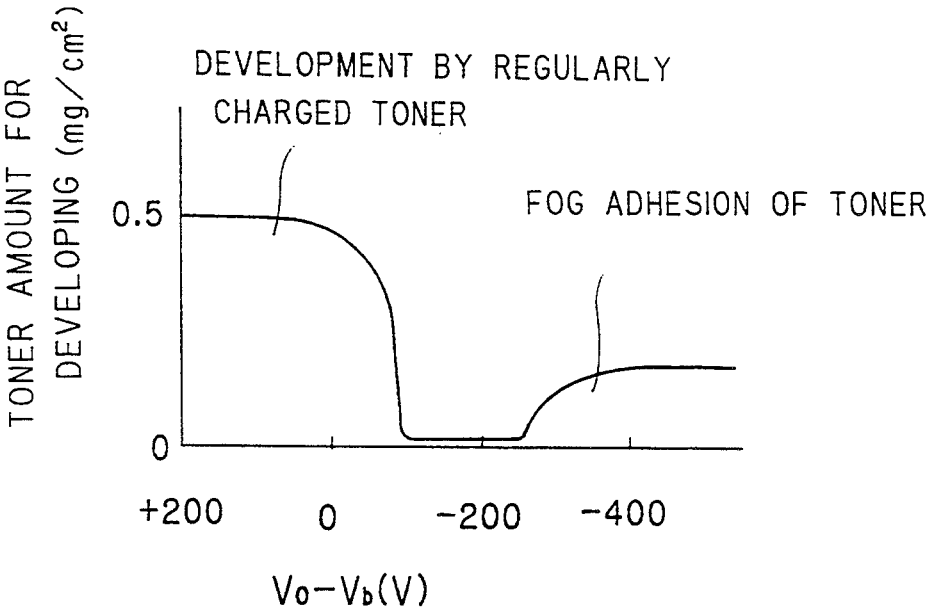
FIG. 40 is a graph showing a toner amount for developing under various difference between a surface potential of a photosensitive drum and a developing bias potential.

EMBODIMENT 58 (see FIG. 38)

In the printer shown in FIG. 17, the charging device 2 is replaced with the charger 20B, which charges the surface of the photosensitive drum 1 at −600 V (Vo=−600 V) to obtain the post-exposure potential Vi of −70 V.

In the printer shown in FIG. 17, the transfer device 4 is replaced with a transfer charger 40A. The toner and other are the same as those for the printer in FIG. 17. The printer carried out, as an embodiment 58, the printing of 500 sheets by intermittently repeating the printing of one sheet bearing a character chart at the B/W ratio of 2.5%. In this case, the toner consumption was small.

EMBODIMENT 59

In the printer shown in FIG. 17, the charging device 2 is replaced with a charger 20C, the developing device 3 is replaced with a two-component developing device 30B, and the transfer device 4 is replaced with a transfer charger 40B.

The voltage of −5 KV is applied to the transfer charger 20C at a charger wire thereof, and the voltage of −600 V is applied to a control electrode thereof. The developing device 30B includes a fixed magnet 30Ba around which a developing sleeve 30Bb rotates. The developing bias of −200 V is applied to the sleeve 30Bb. The developer is formed of negatively chargeable toner having a mean particle diameter of 9 μm, which contains, as major component, styrene n-butyl methacrylate, and carrier having a mean particle diameter of 60 μm and containing polyester resin, Fe—Zn ferrite fine particles, carbon black and others. This developer is transported to the developing region at a rate restricted by a restriction blade 30Bc, and is subjected to the development in a form of the magnetic brush. The transfer charger 40B receives a D.C. component of 250 V and A.C. component of 4 KV at peak to peak.

In an embodiment 59, the printer was used to carry out the printing of 500 sheets, in accordance with the sequence similar to that shown in FIG. 36, by intermittently repeating the printing of one sheet bearing a character chart at the B/W ratio of 2.5%. In the result, the toner consumption was small.

As described hereinabove, the present invention can be applied to various kinds of developing devices, and particularly can be effectively applied to the case using the one-component developer.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

an electrostatic latent image carrier having a moving surface to be charged;

contact charging means for selectively applying a first charging voltage and a second charging voltage to said surface to be charged, said second charging voltage having a single polarity that is the same polarity as the first charging voltage;

wherein the second charging voltage is in pulse form; and control means for controlling said contact charging means so that said first charging voltage is applied to an electrostatic latent image forming region of said surface to be charged, and that the voltage applied by said contact charging means is changed from said first charging voltage to said second charging voltage when a region confronting said contact charging means moves from said electrostatic latent image forming region to a nonimage portion in accordance with movement of said surface to be charged.

2. An image forming apparatus, comprising:

an electrostatic latent image carrier having a moving surface to be charged;

contact charging means for selectively applying a first charging voltage and a second charging voltage to said surface to be charged, said second charging voltage having the same polarity as the first charging voltage, wherein the second charging voltage is in a pulse form having a predetermined cycle-period equal to or shorter than a time period which is obtained by dividing a charging width in a moving direction of said surface of said electrostatic latent image carrier through which said charging means contacts said surface to be charged, by a moving speed of said surface to be charged; and control means for controlling said contact charging means so that said first charging voltage is applied to an electrostatic latent image forming region of said surface to be charged, and that the voltage applied by said contact charging means is changed from said first charging voltage to said second charging voltage when a region confronting said contact charging means moves from said electrostatic latent image forming region to a nonimage portion in accordance with movement of said surface to be charged.

3. An image forming apparatus, comprising:

an image carrier having a moving surface to be charged;

first contact charging means for charging the surface at a first charging voltage;

second contact charging means, disposed at a downstream side of the first contact charging means with respect to the moving direction of the surface, for charging the surface at a second charging voltage having the same polarity as the first charging voltage and having an absolute value smaller than that of the first charging voltage;

developing means for developing an electrostatic latent image formed on said image carrier by toner charged with the same polarity as the first and the second charging voltage; and means for removing counter charged toner from the second contact charging means by controlling the first contact charging means and the second contact charging means so that the surface charged by the first charging means is recharged by the second charging means so that counter charged toner which has adhered to the second contact charging means moves to the surface.

4. An image forming apparatus, comprising:

an image carrier having a rotating endless surface to be charged;

contact charging means for selectively applying a first charging voltage and a second charging voltage to the surface, said second charging voltage having the same polarity as the first charging voltage and having an absolute value smaller than that of the first charging voltage; and control means for controlling the contact charging means so that the first charging voltage is applied to an image forming region of the surface and a nonimage forming region of the surface which follows the image forming region, and that the voltage applied by the contact charging means is changed from the first charging voltage to the second charging voltage when the contact charging means contacts again the nonimage forming region, to which the first charging voltage has been applied, in accordance with the rotation of the image carrier.

5. An image forming apparatus comprising:

an electrostatic latent image carrier having a moving surface to be charged;

a contact charger which selectively applies a first charging voltage and a second charging voltage to said surface to be charged, said second charging voltage having a single polarity that is the same polarity as the first charging voltage and having an absolute value smaller than that of the first charging voltage;

a developer which develops an electrostatic latent image formed on an electrostatic latent image forming region of said surface by toner charged with the same polarity as the first charging voltage of the contact charger; and a controller for removing counter charged toner from said contact charger, wherein said controller controls said contact charger so that said first charging voltage is applied to said electrostatic latent image forming region, and that the voltage applied by said contact charger is changed from said first charging voltage to said second charging voltage when a region confronting said contact charger moves from said electrostatic latent image forming region to a non-image portion in accordance with movement of said surface to be charged so that counter charged toner which has adhered to the contact charger moves to the non-image portion when the contact charger is changed from said first charging voltage to said second charging voltage.

6. An image forming apparatus comprising:

electrostatic latent image carrier having a moving surface to be charged;

contact charging means for selectively applying a first charging voltage and a second charging voltage to said surface to be charged, said second charging voltage having a single polarity that is the same polarity as the first charging voltage and having an absolute value smaller than that of the first charging voltage;

developing means for developing an electrostatic latent image formed on an electrostatic latent image forming region of said surface by toner charged with the same polarity as the first charging voltage of the contact charging means;

means for removing counter charged toner from the contact charging means by controlling said contact charging means so that said first charging voltage is applied to said electrostatic latent image forming region of said surface to be charged, and that the voltage applied by said contact charging means is changed from said first charging voltage to said second charging voltage when a region confronting said contact charging means moves from said electrostatic latent image forming region to a non-image portion in accordance with movement of said surface to be charged so that counter charged toner which has adhered to the contact charging means moves to the non-image portion when the contact charging means is changed from said first charging voltage to said second charging voltage 7. An image forming apparatus of claim 6, wherein said control means controls said contact charging means so that the voltage applied by said contact charging means is changed from said first charging voltage to said second charging voltage during a non-image period, and then the voltage applied by said contact charging means is changed from said second charging voltage to said first charging voltage after said second charging voltage is applied for a predetermined time period.

8. An image forming apparatus of claim 7, wherein said control means controls said contact charging means so that a plurality of voltage in a pulse form are formed during said non-image period by repeating an operation in which the voltage applied by said contact charging means is changed from said first charging voltage to said second charging voltage, and then the voltage applied by said contact charging means is changed from said second charging voltage to said first charging voltage after said second charging voltage is applied for a predetermined time period.

9. An image forming apparatus of claim 7, wherein said predetermined time period is equal to or shorter than a time period which is obtained by dividing a charging width in a moving direction of said surface of said electrostatic latent image carrier through which said charging means contacts said surface to be charged, by a moving speed of said surface to be charged.

10. An image forming apparatus comprising:

an electrostatic latent image carrier having a rotating endless surface to be charged;

contact charging means for selectively applying a first charging voltage and a second charging voltage to said surface to be charged, said second charging voltage having the same polarity as the first charging voltage;

latent image forming means which forms an electrostatic latent image on said surface to be charged, which is charged with said first charging voltage;

developing means, which is disposed at a developing position downstream of said contact charging means in a moving direction of said surface to be charged, for developing said electrostatic latent image with toner;

sheet feeding means, which is disposed at a sheet feeding position downstream of said developing means in the moving direction of said surface to be charged, for feeding a transfer sheet to said developed electrostatic latent image;

transfer means, which is disposed at a transfer position downstream of said sheet feeding position in the moving direction of said surface to be charged, for selectively applying a first transfer voltage of a polarity opposite to that of the toner and a second transfer voltage, which has the same polarity as the toner and has an absolute value larger than that of the second charging voltage;

control means for controlling said contact charging means to apply said first charging voltage to an electrostatic latent image forming portion of said surface to be charged, for controlling said latent image forming means to form an electrostatic latent image in a region charged with said first charging voltage, for controlling said developing means to develop said electrostatic latent image, for controlling said sheet feeding means to feed said transfer sheet to said developed electrostatic latent image, and for controlling said transfer means to apply said first transfer voltage to said fed transfer sheet; and removing means for removing counter charged toner from the contact charging means by controlling said transfer means to apply said second transfer voltage to a nonimage portion of said surface to be charged, and for controlling said contact charging means to apply said second charging voltage to said nonimage portion to which has been applied the second transfer voltage so that counter charged toner which has adhered to the contact charging means moves to the nonimage portion of said surface.

* * * * *